United States Patent [19]

Cotton, Jr. et al.

[11] 4,449,437

[45] May 22, 1984

[54] AUTOMATIC PIANO

[75] Inventors: Robert B. Cotton, Jr., Erlanger, Ky.; Dale M. Uetrecht, Colerain Township, Hamilton County, Ohio

[73] Assignee: Baldwin Piano & Organ Company, Cincinnati, Ohio

[21] Appl. No.: 304,404

[22] Filed: Sep. 21, 1981

[51] Int. Cl.[3] ..... G10H 1/38; G10H 1/46; G10H 7/00

[52] U.S. Cl. ..... 84/1.01; 84/1.1; 84/1.27; 84/345; 84/370; 84/DIG. 22

[58] Field of Search ..... 84/1.01, 1.03, 1.17, 84/1.24, 343–345, 369, 370, DIG. 12, DIG. 22, 1.09, 1.1, 1.27

[56] References Cited

U.S. PATENT DOCUMENTS

| | | | |
|---|---|---|---|
| 4,067,253 | 1/1978 | Wheelwright et al. | 84/1.24 X |
| 4,132,141 | 1/1979 | Campbell et al. | 84/1.1 X |
| 4,248,118 | 2/1981 | Hall et al. | 84/1.01 |
| 4,292,874 | 10/1981 | Jones et al. | 84/1.03 |
| 4,294,155 | 10/1981 | Turner | 84/1.01 |
| 4,311,076 | 1/1982 | Rucktenwald et al. | 84/1.03 |
| 4,311,077 | 1/1982 | Hall | 84/1.01 |
| 4,312,257 | 1/1982 | Kato et al. | 84/1.03 |
| 4,315,451 | 2/1982 | Uchiyama et al. | 84/1.03 |
| 4,344,345 | 8/1982 | Sano | 84/1.03 |
| 4,351,221 | 9/1982 | Starnes et al. | 84/1.1 X |

*Primary Examiner*—Stanley J. Witkowski
*Attorney, Agent, or Firm*—Kirkland & Ellis

[57] ABSTRACT

The present invention is an electronic piano that includes various "easy play" features that enable a person with little musical training to play the piano producing music similar to that of a skilled musician. The "easy play" feature automatically creates musical and rhythmic piano accompaniment patterns in response to playing either one key (One Finger Chord mode) or a chord (Funchords mode) with the left hand. The player plays the melody of the desired tune with the right hand. Instead of having to move the fingers of the left hand to play complex piano accompaniment patterns, as with a conventional piano, the player only needs to play a note or chord, and move the finger or fingers of the left hand to a different playing key or keys to change chords and patterns. In the standard piano mode, this instrument resembles an acoustic piano in function. The invention also includes a set of pushbutton switches which control the "easy play" features of the instrument. The features in the invention include: Funchords, One Finger Chord, Dynamic Pro Harmony, Harmony Dynamic Adjustment, Minor Touch Strip, Arpeggio Touch Strip, Style Selector, Style Expanders, Coupler, Manual Advance, Staccato, and Memory.

47 Claims, 15 Drawing Figures

C
+15V
(10 F8)
10K
7417
M3 PORT I
307b
307c
307d
307a
214
4556
X58
A
B
E
Q0
Q1
Q2
Q3
D

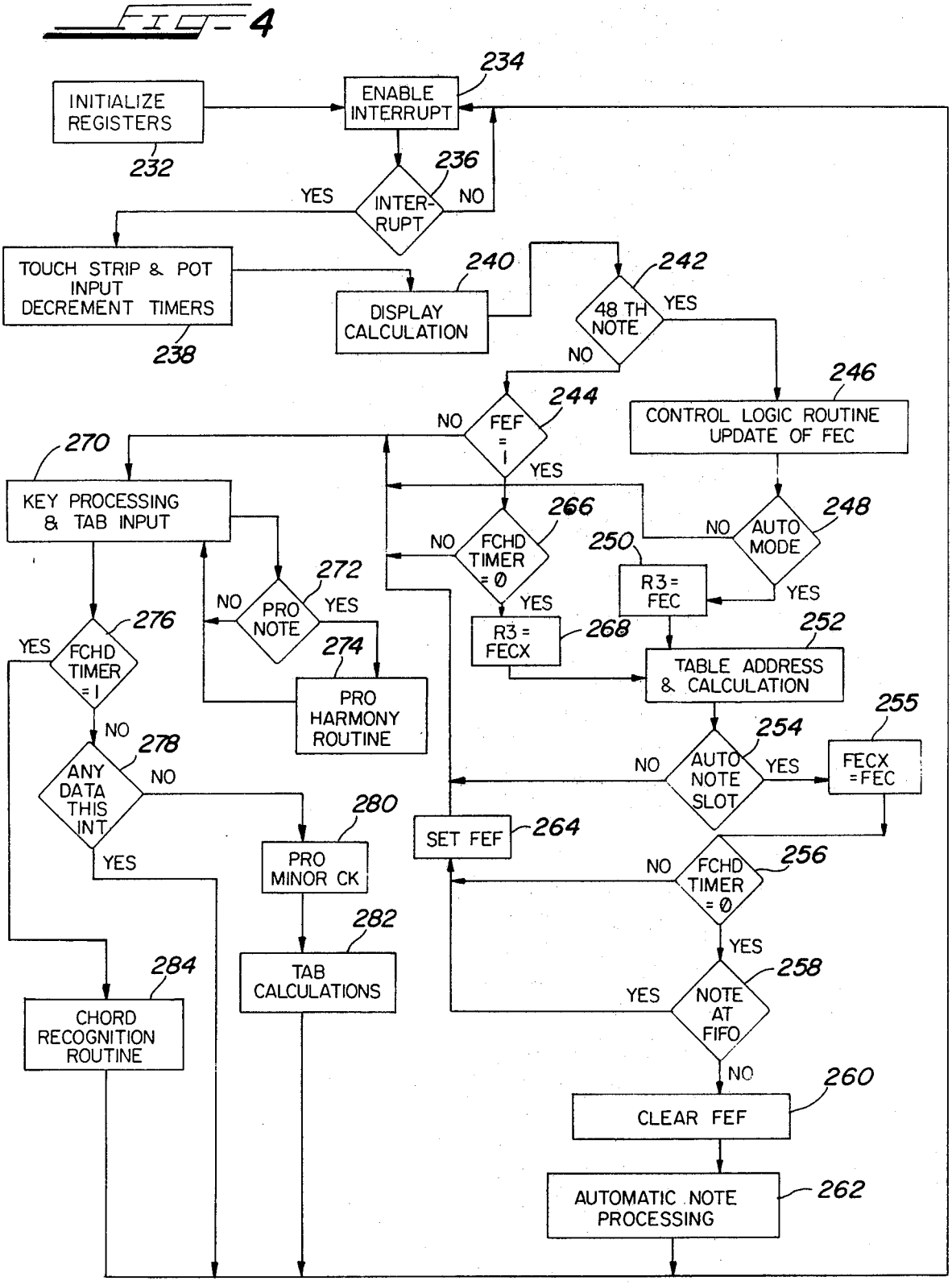
FIG-4
INITIALIZE REGISTERS
232
ENABLE INTERRUPT
234
INTER-RUPT
236
YES
NO
TOUCH STRIP & POT INPUT DECREMENT TIMERS
238
DISPLAY CALCULATION
240
48 TH NOTE
242
YES
NO
CONTROL LOGIC ROUTINE UPDATE OF FEC
246
FEF = 1
244
NO
YES
KEY PROCESSING & TAB INPUT
270
FCHD TIMER = 0
266
NO
YES
AUTO MODE
248
NO
YES
R3 = FEC
250
R3 = FECX
268
TABLE ADDRESS & CALCULATION
252
PRO NOTE
272
NO
YES
PRO HARMONY ROUTINE
274
FCHD TIMER = 1
276
YES
NO
ANY DATA THIS INT
278
NO
YES
PRO MINOR CK
280
TAB CALCULATIONS
282
CHORD RECOGNITION ROUTINE
284
AUTO NOTE SLOT
254
NO
YES
FECX = FEC
255
SET FEF
264
FCHD TIMER = 0
256
NO
YES
NOTE AT FIFO
258
YES
NO
CLEAR FEF
260
AUTOMATIC NOTE PROCESSING
262

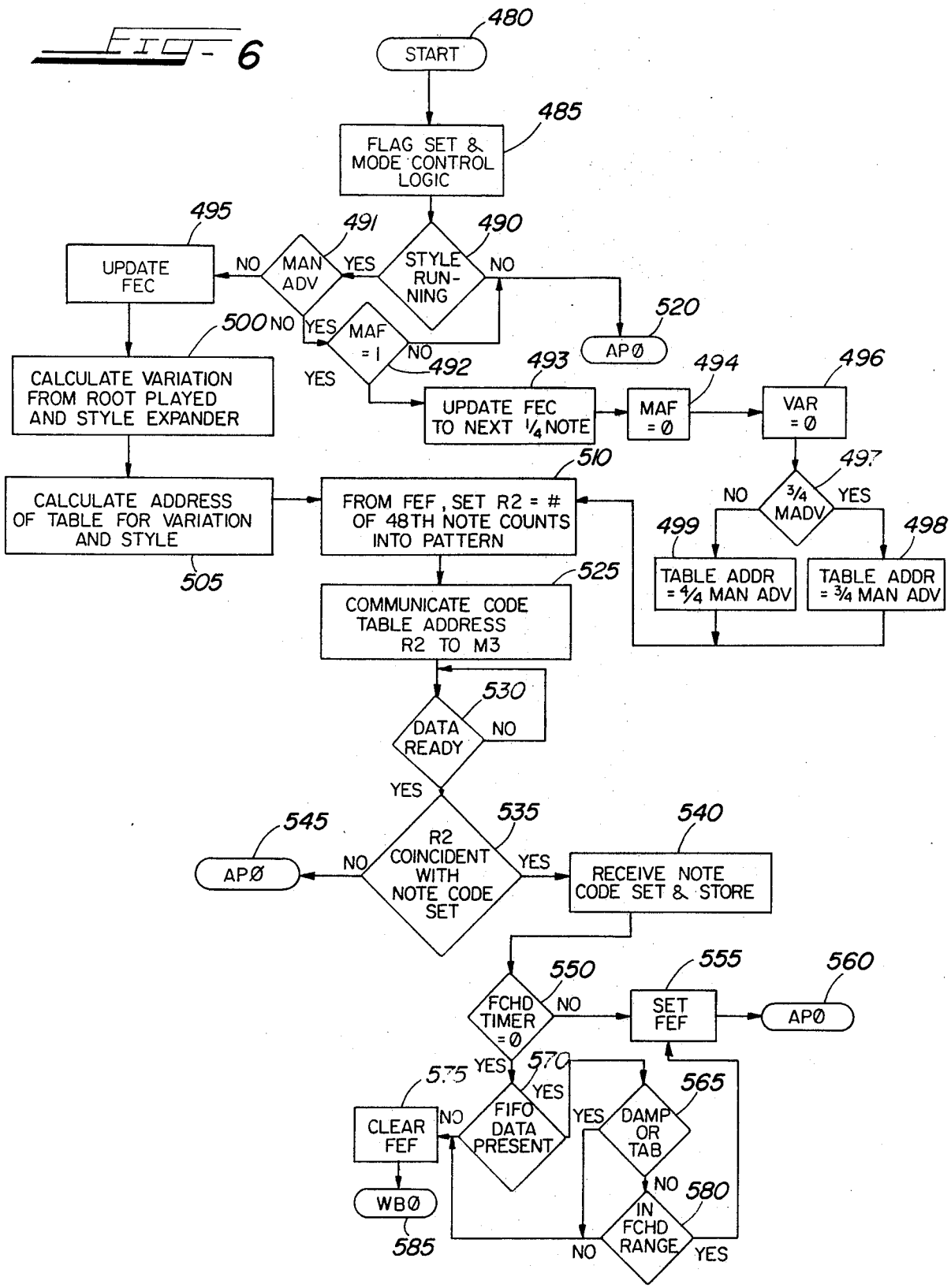
FIG-6
480
START
485
FLAG SET & MODE CONTROL LOGIC
490
STYLE RUN-NING
NO
520
AP∅
491
MAN ADV
YES
NO
495
UPDATE FEC
492
MAF = 1
NO
YES
500
CALCULATE VARIATION FROM ROOT PLAYED AND STYLE EXPANDER
493
UPDATE FEC TO NEXT 1/4 NOTE
494
MAF = ∅
496
VAR = ∅
497
3/4 MADV
NO
YES
499
TABLE ADDR = 4/4 MAN ADV
498
TABLE ADDR = 3/4 MAN ADV
510
FROM FEF, SET R2 = # OF 48TH NOTE COUNTS INTO PATTERN
CALCULATE ADDRESS OF TABLE FOR VARIATION AND STYLE
505
525
COMMUNICATE CODE TABLE ADDRESS R2 TO M3
530
DATA READY
NO
YES
535
R2 COINCIDENT WITH NOTE CODE SET
NO
545
AP∅
YES
540
RECEIVE NOTE CODE SET & STORE
550
FCHD TIMER = ∅
NO
555
SET FEF
560
AP∅
YES
570
FIFO DATA PRESENT
YES
NO
575
CLEAR FEF
WB∅
585
565
DAMP OR TAB
YES
NO
580
IN FCHD RANGE
NO
YES

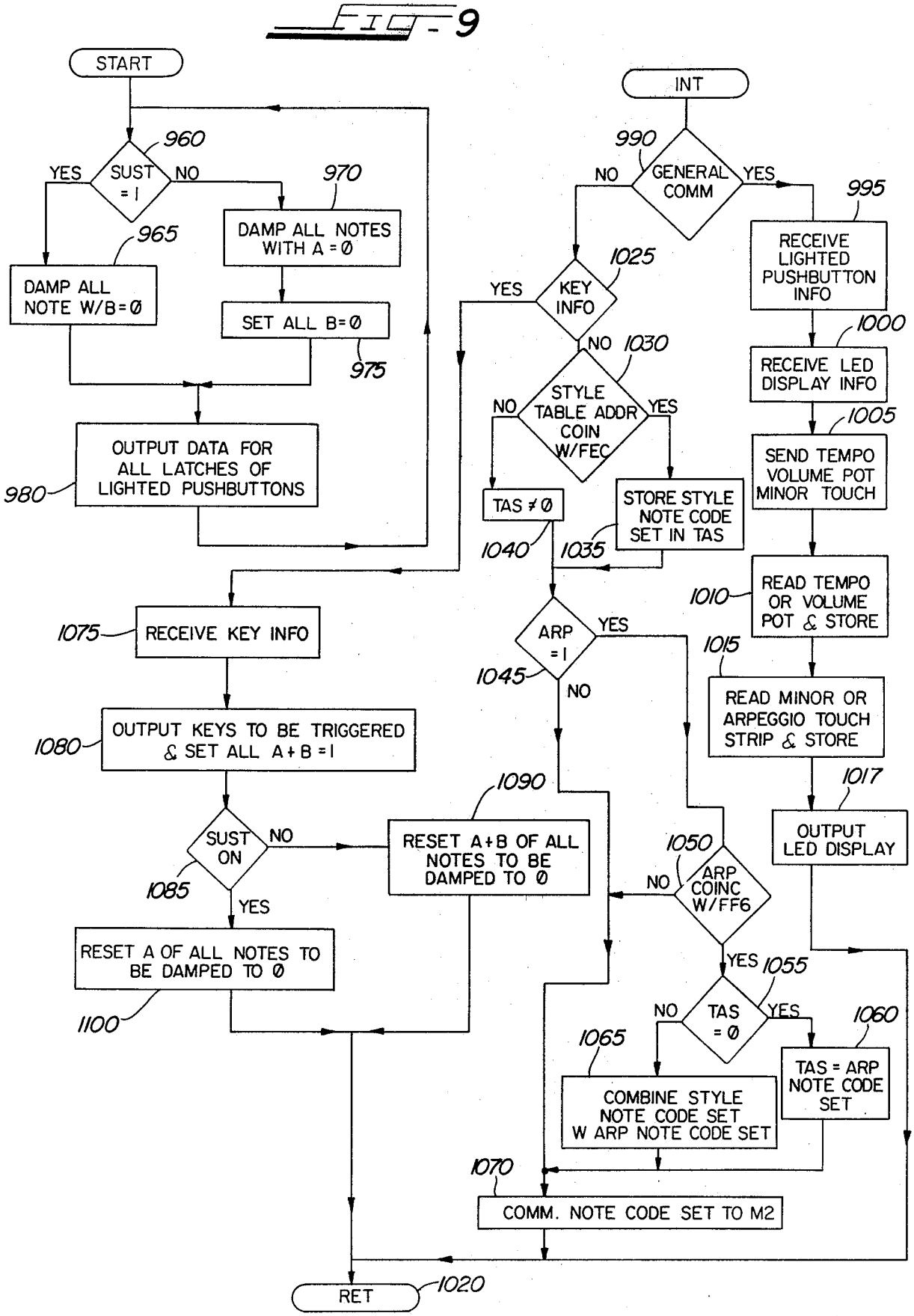
FIG-9
START
SUST = 1
YES
NO
960
965
970
DAMP ALL NOTE W/B=Ø
DAMP ALL NOTES WITH A=Ø
SET ALL B=Ø
975
OUTPUT DATA FOR ALL LATCHES OF LIGHTED PUSHBUTTONS
980
RECEIVE KEY INFO
1075
OUTPUT KEYS TO BE TRIGGERED & SET ALL A+B=1
1080
SUST ON
1085
RESET A OF ALL NOTES TO BE DAMPED TO Ø
1100
RESET A+B OF ALL NOTES TO BE DAMPED TO Ø
1090
INT
GENERAL COMM
990
995
RECEIVE LIGHTED PUSHBUTTON INFO
KEY INFO
1025
STYLE TABLE ADDR COIN W/FEC
1030
TAS ≠ Ø
1040
STORE STYLE NOTE CODE SET IN TAS
1035
ARP = 1
1045
1000
RECEIVE LED DISPLAY INFO
1005
SEND TEMPO VOLUME POT MINOR TOUCH
1010
READ TEMPO OR VOLUME POT & STORE
1015
READ MINOR OR ARPEGGIO TOUCH STRIP & STORE
1017
OUTPUT LED DISPLAY
1050
ARP COINC W/FF6
1055
TAS = Ø
1060
TAS = ARP NOTE CODE SET
1065
COMBINE STYLE NOTE CODE SET W ARP NOTE CODE SET
1070
COMM. NOTE CODE SET TO M2
RET
1020

AUTOMATIC PIANO

BACKGROUND OF THE INVENTION

1. Field of the Invention

The present invention relates to an electronic musical instrument and, more specifically, to an electronic piano which utilizes a microcomputer to detect which keys are being played, the manner in which the keys are being played, and which tab switches have been actuated and to control the sounding of notes in response to the information detected so as to enable the player to produce complex music accurately emulating the sound style of an accomplished pianist.

2. Description of the Prior Art

An electronic musical instrument using continuous tone generators capable of simulating the sounds of a conventional acoustical piano is described in U.S. Pat. No. 4,248,123 issued to Bunger et al., Feb. 3, 1981. The instrument described in the '123 patent includes a gating circuit featuring a switch travel timing circuit having a double-time constant for control of the dynamic range from the keyboard. As noted in the '123 patent, an important element of such instruments involves the electronic circuitry for synthesizing the touch-responsive waveshape envelopes needed to accurately emulate the tonal attack and the decay characteristics of an acoustical piano. The '123 patent discloses the use of a capacitor timing circuit for timing the keyswitch travel to obtain a control potential related to key velocity. The output signal from this circuit was allowed to decay at a double-time constant rate in an effort to provide realistic control over the gating voltages and signal dynamics.

The present invention utilizes a microprocessor to accurately time the keyswitch travel when a key is played. The time measured by the microprocessor is related to a volume level by means of a lookup table stored in a ROM within the microprocessor. The present invention more accurately times keyswitch travel than the capacitor timing circuit described in the '123 patent. In addition, the use of a lookup table containing a value of volume level for each possible travel time within a wide range of travel times provides improved control over the gating voltages and signal dynamics.

The U.S. patent application entitled "Chord Identification System for Electronic Musical Instruments," filed June 18, 1981 by Uetrecht and Simmons, Ser. No. 275,082 and now U.S. Pat. No. 4,389,914 describes a method and apparatus for identifying a chord played on a keyboard of a musical instrument and for identifying the root and the type of chord being played. The apparatus described in the foregoing patent application includes a microprocessor to selectively cause the associated circuitry of the pedal and accompaniment keyboard of the instrument to play automatically either the identified root or a sequence of notes compatible with the identified root and chord. The apparatus described in the foregoing patent application performs the chord identification function through a logical sequence of tests which determine the existence of root intervals, the number of notes, and whether the chord is a major or minor chord. The present invention improves upon the method of identifying chords described in the foregoing patent application. The improvement of the present invention allows for the identification of diminished, augmented, and suspended chords.

In addition, the present invention utilizes microprocessor control in a unique way to provide the playing of automatic style patterns and expanded variations of patterns, which are selectable by tabs operated by the person playing the instrument, and which vary in accordance with the key or keys being played.

SUMMARY OF THE INVENTION

The present invention is an electronic musical instrument that includes various features that automatically create musical and rhythmic piano accompaniment style patterns in response to playing either one key (One Finger Chord mode) or a chord (Funchords mode) with the left hand.

Dynamic control from the keyboard is achieved in the present invention by means of a microprocessor which is used to accurately time the keyswitch travel when a key is played. The time measured by the microprocessor is related to a volume level by means of a lookup table stored in a ROM within the microprocessor. This volume level determined by the microprocessor controls the volume at which played notes are sounded.

When the One Finger Chord mode of operation is selected, one of various musical "styles", e.g., ragtime, swing, boogie, etc., can be selected. Selection of a style causes the present invention to commence to generate an automatic pattern of piano tones upon the playing of a key within a predetermined range of keys on a keyboard. The root note of the automatic pattern is determined by the key played. All of the styles consist of automatic piano patterns two measures in length, which are repeated for as long as playing keys within the automatic range are depressed or are under control of a memory switch.

To expand on these automatic patterns, one of six Style Expanders can be selected each, providing a total of eight measure of patterns to add variation to the music. The eight measures are separated into four two-measure patterns. When one of the Style Expanders is selected, one of the four two-measure patterns is selected by processor means so as to achieve the optimum musical effect for the root note played at a given time, causing the variation changes to occur automatically.

The Funchords mode of operation of the automatic patterns is similar in operation to the One Finger Chord mode; however, in the Funchords mode at least three keys must be played, and the root is identified by a microprocessor from the notes played. In the Funchords mode, augmented, diminished, and suspended chords are determined by processing one predetermined set of data tables.

In either of the two automatic modes, One Finger Chord or Funchords, whenever the Pro Harmony feature is selected and a right hand note (i.e., a note to the right of the automatic range of notes on the keyboard) is played, a fill-in harmony of notes is played along with the right-hand note. These notes are the notes of the chord played (a triad of the root note in One Finger Chord mode) or the actual keys depressed (in the Funchords) but sounded in the octave below the right-hand note.

The coupler feature is another right-hand fill-in effect that, when selected, allows the playing of a note or notes one or more octaves above the treble note that is actually being played. In the preferred embodiment, the coupler feature causes a note to play two octaves higher than the note that is actually struck, causing both notes to sound.

The manual advance feature of the present invention allows a player to play automatic accompaniments without having to keep to the tempo that is generated by the instrument. Either a 4/4 manual advance pattern or a ¾ manual advance pattern can be selected. These patterns are programmed so that all notes fall on a quarter note time slot. These patterns only advance to and play the next quarter note when the player plays a new note (or a new chord when in the Funchords mode).

A feature of both the One Finger Chord mode and the Funchords mode is the playing of a root bass note whenever a key is played that changes the root note, making it impossible to play a new note or chord without having notes play.

A staccato feature operates in either of the two automatic modes to provide a more crisp sound to the automatic styles in the preferred embodiment. When the staccato feature has been selected, the instrument operates as when in the One Finger Chord or Funchords mode, except that all automatic notes that are keyed are damped on the following 48th note.

BRIEF DESCRIPTION OF THE DRAWINGS

FIG. 4 is a system flow diagram for a second microcomputer used in the present invention.

FIG. 6 is a flow diagram of the routine used to calculate table addresses in the present invention.

FIG. 9 is a system flow diagram for a third microcomputer used in the present invention.

DETAILED DESCRIPTION OF THE PREFERRED EMBODIMENT

A. System Block Diagram

Figure 2:
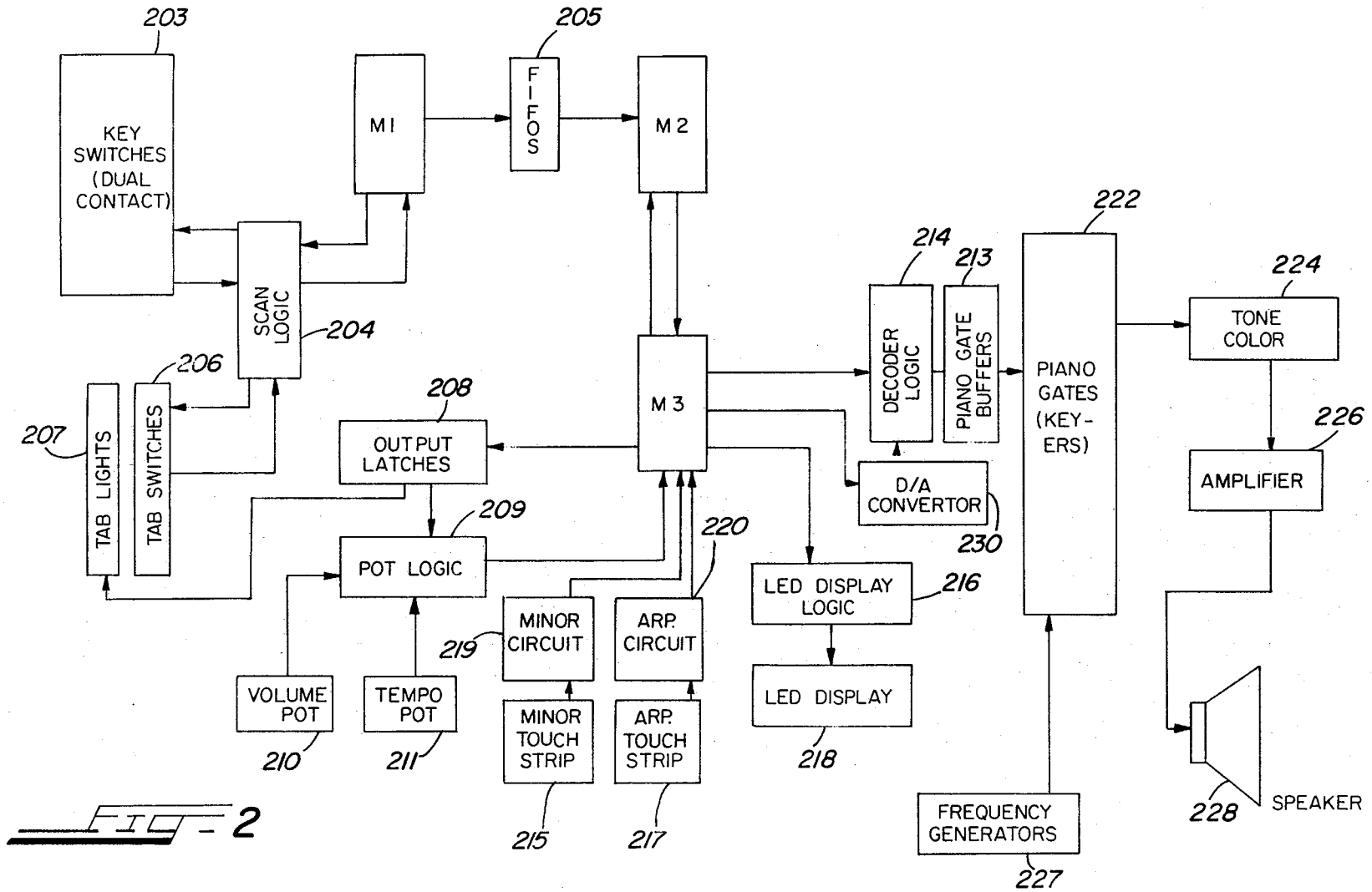
FIG. 2 is a schematic block diagram of the preferred embodiment of the present invention.

Referring to the schematic block diagram of the system of the present invention in FIG. 2, it can be seen that the electronics for this instrument utilizes three microprocessors M1, M2, and M3. Logic circuitry 204 is used to scan the 88 dual-contact keyswitches 203 and lighted pushbutton tab switches 206, which are used for controlling all logical functions, as described hereinafter. Two FIFO circuits 205 are used for communicating information between processors M1 and M2. Volume is controlled by potentiometer 210 and tempo is controlled by potentiometer 211, both of which are read by hardware logic circuitry 209. Decoder logic 214 controls 88 piano frequency gates 222. The piano frequency gates 222 control keying, sustain, and damping of signals from frequency generators 227 which are gated to tone color circuitry 224. Analog to digital convertor 230 controls key volume. An audio amplifier 226 amplifies tones received from the tone color circuitry 224 to drive the speaker 228. A four-digit LED display 218 is driven by hardware logic circuits 216 to display information such as beat number, selected tempo rate and the number of sharps and flats for a given musical key.

Processor M1 scans all keyswitches 203 and tab pushbuttons 206. It also times the travel of the keyswitches 203 to calculate dynamic information which is used to control the volume of the notes, as described hereinafter. Processor M1 then communicates this information a byte at a time to processor M2 through two 16×4 bit FIFO (first in, first out) integrated circuits 205, which can be a commercially available type CMOS 40105.

Processor M2 receives all keyswitch and tab switch information from processor M1 via the FIFO's 205 and is responsible for making most logical decisions concerning the operation of the piano, as described hereinafter. Processor M2 outputs the keyswitch and tab switch information to processor M3.

Processor M3 has two major tasks. It stores all of the pattern information for the automatic operation of the piano. Also, in response to the communications it receives from processor M2, processor M3 performs all outputting of information to the instrument's tone signal gates 222, the LED display logic 216, and LED display 218, potentiometer reading logic circuitry 209, and output latches 208 which control tab lights 207.

B. Keyswitch Scanning and Dynamic Control

As illustrated in FIG. 2, processor M1 scans all 88 piano keyswitches 203. Each piano key operates two switch contacts (shown schematically in FIG. 3*a*) made up of a single pole double throw switch 116. When a keyswitch 116 is at rest (in the "up" position), one of the two contacts 112 (referred to as the normally closed, NC, contact) is closed and the other contact 114 (referred to as the normally open contact, NO) is open. As the key (not shown) is initially depressed, the NC contact 112 first opens, and when the key is depressed farther, the NO contact 114 closes. The time between the opening of the NC contact 112 and the closing of the NO contact 114 varies, depending on the velocity at which the key is depressed, i.e., how hard the key is struck. If the key is struck hard, this time will be short, i.e., on the order 4 to 6 milliseconds. If the key is struck lightly, the time will increase to as much as 100 milliseconds.

This keyswitch arrangement is used to control the dynamics of the piano. In prior art electronic musical instruments, a capacitor discharges during the abovementioned time interval during which a key is being struck and is traveling downward. Depending on the length of time for the discharge, a higher or lower voltage is applied to the keying gate of the piano corresponding to that piano key. Because the amplitude of the output of each keying gate is functionally related to the keying voltage applied, the dynamics of each corresponding tone envelope are thus controlled by the speed with which the key is struck.

In the present invention, the keyswitch arrangement is similar, but an improved method of timing key travel is used. Timing is accomplished in the present invention by processor M1 instead of a capacitor, thereby providing more accurate timing measurement as well as the ability to automatically adjust the amplitude of the tones relative to the key depression time to any desired taper.

Figure 3A:
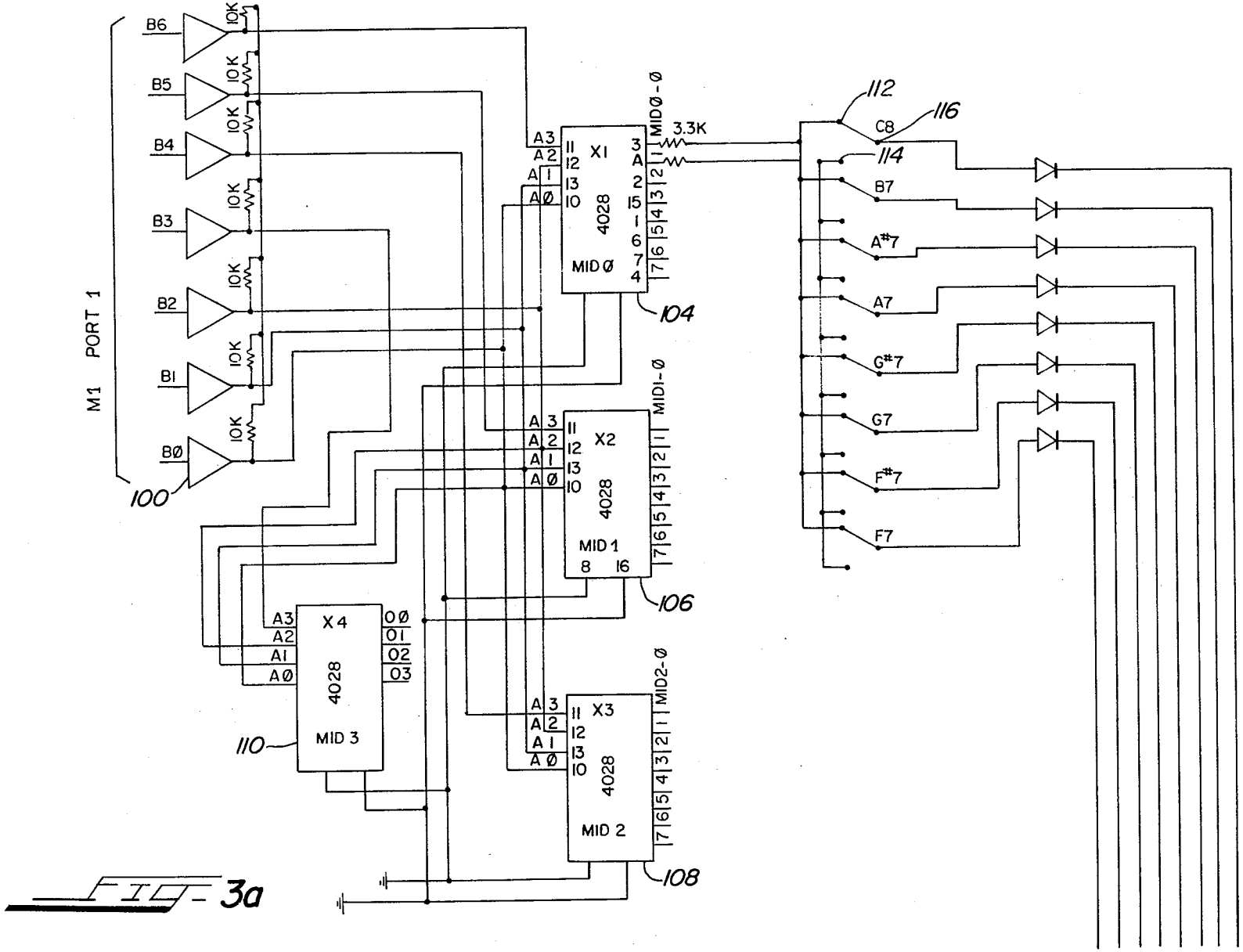
FIG. 3*a* and 3*b* are a schematic diagram illustrating the electronic circuitry for interfacing and scanning the switches associated with all playing keys and tabs.
Figure 3B:
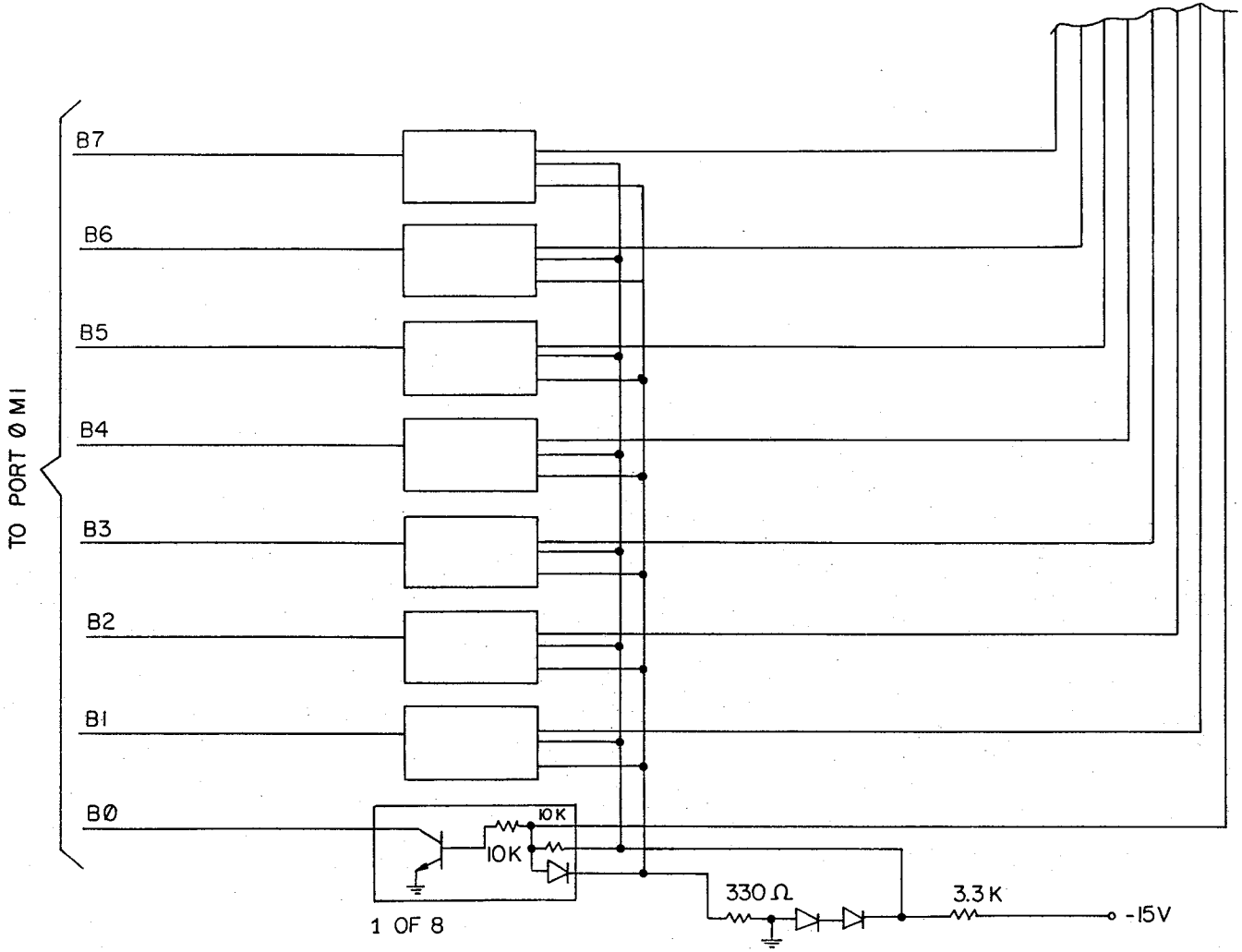

The keyswitches 203 in the present invention are arranged in eleven groups of eight switch pairs. With reference to FIG. 3*a* port 1 or processor M1 provides the logic to scan all NC and NO switch contacts through a buffer 100 which translates the processor 5 volt logic to 15 volt logic, and three one-of-eight decoders 104, 106, and 108, which can be commercially available type CMOS 4028. Eight of the outputs of each decoder 104, 106, and 108 are used, providing a total of 24 scan lines (only 22 are actually used). Each of these 22 scan lines becomes active sequentially and each is connected to a group of eight NO keyswitch contacts 114 or NC keyswitch contacts 112. This hardware configuration is used to multiplex the keyswitches, using port 0 or processor M1 to input the keyswitch information to the processor M1.

C. Processor M1

Microprocessor M1 scans all NC key contacts 112 and NO key contacts 114 and times the travel of each piano key to determine the appropriate amplitude to be output for that key. Processor M1 also scans all the tab control switches 206. All this information is conveyed to processor M2 by use of two 16×14 FIFO integrated circuits 122 and 124 shown in FIG. 3*c*.

The operation of processor M1 will now be described with reference to FIGS. 2 and 3*a–e* which illustrate the associated hardware, and to the flowcharts in FIGS. 1*a* and 1*b*, which contain a flow diagram for the logic of processor M1.

Figure 1A:
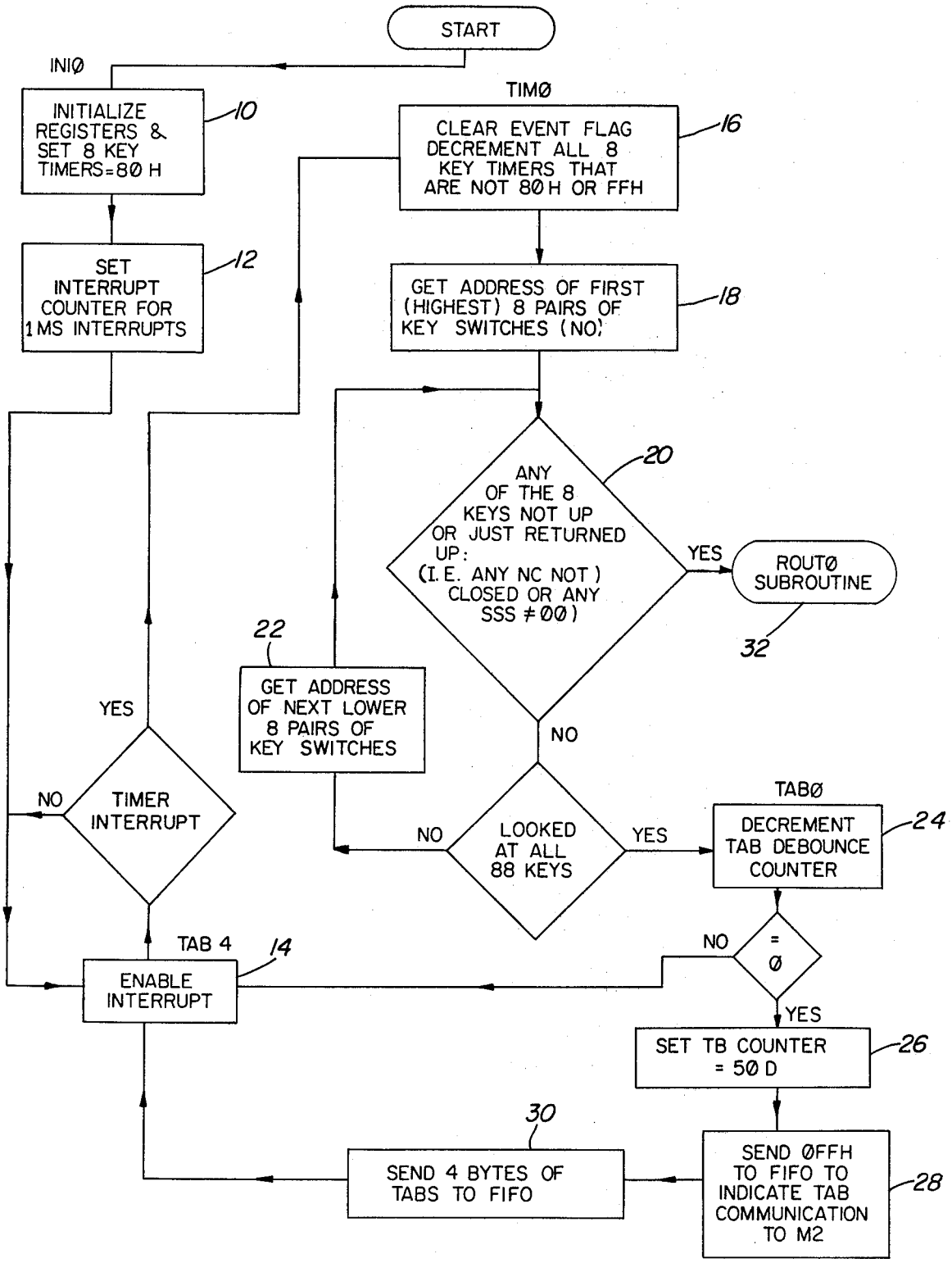
FIG. 1*a* is the first portion of a system flow diagram for a first microcomputer used in the present invention.

Processor M1 begins program execution by initializing its 64 8-bit (one byte) registers (block 10), in FIG. 1*a* and then sets its interrupt timer (block 12) to cause one millisecond interrupts. This means that every millisecond, the processor M1's interrupt routine will be executed (see FIGS. 1*a* and 1*b*). At the end of execution of the interrupt routine, processor M1 will execute a loop (block 14) and wait for the next interrupt from the interrupt timer (not shown), which is part of the 3870 microprocessor. The relatively short interrupt time of one millisecond enables the processor M1 to time the travel of each struck piano key between the time its normally closed (NC) contact 112 opens, as the key begins its travel down, until its normally open (NO) contact 114 closes, as the key is depressed further. This travel time can vary between 100 milliseconds for a softly-hit key to as little as 4 milliseconds for a key struck very hard. In order to time intervals as short as this with acceptable accuracy, it is necessary to check the status of all keys every millisecond.

A set of 22 processor registers (not shown) in M1 keeps track of the status of all 88 piano keys, each set of 8 adjacent keys sharing two adjacent registers in processor M1. These registers, called switch scan status registers, will be referred to hereinafter as SSS registers (not shown); the individual 2-bit status code for each kay, which comprises two bits of the same bit number in adjacent bytes of SSS, will be referred to hereinafter as the SSS code for a given key. For example, if bit 3 of the first byte of SSS=1 and bit 3 of the second byte of SSS=0, then the SSS code for the highest A note on the piano (referred to as A7) would be 10. Only three of the four possible SSS codes are used: 00 indicates that a key is up (NC contact closed), 10 indicates that a key is on its way down (NC and NO contacts open), and 11 means the key has hit bottom (NO contact closed).

Another group of registers in processor M1 used for storing the status of keys are eight key timer registers, referred to hereinafter as KTIM registers (not shown), and eight key number registers, referred to hereinafter as KNUM registers (not shown). The KTIM registers are used to time the travel of the keys that are being depressed, and the KNUM registers are used to keep track of which key is in which KTIM register at a given time. The use of the eight KTIM registers in the present invention allows the saving of substantial processor memory. If a register was required as a timer for each key, for example, 88 processor registers would be used, instead of the 16 used here for KTIM and KNUM memory. The limitation imposed by the use of only eight KTIM registers and eight KNUM registers is the inability to time the travel of more than eight keys simultaneously. However, the significance of this potential drawback is minimized by clearing the KTIM register and KNUM register being used for a particular key as soon as the NO contact 114 for that key is closed. Therefore, even while a key is held down, its timer (i.e., the temporarily assigned KTIM and KNUM registers) is cleared and available for timing another key when it is struck. In the unusual event that eight keys happen to be traveling down simultaneously so that no timer is available for the ninth key that is struck, the timer value assigned to that ninth key is that of the most recently timed key. Laboratory tests demonstrate that this latter occurrence is rare, even with complex piano playing.

Continuing on with the flowchart in FIG. 1*a*, the heart of the routine executed by processor M1 in the present invention is the scanning of the keyswitches 203, which is illustrated in blocks 18 to 24. In these steps processor M1 scans each of the eleven sets of eight dual (NC and NO) key contacts 112 and 114 (se FIG. 3*a*). An assumption is made here that at any given time the majority of keys 203 will be at rest in the up position. So in the interest of obtaining shorter processing time, processor M1 looks only at the NC contacts 112 and the left bit of the corresponding SSS code for each group of eight keys. Examining a given group of NC contacts 112 and the left bit of their corresponding SSS code, if the contacts 112 all are closed and the left SSS codes are all 0, then those eight keys are all at rest in the up position (and, as indicated by the left SSS codes being 0, were also up during the previously run interrupt), and no processing is required for those keys. (Only the left SSS bit need to be examined, since in the preferred embodiment the SSS code 01 does not exist; if the left bit is 0 then the right bit also is 0.) This method of scanning allows processor M1 to examine all 88 piano keys 203 in approximately 500 microseconds, if no keys require any processing (i.e., if no keys have been played). Although the flow diagram FIG. 1*a* illustrate this scanning routine as a computer looping operation, in the preferred embodiment processing time is shortened by replacing the loop with eleven separate, sequentially-run sets of program code, each of which examines one set of eight keys.

The most probable state of any key at a given time is at rest in the up position, and the second most probable state is at rest in the down position. Although a key may spend only 4 to 100 milliseconds in travel on its way down or back up, it may be held down by the player for seconds at a time. Therefore, it is important that processor M1 not waste time on keys at rest in the up or down positions. Therefore, processor M1 examines a group of eight keys by means of the keyscan routine 20 in FIG. 1*a* to determine whether one or more of the keys in the group of eight keys is not at rest in the up position. This is accomplished by examining the byte of data corresponding to the eight keys, whereby processor M1 determines whether any key fails to "pass" the "at rest and up" test. In that event, processor M1 executes the logic steps illustrated by subroutine ROUTØ 32 (see FIGS. 1*a* and 1b). This is the routine that first decides whether a key really needs attention and, if so, directs processor M1 to the appropriate area of its program. The first task of ROUTØ 32 is to determine if the keys that did not pass the first scanning test are being held down and hence do not require further processing. If a key is being held down, its NO contact 114 is closed and the right bit of its SSS code is 1. If all keys in the byte are either at rest up or at rest down ROUTØ 32 at 34 immediately returns processor M1 to continue the scanning routine 20 (see FIG. 1*a*).

The other routines performed by processor M1 are explained best in conjunction with the playing of a key. When a key is depressed, its NC contact 112 opens. During the processor M1's next execution of scan routine 20, this opened NC contact 112 causes the ROUTØ subroutine 32 to be executed by processor M1. Because both NC and NO contacts 112 and 114, respectively, are open and the SSS code is 00 (meaning the key was up the last time processor M1 looked at it), processor M1 decides by execution of ROUTØ 32 that at least one of the eight keys in the byte has just been depressed, thereby causing processor M1 to execute the timer assignment routine, TIASØ 58 by way of test 56 (see FIG. 1*b*).

By means of steps illustrated by TIASØ 58, processor M1 finds the first key in the byte that has just been depressed and sets its SSS code to 10, indicating that the key is on its way down. (This will indicate to processor M1 during execution of the ROUTØ 32 routine during upcoming interrupts that the key had been depressed previously.) The present invention utilizes eight, eight-bit registers, which are hereinafter designated as KTIM registers, as timers for timing the travel of a key from the up to the down position when it is struck. Processor M1 finds an available timer (80 hexadecimal in one of the KTIM registers indicates timer availability) and assigns in 60 the keyswitch to that timer by first setting the timer to a value of 97 and then storing the key number in the KNUM register associated with the newly set KTIM register. If no timer had been available, and that would have been indicated by no 80H in any of the eight KTIM registers, then the routine would ignore this key. Next, the event flag is set (see step 64 in FIG. 1*b*). This flag, which is set both by the TIASØ routine 58 and the send key routine, SEKØ 38, causes processor M1 to by-pass execution of certain other routines during the interrupt. This action avoids using processor time for less urgent routines when either the TIASØ or SEKØ routines 58 and 38, respectively, and run during an interrupt. After processor M1 has completed the TIASØ routine 38, it returns to the scan routine 20 (see FIG. 1*a*) and continues examining the rest of the keys 203. This return is similar to a conventional subroutine return, except that in the preferred embodiment the program counter is adjusted in 86 so that the return 88 will cause the scan routine 20 to reexamine the current set of eight keys. There may be other keys in the group of eight that need processing.

Continuing the description of processor M1's operation in connection with the playing of the key that has just been depressed, during subsequent interrupts in the execution of the main program, processor M1 recognizes through execution of the ROUTØ 32 routine that the key is still traveling between the NC and NO contacts, 112 and 114, respectively, because NC and NO are both open. During each one of these one millisecond interrupts, processor M1 decrements by one that key's timer (i.e., KTIM register), which was originally set to 97, by execution of the TIMØ routine 16. (The TIMØ routine 16 also clears the above-mentioned event flag, allowing the DEBØ 72 and SEDØ 82 routines, described hereinafter, to be run if other, more urgent routine are not run first.) Each time TIMØ decrements the key's KTIM register represents another millisecond that it is taking the key to reach the NO contact 114.

Processor M1 recognizes when the key has finally traveled far enough to close the NO contact 114 because execution of the ROUTØ routine 32 recognizes that the NO contact 114 is closed and SSS code for the key is 10. The ROUTØ routine 32 then branches through test 36 to the send key routine, illustrated as SEKØ 38 in FIG. 1*b*. SEKØ routine 38 sets the key's SSS code to 11, which indicates that the key has closed the bottom NO contact 114. Assuming the key had been assigned to a KTIM timer, as illustrated by block 40, and that the timer has not timed out (which occurs if the key takes over 97 milliseconds to close the NO contact 114), as illustrated by block 42, then the SEKØ routine 38 communicates the key value (i.e., the value in the corresponding KTIM register) to the FIFO circuits 122 and 124 (see FIG. 3*c*) by outputting it in 46 to port 4 of processor M1 (see FIG. 3*c*).

Figure 3C:
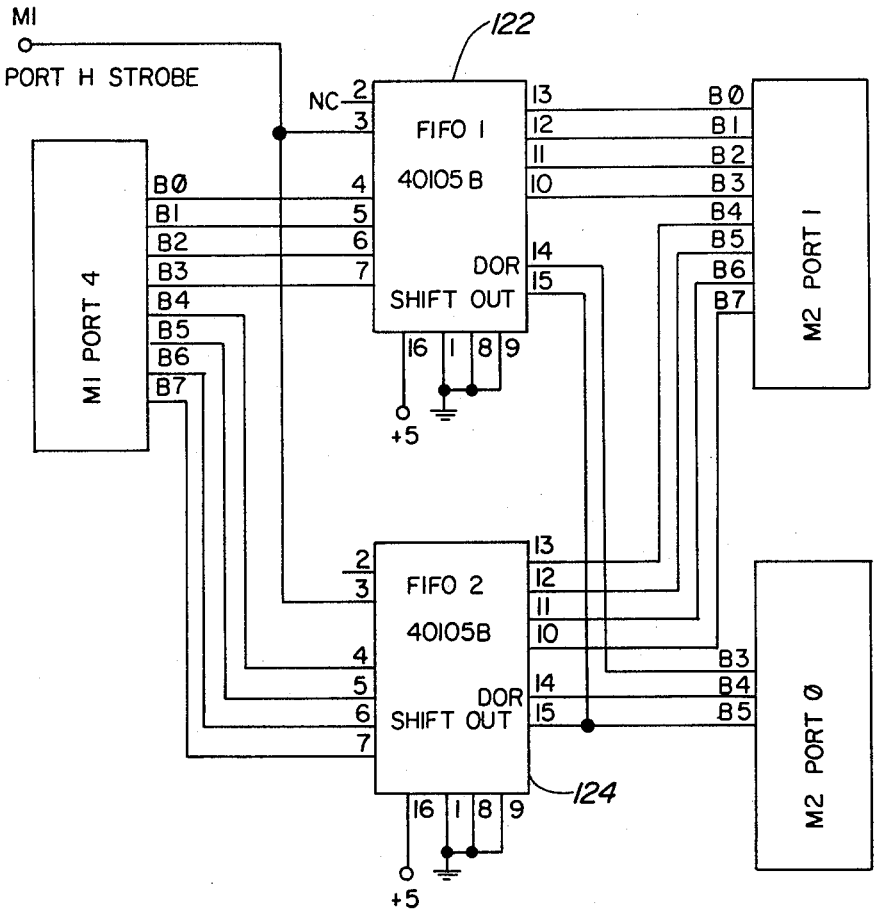
FIG. 3*c* is a schematic diagram illustrating the FIFO circuits by which processor M1 communicates information to processor M2.

Next, processor M1 examines the timer value in the corresponding KTIM register to determine how long it took for the key travel, which indicates how hard the key was hit. In the preferred embodiment of the present invention, the amplitude at which the key is to be sounded is obtained from the KTIM value and communicates at 48 to the FIFO circuits 122 and 124 (FIG. 3*c*). The amplitude at which the note corresponding to the key played is to be sounded is obtained from a lookup table in a read only memory (ROM) in processor M1. An amplitude value is stored in the lookup table corresponding to every possible value of the timer (i.e., the value stored in the KTIM register). As indicated above, the timer value in the KTIM register can range from 0 to 97 milliseconds. Both these FIFO bytes (the key value and the amplitude) are transferred from the FIFO circuit 122 and 124 to processor M2, where the key information is then processed and communicated to processor M3 for outputting to the keying gate 222. The KTIM byte is not set to 80 (hexadecimal) to indicate it is ready to be used by another key (see FIG. 2).

If the timer has timed out (i.e., the time exceeded 97 milliseconds), its value if FF hexadecimal. In that case, no information is communicated to the FIFO circuit and the KTIM register is cleared at 44. This is analogous to an acoustical piano key which, if hit too softly, will not cause the hammer to strike. However, if at the time the key was depressed no timer was available, the key would not have been assigned to a timer, which circumstance is illustrated by 50 in FIG. 1*b*. In this case, an approximation of the overall level of current piano playing is made; the key number (i.e., which is stored in the corresponding KNUM register) is communicated to the FIFO circuit (205 in FIG. 2) and the amplitude for the corresponding tone is approximated by communicating in 52 the amplitude of the most recently played tone. The event flag is now set (see block 54 in FIG. 1*b*) (as explained above) and the processor M1 returns to the scan routine 20 (see FIG. 1*a*) to examine the rest of the keys 203.

When the played key is released, the ROUTØ routine 32 ignores it on its way up because both contacts the NC and NO 112 and 114 are open and the key's SSS code is 11, which indicates that the key is not on the way down. When the key finally travels up far enough to again close the NC contact 112, the ROUTØ routine 32 determines that the NC contact 112 is closed and the SSS code is 11. If the event flag has not been set in 66 via 78, processor M1 next performs the send damp routine SEDØ 82.

The SEDØ routine 82 (see FIG. 1*b*) finds the first key in the group of eight currently being scanned having its NC contact 112 closed and an SSS code of 11. Bit 7 in the corresponding KNUM register is set to indicate that the note is to be damped and the key number (i.e., the contents of the KNUM register) is communicated to the FIFO circuit 205, which indicates to processor M2 that this key is to be damped. In 84 processor M1 sets the key's SSS code to 00 to indicate that the key has returned. The key has now completed a full cycle of being played and released.

Figure 1B:
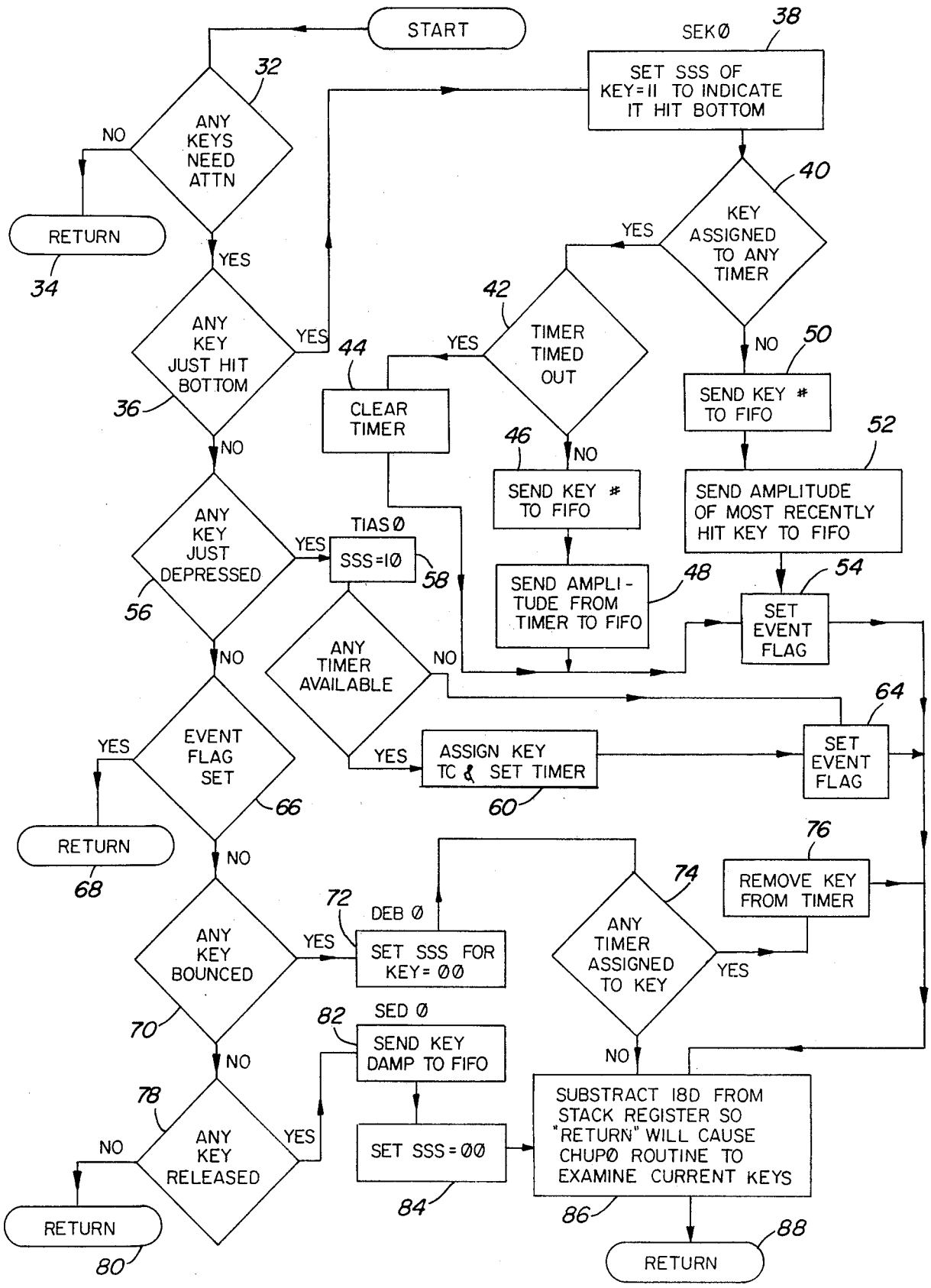
FIG. 1*b* is the second portion of a system flow diagram for the first microcomputer in the present invention.

The ROUTØ subroutine 32 also can direct processor M1 to execute another routine, DEBØ 72 (see FIG. 1*b*). Routine DEBØ provides for debouncing the keyswitches 203. If a key were partially depressed and then released, its SSS code would have been set to 10 by processor M1 to signify that it was traveling downward, and processor M1 would have assigned a KTIM timer to it with the expectation that the corresponding NO contact 114 would soon be closed. A similar situation would occur if, on the release of the key, the NC contact 112 were to bounce. First it would appear to processor M1 that the key had returned, then been struck again, and returned again without ever closing the NO contact 114. Processor M1 detects this situation at 70 during its execution of the ROUTØ routine 32 by checking for any key with a closed NC contact and an SSS code of 10, indicating the key was on its way down. Whenever processor M1 detects this situation it executes the DEBØ routine 72. Execution of the DEBØ routine 72 causes the SSS code for the key to be set to 00, and the key is removed 76 from a KTIM timer if it has been assigned to one as determined at 74. DEBØ routine 72 provides complete debouncing for the system of the present invention. It is not necessary to debounce the normally open contacts 114 because in the present invention keys on the way up are ignored until they close the NC contact 112. If a newly struck key were to close the NO contacts, bounce off, and then the close NO contacts again, processor M1 would have stopped the key's timer when the NO contacts first were closed and would have communicated the key and amplitude information to a FIFO 205, as described above. It is of no consequence if the key bounces mumerous times on the NO contact, because, after the key information has been communicated, the key is ignored until it again closes the normally closed NC contacts 112. Therefore, the only constraint on the keys is that they be designed so that no key bounces from either contact all the way to the opposite contact. Thus, the present invention allows the keyswitches to be constructed with virtually no concern about key bounce.

The lighted pushbutton tab switches 206 (see FIG. 2) control the "easy play" features of the auto piano of the present invention. After each complete scan of the 88 keyswitches 203, a tab counter register (not shown) is decremented, as illustrated in block 24 (see FIG. 1*a*). If the tab counter register is decremented to 0 during execution by processor M1 of a given interrupt program, the tab switches 206 are scanned, and the tab counter register is set to 50, as illustrated by block 26 in FIG. 1*a*. Thus the tab switches are scanned every 50 interrupts, or, since one interrupt occurs each millisecond, every 50 milliseconds. Each time the tab switches 206 are scanned, a byte set equal to FF hexadecimal is first communicated at 28 to a FIFO circuit 122 or 124 (see FIG. 3*c*) which indicates to processor M2 that switch tab information is about to be communicated, and then at 30 four bytes containing the switch tab information (which provides one bit for each of the 29 tabs plus three excess bits) are communicated sequentially to a FIFO circuit 122 or 124. Tab switch scanning is accomplished by the same circuitry as the keyswitch scanning in conjunction with decoder circuit 110 (FIG. 3*a*). Decoder circuit 110 is addressed by bits 0, 1, and 2 and selected by bit 3 of port 1 to provide one of four outputs to select one of the four sets of eight tab switches.

It should be noted that, when many keys are being played in rapid succession, processor M1 may require more time than one millisecond to execute the interrupt program (see FIGS. 1*a* and 1*b*). If this occurs one or more interrupt signals may be missed. This causes slight inaccuracies in the timed keys. However, such inaccuracies are not noticeable to the player, especially when many keys are being played. Moreover, the use of the event flag, as described above, minimizes the frequency of such occurrences.

D. Processor M2

(1) Hardware Considerations

As noted above, processor M2 performs virtually all of the logical functions of the Auto Piano of the present invention. Broadly stated, this means that processor M2 receives keyswitch and tab switch information from processor M1 via the FIFO circuits 122 and 124 (see FIG. 3*c*), processes that information, and outputs the results directly to processor M3, which in turn outputs the information to various hardware circuitry, as described hereinafter. Therefore, processor M2 actually has no connection to any of the piano's harware (except for the FIFO circuits 122 and 124 and processor M3).

Communications between procesor M1 and processor M2 have been discussed above. Communications between processors M2 and M3 are accomplished in a different manner. Whenever processor M2 needs to output information to M3 or whenever processor M2 needs to receive information from processor M3, processor M2 sends a signal to the interrupt pin of processor M3. Processor M3 then interrupts its processing and begins execution of an interrupt routine. The interrupt routine begins with a synchronous communications between the two processors via port 5 of each processor. Communications travel in both directions, since processor M2 may be sending information to or receiving information from processor M3 or both. This process of synchronous communications is the same as described in the U.S. Pat. application entitled "System for Communicating Data Among Microcomputers in an Electronic Musical Instrument," filed June 8, 1981 by Jones, serial No. 271,133, and now U.S. Pat. No. 4,412,470 which also is assigned to the same assignee as the present invention.

Information that is output from processor M2 to processor M3, and hence to the hardware circuitry as illustrated in FIG. 2, includes keying information to cause a piano gate(s) 222 to turn on to play a note(s), amplitude information to be sent to the digital/analog convertor 230 to control the amplitude of the corresponding tone, and damp information to cause processor M3 to damp a specified gate(s) 222 to cause the tone to decay at a fast rate. Other information communicated to processor M3 includes controlling of the LED display 218 via LED display logic 216 and setting the latch circuits 208 to light the appropriate lighted tab switch pushbuttons 207. Information required by processor M2 from processor M3 consists mainly of accessing a large lookup table stored in processor M3 that contains all the data for the automatic piano patterns, as hereinafter described. Processor M2 also receives information corresponding to the setting of the volume and tempo potentiometers 210 and 211, respectively, (which information is obtained by processor M3, as hereinafter described) and the state of the minor touch strip 215 and the arpeggio touch strip 217 (which information is obtained by processor M3). In the following description of the operation of processor M2, it will be inconvenient to refer continually to this communication process. Hence, whenever it is stated that processor M2 "outputs" information it should be understood that processor M2 actually is initiating a communication with processor M3 to cause processor M3 to output the information. Similarly, when processor M2 "reads" the volume or tempo potentiometers 210 and 211, respectively, or "inputs" the minor touch strip 215 or the arpeggio touch strip 217 from their associated circuits 219 and 220, it should be understood that processor M2 actually is initiating a communication with processor M3 and that the "reading" or "inputting" is accomplished through communications. The process of communicating data from the pattern lookup table in processor M3 to processor M2 is more involved and will be explained in more detail hereinafter.

(2) Outline of Auto Piano Operation

Because processor M2 is responsible for virtually all the logical control of the Auto Piano of the present invention, it is necessary at this point briefly to describe the various operating modes of the present invention. The three basic modes of the present invention are Standard Piano, One Finger Chord, and Funchords. As are most features on the piano of the present invention, one of these three operating modes is selected by the player by pressing one of three lighted pushbutton switches located on the control panel.

In the Standard Piano mode, the instrument of the present invention acts like an ordinary acoustical piano and performs similarly to an electronic piano such as the one described in U.S. Pat. No. 4,248,123. The present invention's improved dynamic control is achieved by computer timing of the key travel, as described above, instead of the RC time constant approach used in some prior art electronic pianos.

When the player selects the One Finger Chord mode of operation, one of the various musical "styles" must be selected by actuating one of the pushbutton switches provided. For example, 12 separate styles could be provided, such as "Ragtime", "Swing", "Boogie", etc. After a syle switch is selected, the player then plays a single key in the automatic range on the instrument's 88-key keyboard. In the preferred embodiment the automatic range comprises the second C below middle C through the first G below middle C. Selection of a style causes the present invention to commence automatic operation upon the playing of a key, and an automaitc pattern of piano tones in the selected style to commence. The root note of the automatic pattern is determined by the key playe. For example, if the player, having selected the "Ragtime" style, plays a C key within the automatic key range, then an automatic pattern will be sounded in a ragtime style and in the key of C. Since the notes of a C major triad chord are C, E, and G, these keys will all be sounded in the automatic pattern, playing both base and accompaniment piano notes. However, the automatic pattern is not restricted to these keys alone and may play other notes of the scale to complete the pattern. The main objective is that, if a player is reading sheet music that calls for a C chord and plays the C key in the One Finger Chord mode, the automatic accompaniment will be musically correct. If the music designates a C chord for the next measure, the player lifts his or her finger from the C key and plays the G key. Tempo (i.e., the number of beats per minute played by the automatic pattern) is selected by the tempo potentiometer 211 located on the control panel. Tempo indication is provided by a four-digit, seven segment digital display 218. If a minor chord is required by the music, the player holds the designated root note and presses the "minor touch strip" 215, which can be a metallic strip located along the front of the instrument under the keyboard.

Automatic operation in the Funchords mode of the present invention is similar to that in the One Finger Chord mode. The difference is that in the Funchords mode the player must play his or her own chord (i.e., at least three notes must be played). The Funchords mode is intended for the player that has developed more musical skill than is required for the One Finger Chord mode. When a C chord is played in any inversion, for example, processor M2 identifies it as a C chord and plays an automatic pattern with a C root. The pattern is identical to the pattern played in the One Finger Chord mode when a C note is played. To cause an automatic minor pattern to be sounded, the player must play a minor chord. The Funchords mode allows for the playing of many more types of chords than does the One Finger Chord mode. Other chords that are recognized by processor M2 and played in the Funchords mode are sixths, dominant and major sevenths, augmented, diminished, and suspended chords.

All of the styles consist, for example, of automatic piano patterns two measures in length, which are repeated for as long as playing keys are depressed. To expand on these automatic patterns, one of the six Style Expander pushbutton switches can be selected, providing a total of eight measures of patterns to add variation to the music. The eight measures are separated in four two-measure patterns; when one of the Style Expanders is selected, selection of one of the four two-measure patterns is dependent on the root note played at a given time, causing the variation changes to occur without requiring the player to push a new pushbutton Style Expander switch.

(3) Processor M2's Software

A number of commercially available microprocessor circuits are suitable for use as processors M1, M2, and M3 in the present invention. One example of a suitable microprocessor is type MK3872, which is a single-chip processor manufactured by Mostek Corp. This device contains 4032 bytes of ROM (read only memory), 64 bytes of scratchpad RAM (random access memory), 64 bytes of "external" RAM memory. The 128 bytes of RAM memory are referred to interchangeably herein as "registers" and "bytes". Further details concerning this microcomputer are contained in Mostek Corporation's Publication No. MK79567, entitled "Single-Chip Microcomputer MK3872, Mostek F8 Microcomputer Devices", (Copyright 1978 Mostek Corporation).

Operation of processor M2 is such that all logical operations take place in what is referred to as an interrupt routine, which is a series of program steps executed during an interrupt in the execution of the main series of program steps otherwise being executed by the microprocessor M2. Referring to the M2 system flowchart in FIG. 4, on power up, routine 232 first clears the memory and sets the interrupt timer to provide an interrupt every 5.2 milliseconds. Routine 234 then enables the interrupt (i.e., conditions the timer to interrupt the wait loop when the interrupt timer is timed out) and waits in a loop 236 for the first interrupt to occur. When the interrupt timer times the end of the first 5.2 milliseconds, processor M2 leaves loop 236 and begins to process its interrupt program. After processing the interrupt program, the computer returns to the enable interrupt routine 234 to wait for the next interrupt to occur. Thus, processor M2 executes the series of computations in its interrupt routine every 5.2 milliseconds. In the preferred embodiment interrupts occur every 5.2 milliseconds in order to facilitate various timing functions, the major one being the timing of the tempo of the automatic patterns, and specifically the counting of 48th notes.

The interrupt routine commences with routine 238, which initiates communications with processor M3 in order to determine the status of the tempo and volume potentiometers 211 and 210, respectively (which are read by processor M3, as hereinafter described) and whether either the minor touch strip 215 or the arpeggio touch strip 217 is being touched (which also is determined by processor M3 as hereinafter described). Two timers, the FCHD timer and the TNP cancel timer, are decremented here, if running, as discussed hereinafter.

Processor M3 next computes the information required to control, via display logic 216 the four-digit, seven-segment display 218. Processor M2 first determines whether an automatic pattern is running or whether the piano is in a reset state. In the reset state, no pattern is running and execution of the display calculation routine 240 causes the display of the tempo, as determined from the position of the tempo potentiometer 211. The tempo is displayed as a number from 40 to 360, which represents the number of beats per minute that would play if the piano were to commence automatic operation. In either of the two automatic modes (i.e., the One Finger Chord or Funchords modes), the 48th note counter (not shown), is interrogated to display the current beat number, which varies from one to four. The 48th note counter is a scratchpad register in the RAM (random access memory) of processor M2 (hereinafter referred to as the "FEC"). To keep to a minimum the external latching circuitry required, tempo rate is multiplexed so that only one of the our digits is actually on at a given time. Since the display calculation routine 240 is executed every 5.2 milliseconds, the multiplex frequency is 1/5.2 or 192.3 Hz. The operation of the display in the present invention is virtually identical to the operation of the display in U.S. patent application entitled "Tempo Measurement, Display and Control," filed June 15, 1981, by Jones, serial no. 273,788 and now U.S. Pat. No. 4,361,066. The display calculation routine 240 also calculates the timing of 48th notes from the setting of the tempo potentiometer 211 and 5.2 millisecond interrupts. This process is identical to that described in the above-cited U.S. patent application entitled, "Tempo Measurement, Display and Control." For example, at a tempo setting of 200 beats per minute, a 48th note would occur approximately every 5 interrupts. If routine 242 (see FIG. 4) determines that it is time for a 48th note, control logic routine 246 updates the FEC (48th note counter). Otherwise the processor M2 executes the Key Processing and Tab Input Routine 270. (The FEF flag is discussed hereinafter. Assume for this portion of the description that it is not set.)

Figure 5:
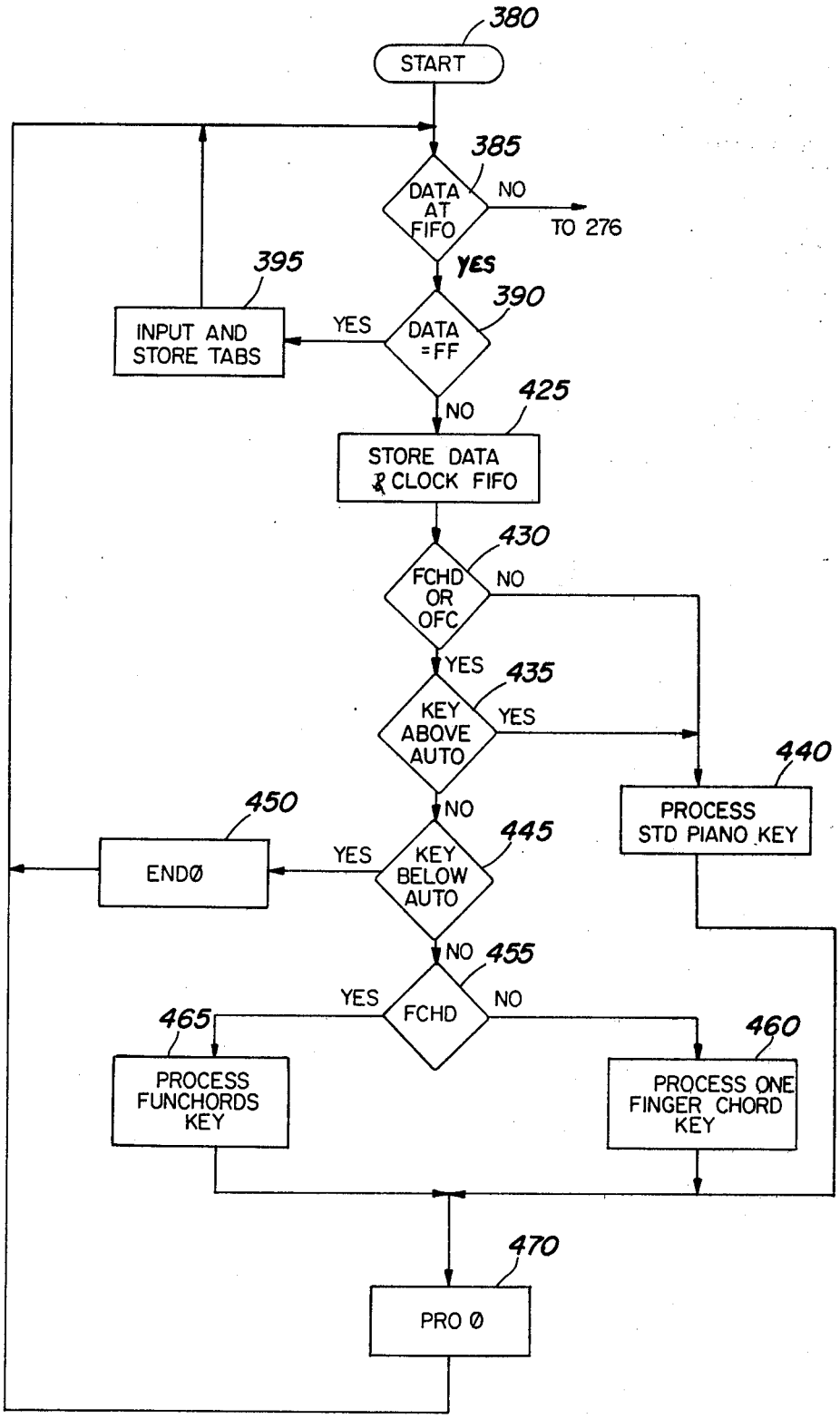
FIG. 5 is a flow diagram of the routine used to process key and tab information in the present invention.

The Key Processing and Tab Input Routine 270 and FIG. 5 is the part of the program executed by processor M2 that examines at 385 the two FIFO's 205 to determine if data is being sent from processor M1. Routine 270 first determines at 390 if the data being communicated from processor M1 is for a key that was struck or damped or for a tab. If tab information is ready to be communicated, which occurs approximately every 50 milliseconds (or every 10 interrupts), excution of the Key Processing and Tab Input Routine 270 loads the tab information at 395, which is contained in four bytes in the preferred embodiment, into a location in processor M2's external RAM to be processed later by execution by processor M2 of the Tab Calculation Routine 282. If the information is for a struck or damped key, the Key Processing and Tab Input Routine 270 outputs the key information at 240 (or the damp information for the key) when in the Standard Piano mode, or if the key is higher than G below middle C, outputs the information regardless of which of the three modes the instrument is in. If a key has been struck, the Key Processing and Tab Input Routine 270 branches to the Pro Harmony Routine 274 and 470 (which is described hereinafter), if the Pro tab is on and the instrument is operating in one of the two automatic modes as determined by Pro Note Routine 272. The Pro Harmony Routine 274 outputs the appropriate right hand harmony notes and returns to the Key Processing and Tab Input Routine 270 to process any more data that might be loaded into the FIFO's 205.

If, after executing the Key Processing and Tab Input Routine 270, the Funchords Timer 276 is not 1 and if no notes were processed during execution of the Key Processing and Tab Input Routine 270, as determined by Routine 278, program control branches to the Pro Minor Check Routine 280 and the Tab Calculation Routine 282. These two routines need not be processed during every interrupt, and in order to save computing time they are executed only if no keys were processed.

The Pro Minor Check Routine 280 checks to see if the automatic pattern has changed from major to minor or minor to major. If so, and any harmony notes have been played and are still sustaining, any thirds in the harmony notes are damped to avoid a clash between a minor third in the automatic pattern and a major third in the right hand harmony (or vice-versa).

The Tab Calculation Routine 282 examines the status of the tabs (from data stored in processor M2's external RAM by the Key Processing and Tab Input Routine 270). It performs debouncing on the tab switches, performs various logical operations on any changed tab switches, and send information to latch the appropriate lighted pushbutton tab switches.

Going back to 48th Note Test 242, when the Display Calculation routine 282 determines that it is time for a 48th note, the program branches to the Control Logic and Update of FEC Routine 246. This routine determines whether it is time to start automatic operation or enter the reset state, depending on the state of the tab pushbutton switches 206 and the playing keys 203. Routine 246 also updates the 48th note counter (FEC), which is a register in the scratchpad RAM within processor M2. It is this FEC register that counts the 48th notes and quarter notes (twelve 48th notes) and keeps track of whether any automatic pattern being sounded is in measure one or two. In either automatic mode: as determined by 248 when an automatic pattern is running, the program being executed by processor M2 then branches to calculate the Table Address Calculation Routine 252 which determines the table address of the next notes of the automatic pattern that are to be keyed, if any, as described hereinafter. It it is time to output any automatic notes, as determined by test 254, the program branches to the Automatic Note Processing Routine 262 (the FCHD timer test 256 and Note at FIFO test 258 are described hereinafter).

By executing the Automatic Note Processing Routine 262, processor M2 obtains information from the style table and outputs and damps appropriate notes to play the selected automatic pattern. After these notes are output, processor M2 returns to the Enable Interrupt Routine 234 to wait for the next interrupt.

The FEF flag, the FECX register, and the Funchords timer are discussed in detail hereinafter. It should be noted here that they all relate to the timing of newly-played root notes in the Funchords mode. When a chord is played, it is impossible for a player, especially an inexperienced one, to hit all of the three or more keys of a chord at precisely the same moment. Therefore, it is necessary to delay the recognition of each new key until all the notes of the chord have been played. When the Key Processing and Tab Input Routine 270 encounters a newly-struck note in the automatic range in the Funchords mode, it sets a Funchords timer (not shown). This timer is set to be long enough so that, by the time it times out, all the keys of the chord will have been played. The Funchords timer is decremented at the beginning of each interrupt by routine 238. If the timer equals 1 in test 276, the program branches to the Chord Recognition Routine 284 to determine the root of the newly-played chord. After the new root has been determined, processor M2 returns to the Enable Interrupt Routine 234 to wait for the next interrupt.

(4) Piano Controls

In the preferred embodiment, all the operations of the Auto Piano of the present invention are controlled by the lighted pushbutton tab switches located on a panel above the keys. These tab switches are continually scanned by processor M1, and their state is communicated to processor M2 via the FIFO's every 50 milliseconds. When the tab information is to be communicated, processor M1 first scans the four groups of eight tab switches in the same way the keyswitches are scanned, as described above. Processor M1 then outputs the value FF (hexadecimal) to the FIFo's 205 to signal to processor M2 that the information relates to tabs rather than keys. Processor M1 then sequentially outputs the four bytes of tab switch data to the FIFO's 205. The FIFO's 205 then contain an FF (hexadecimal) and four bytes of data which indicate the status of all tab switches. The only part of processor M2's program that inputs data from the FIFO 205 is the Key Processing and Tab Input Routine 270 (see FIG. 4). As shown in FIG. 3*c*, port 1 of processor M2 and several bits of port 0 are connected to the FIFO's 122 and 124. The eight data outputs from the two FIFO's 122 and 124 are connected to port 1 of processor M2. Two "data out ready" lines are connected to processor M2 port 0, bits 3 and 4, of processor M2 and bit 5 of port 0 is connected to the shift out line that is used to shift data out of the FIFO's 122 and 124. As processor M2 begins execution of its Key Processing and Tab Input Routine 270, it first inputs the state of the two DOR (data out ready) lines from port 0. If both lines are high (i.e., at +5 volts), then data exists at the outputs of FIFO's 122 and 124. The key Processing and Tab Input Routine 270 immediately inputs the data and checks to see if it is equal to FF hex. If so, the data is a tab communication, and processor M2 begins execution of a sequence of instructions for inputting four bytes of information from the FIFO's 122 and 124 and loading each byte into a register in its external RAM. After inputting each byte, a pulse is outputted on the "shift out" line 15 (see FIG. 3*c*) to clock the next byte from the output of the FIFO's 122 and 124. This operation occurs every 50 milliseconds.

Although the tab information is stored in external RAM (not shown) by the Key Processing and Tab Input Routine 270, no logic or debouncing has yet been performed. This is accomplished by the Tab Calculation Routine 282. In addition to the four bytes of external RAM already mentioned, there are four more bytes that are used to store the status of these tab switches from the previous tab scan that took place 50 milliseconds before. Every time the Tab Calculation Routine 282 is executed, processor M2 first compares the four old tab bytes to the four new tab bytes. Any difference discovered represent the change in the position of the tab switches 206. For example, if the stop switch had been stored as a 0 on the previous scan and the new scan shows it as a 1, then processor M2 knows that the stop switch has been pushed. The computer stores a 1 in one of four scratchpad registers for each newly pressed pushbutton tab switch, all of which can be momentary contact switches. It uses these four registers for the duration of the Key Processing and Tab Input Routine 270 to perform various operations. The debounce delay is provided by the 50 milliseconds between each tab communication.

For each of the tab pushbutton switches, except for style expander and style pushbutton switches, there is a bit in scratchpad RAM in processor M2 that is set or not set, depending on whether the control is latched on or off. If the Standard Piano bit is not set, and the Standard Piano pushbutton switch is depressed by the player, then the Standard Piano bit is set, for example. Likewise, if a bit is set when its pushbutton switch is pressed, then the bit gets reset. There is a light for each of the pushbutton switches to indicate the status of the control, and each light has a latch, which is set or reset by the computer. The information to set or reset all tab light latches is communicated to processor M3 early in each interrupt routine, as illustrated by block 238 in FIG. 4. Processor M3 controls the light latches 208. The style expander and style pushbutton switches control two groups of interlocking functions. Only one style and only one style expander can be selected at a time. Pressing another pushbutton switch in the group causes the currently lit switch to go out and the newly pressed switch to light. After examining the style and style expander switches, processor M3 stores two numbers (from one to twelve for the style and one to six for the style expander switches) in scratchpad memory. A number of other similar logical calculations must be made by the tab routine, as discussed hereinafter in connection with the description of the various Auto Piano features of the present invention.

(5) Control of Tempo

Because of the automatic modes of the present invention, this instrument requires automatic control of tempo. That is, a particular set of notes in an automatic pattern are played at regular intervals. This is similar to an electronic rhythm unit in prior art electronic organs that plays percussive voices in an automatically generated tempo. In some rhythm units, this accomplished by a simple oscillator that clocks a divider chain that is used to sequentially address a Read Only Memory in which the automatic pattern is stored. Control of the tempo in this case is usually controlled by a potentiometer that varies the frequency of the oscillator.

The tempo control in the present invention is accomplished in a different manner. A potentiometer 211 is read by processor M3 (see FIG. 2). From this reading a number called the rhythm rate is calculated by processor M3. This rhythm rate is used to count the number of 5.2 millisecond interrupts between successive 48th notes. The reading and calibration of the tempo potentiometer and the method for determining the occurrence of 48th notes is nearly identical to that described in the above-referenced U.S. patent application entitled "Tempo Measurement, Display and Control." The only difference is that in the present invention the potentiometer reading and the 48th note counting are done in two different processors. Processor M3 reads the potentiometer setting and determines the tempo. It then communicates this tempo value to processor M2 early in the interrupt routine 238 of processor M2. Processor M2 then determines the 48th notes during the Display Calculation Routine 240 (see FIG. 4).

The readout on the four-digit, seven-segment LED display (218 in FIG. 2) also is controlled by the Display Calculation Routine 240. This display 218 has three basic modes of operation. When the automatic patterns are not operating (i.e., when "Standard Piano" has been selected or when the "stop" button is pressed, for example), the display 218 indicates the tempo corresponding to the position of the tempo potentiometer 211 in beats per minute. This is the tempo that would be played if automatic operation were to commence at the potentiometer setting. When automatic operation does begin, the display 218 ceases to display the tempo and instead displays the beat of the measure that currently is being played from beat one to four. These two modes of operation also are nearly identical to the above-referenced "Tempo Measurement, Display and Control" patent application. The only difference is that in the present invention the display is calculated by processor M2 and then communicated to processor M3 to be output to the actual display logic 216 and display 218 (see FIG. 2).

The other mode of operation involves the style expanders. Six style expander pushbutton switches are used to select which key the music is to be played in, which then allows the player to select the appropriate style expander to give the best-sounding musical patterns for the key signature of a particular piece of music.

When any one of the style expander pushbutton switches is depressed and held in, however, the four-digit display shows the number of sharps and flats that are found in the two keys of music that are labeled on the style expander pushbutton. For example, if the pushbutton switch for the style expander labeled "C G♭" is held in, the display 218 will show a "O" on the second digit from the left indicating that there are 0 sharps in the key of C, and a "6" on the third digit from the left indicating that there are 6 flats in the key of G♭. This allows the novice to determine instantly the number of sharps or flats in any key. To provide this mode of operation, processor M2 uses a number corresponding to the style expander selected, which is determined by the Tab Calculation Routine 282 discussed above, along with a six-byte lookup table stored in a ROM in processor M2. The data counter (i.e., the address register) of processor M2 is loaded with the starting address minus one of this lookup table. Then the style expander number (1 to 6) is added to the data counter, and the byte located at the resulting address is loaded into the accumulator of processor M2. At this point the left nibble (4 bits) of the accumulator contains the number of sharps for the pressed style expander and the right nibble contains the number of flats. This information is stored in memory until it is communicated to processor M3 during the next communications. Processor M3 subsequently outputs this information to the display logic 216 to determine the middle two digits to be displayed in display 218.

The seven segment display 218 driven by processor M3 is controlled by display logic 216, which includes a binary coded decimal (BCD) to Seven Segment Decoder/Driver circuit, such as a commercially available type SN7447 device, and four transistors. See the U.S. patent application entitled "Tempo Measurement, Display, and Control," filed June 15, 1981 by Jones, Ser. No. 273,788 and now U.S. Pat. 4,361,066. Only one decoder/driver circuit 216 is used, and the digits are multiplexed so that only one digit is actually turned on at any given time. Since a different digit is turned on during every 5.2 millisecond interrupt, the multiplex rate is determined by the reciprocal of 4 times 5.2 milliseconds, which is a rate of 48 Hz. Port 4 of processor M3 is dedicated to the display output. Its lower four bits are connected to the decoder/driver circuit 216, and each of its higher four bits are used to drive a transistor that supplies current for one of the four common-anode, seven segment display digits. To latch a given number to a given digit, the number is first stored in the right nibble of the accumulator of processor M3. One of the four bits in the accumulator's left nibble is set to supply current to the desired digit in display 218 (see FIG. 2). The accumulator is then output to port 4, which causes the number to be displayed by the desired digit 218.

Port 4 is left unchanged until the next interrupt, at which time another digit is turned on.

(6) Standard Piano Mode

As mentioned there are three modes of operation for the present invention, Standard Piano, One Finger Chord, and Funchords. Only one of the three modes can be selected at a time. There are three switches by which each of the three modes can be selected, and whenever any one of the switches is activated to select a corresponding one of the three modes, the Tab Calculations Routine 282 causes either of the other two modes that might be on at the time to be turned off.

In the Standard Piano mode, the instrument plays much like a conventional acoustic piano or like a prior art electronic piano. The method of obtaining the information for dynamic control of the keys has been described above; the method by which the keys are actually sounded will now be described. When a new key is played, two bytes of information are inserted into the FIFO 205 by processor M1. The first byte is the key's number, and the second byte is the volume at which the corresponding tone is to be sounded. When processor M2 executes the Key Processing and Tab Input Routine 270, it checks both DOR (data out ready) outputs from the two FIFO's 205. The state of the DOR outputs indicates that data is ready to be outputted. If they indicate that data is waiting at the outputs of FIFO circuits 122 and 124, processor M2 inputs the data from its port 1 (see FIG. 3*c*). Since this byte contains data for a newly-played kay, bit 7 will be 0, which will indicate to processor M2 that it is a new key. All 88 keys 203 of the present invention are assigned a number, starting with a 0 for key C8, the highest key on the piano, and continuing through 58 hex for the lowest key. Processor M2 stores this key number in memory temporarily, clocks the FIFO once, and loads the next byte of data from the FIFO 205 into its accumulator. The data in this byte indicates the volume at which the key is to be sounded, which can range from O through FF hex. After the Key Processing and Tab Input Routine 270 is completed, processor M2 communicates both these bytes to processor M3 in the manner described above. If several newly-played keys occur within one interrupt, the data for all the newly-played keys would get communicated together at the end of the Key Processing and Tab Input Routine 270.

Figure 3D:
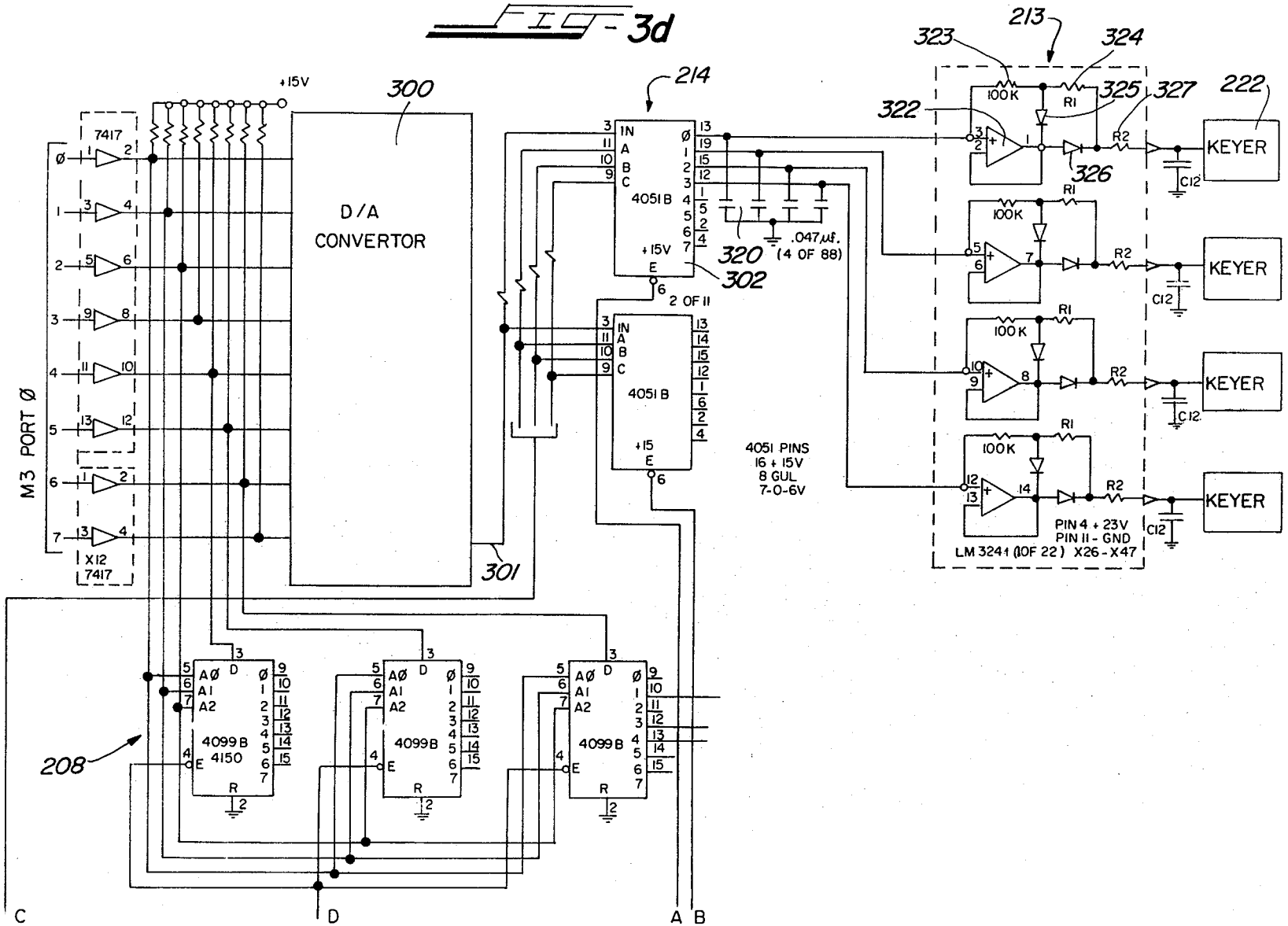
FIG. 3*d* and 3*e* are a schematic diagram illustrating the application of control signals to keyer circuitry which controls tone signals.
Figure 3E:
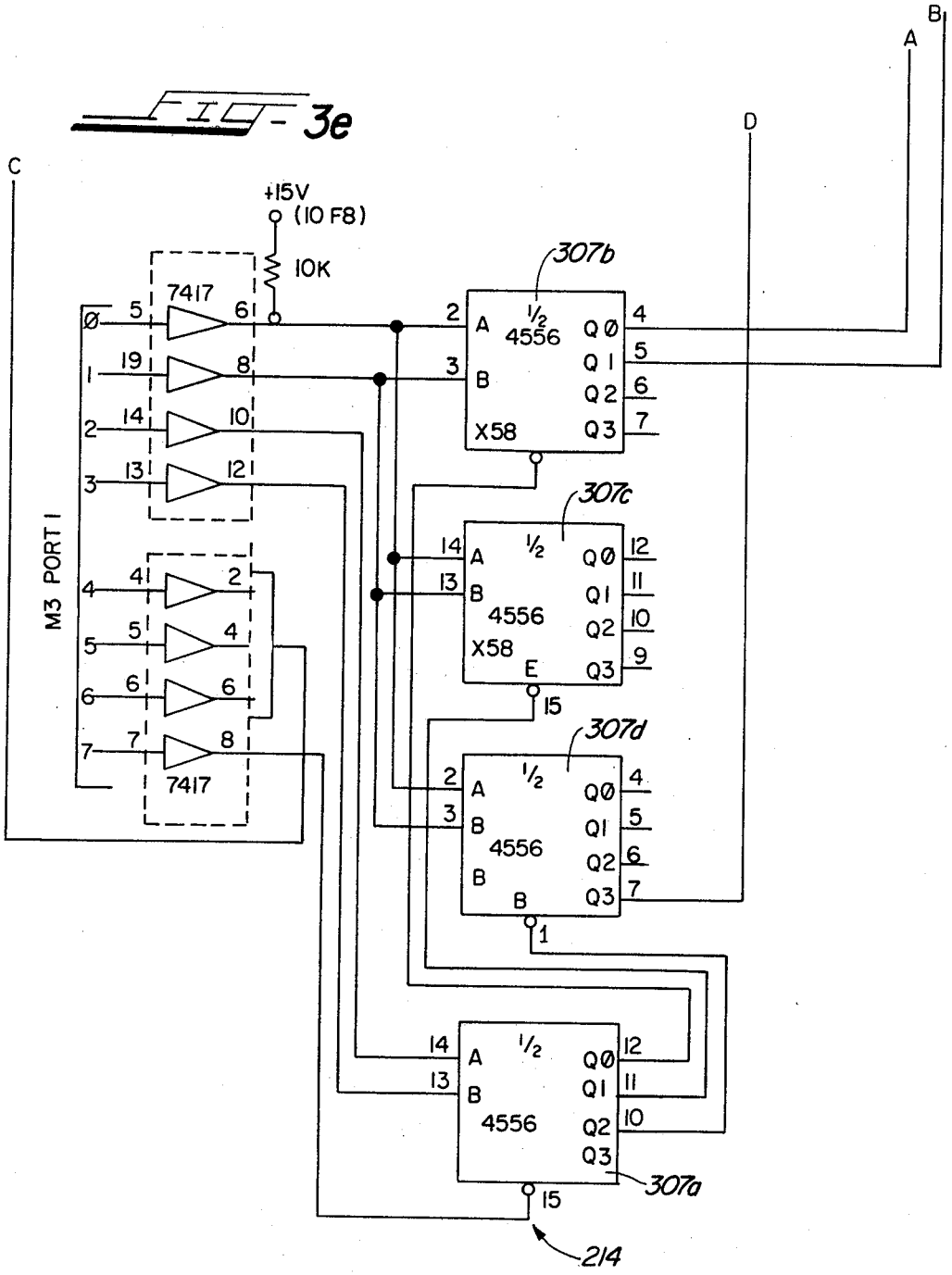

After communications with processor M2 have ended, processor M3 outputs the new note. With reference to FIG. 3*d*, processor M3 first outputs the amplitude of the key to its port 0, which is connected to a resistor ladder network (not shown) that forms a digital to analog convertor 300. Depending on the number output to port 0 of processor M3, processor M3 can output voltages in the range of 0 to 15 volts at the output 301 of the digital to analog convertor 300. The analog multiplex circuit 302 is one of eleven such circuits, each of which can control 8 keying circuits for 8 keys. Analog multiplex circuit 302 can be a commercially available CMOS 4051 integrated circuit. Port 1 of processor M3 is used to select one of 88 keyers (not shown). Bits 2 and 3 of port 1 are connected in FIG. 3*e* to a one of four decoder 307*a*, which is enabled by bit 7 of port 1 of processor M3. Three of the outputs of decoder 307*a* are used to enable three other one of four decoders 307*b*, 307*c*, and 307*d*, which collectively have 12 outputs, 11 of which are used to select one of the eleven analog multiplexers 302. Bits 0 and 1 of port 1 of processor M3 are used to select one of four outputs of the decoder selected by the first decoded 307*a*. Thus, bits 0 through 3 and bit 7 of port 1 of processor M3 are used to select one of eleven analog multiplex circuits 302. Bits 4, 5 and 6 of port 1 are used to select one of eight outputs of the currently selected analog multiplexer 302. When a keyer 222 (see FIGS. 2 and 3*d*) is to be turned on, the appropriate byte is output to port 1 of processor M3. This causes the analog voltage at the output 301 of the D/A convertor 300 to charge the desired keying circuit 222 through buffer circuit 213. For example, assume that the buffer circuit with output resistor 327 is to be turned on. Bits 2 and 3 of port 1 are set to 0 so that decoder 307*a* will select decoder 307*d*. Bits 0 and 1 of port 1 also are set to 0 so that the Q0 output of decoder 307*d* will go low to select analog multiplexer 302. Bits 4, 5, and 6 of port 1 are set to 0 to select output 0 of the multiplexer 302, and bit 7 of port 1 is set to 0 to enable the decoder 307*a*. Thus, when all bits of port 1 are set to 0, the analog voltage at output 301 will be switched to charge up capacitor 320. Ports 0 and 1 of processor M3 must not be changed until the capacitor 320 is fully charged to the keying voltage at the output 301 of the D/A convertor 300. This voltage is applied to the non-inverting input of an operational amplifier 322. The output of this amplifier 322 is applied through diode 326 and resistor 327 to charge up the actual keying capacitor C12. The keying capacitor is identical in operation to keying capacitors found in prior art electronic pianos. The function and operation of the keying capacitor is the same as described in U.S. Pat. No. 4,248,123 to Bunger and Uetrecht (see the capacitor labeled "C12" in FIGS. 2, 3, and 4 of that patent). When the keying capacitor is charged up by one of the outputs of the analog multiplexer 302, it allows one of the 88 piano tone signals to be gated on, as described in the above-cited patent. When port 1 of processor M3 is changed, the analog multiplexer 302 in question is no longer selected, and its output becomes a high impedance. This causes the keying voltage on the sustain or keying capacitor to decay with a long sustain time constant.

When it is necessary to damp a note, processor M1 sends a single byte of data via the FIFO 205 to processor M2. This byte contains the same key code as that for sounding a newly-keyed key (from 0 to 58 hex), except that bit 7 is set to indicate to processor M2 that the data is for a damp. Only one byte of data is required because no amplitude information is needed. After all notes have been processed, processor M2 communicates this damp byte to processor M3. To damp a given key, processor M3 outputs all zeroes on port 0, causing a near-zero voltage to appear at the output 301 of the D/A convertor 300. Port 1 is then used to select the output of an analog multiplexer 302 corresponding to the key to be damped. The capacitor 320 then is discharged through the multiplexer 302, and the operational amplifier 322 begins discharging the sustain capacitor C12 through resistors 327 and 324 and a diode 325. This causes the keying circuit to damp away at a much faster rate than it otherwise would have done under the decay of the sustain capacitor.

To prevent the diode drops found in the diodes 325 and 326 in the keying circuits from charging up the capacitors 320, and thereby causing the keyers to turn on slightly, it is necessary to periodically discharge the capacitor 320 for each key that is currently supposed to be damped (i.e., not sustaining on). To accomplish this, processor M3 stores one bit in its memory for each key that has been keyed on and not yet damped. All other keys are periodically damped at times in which the processor is not performing other operations (e.g., such as turning on new keys, damping old keys, reading pots and touch strips, or communicating information with processor M2).

This describes the operation of the present invention in the Standard Piano mode. It also basically describes its operation in the automatic modes in the section of the piano from G#3 (the third G# from the left end of the keyboard) to the top of the keyboard. Only the automatic key range and the bottom octave chord range, both of which are to the left of G#3 on the keyboard, function differently in either of the two automatic modes. However, even in the automatic modes, where keys are automatically keyed on and damped off at various times under computer control, these keying and damping operations are accomplished in the same manner as they are in the Standard Piano mode. Thus, when it is stated hereinafter that a key is keyed on or damped off, what is meant is that the information to accomplish that function is communicated from processor M2 to processor M3 and that processor M3 outputs the information to the hardware (see FIG. 2) in the same way as described above for the Standard Piano mode.

(7) One Finger Chord Mode (a) Control Logic

When the One Finger Chord mode is selected and any style also has been selected, the instrument of the present invention is in the automatic mode and will commence playing an automatic pattern when any key in the automatic key range is depressed or played. Which key is depressed determines the root note for the automatic pattern. For example, if a G key is depressed, the root note for the pattern is G. Referring again to FIG. 4, it is in the Display Calculation Routine 240 that the 48th note time intervals are determined, as described above. When it is time for a 48th note, as determined by test 242, instead of branching to its Key Processing and Tab Input Routine 270, processor M2 begins processing the Control Logic and FEC Update Routine 246. This routine is illustrated in greater detail in FIG. 6. During its execution of routine 485, processor M2 examines such conditions as whether any automatic key is depressed, what mode of play the instrument is in, etc. and has control of whether the instrument is to be in the automatic mode or reset. For this description, since the One Finger Chord mode has been selected, it is assumed here that the style (automatic pattern), is running as determined by test 490 (had it not been running, the program would have branched to the key processing routine 520, just as it would have if a 48th note had not occurred).

(b) Forty-Eighth Note Counter

The next task of the Control Logic and FEC Update Routine 246 (see FIG. 4) is to update the FEC (48th note counter) in Update FEC Routine 495. The FEC is a single register in the scratchpad memory of processor M3 which is divided into two nibbles of 4 bits each. The lower order nibble (right 4 bits) counts the number of 48th notes in a quarter note. Since there are twelve 48th notes in a quarter note, this counter counts from 0 to 11 and then is reset to 0. All automatic patterns are designed to consist of two measures with four quarter notes in each. When the quarter note counter (lower order nibble of the FEC) is reset to 0, the left nibble is incremented by one. The left or higher order nibble counts the quarter notes from 0 through 7 for the eight quarter notes in the two measure pattern. After the count of 7, this counter is reset to 0. As noted above, the FEC is updated on every 48th note.

(c) Format of Automatic Pattern Data Table

The next several routines in FIG. 6 describe the method in which the automatic notes are located within the large automatic pattern data lookup table stored in ROM in processor M3. At this point it is desirable to describe the format in which the automatic pattern data is stored. Each style has four "variations", each of which contains a two-measure automatic pattern. Selection of these variations is discussed hereinafter. For a given variation of a given style, processor M2 generates an automatic pattern from the automatic pattern data lookup table. The length of this lookup table is dependent on the complexity of the automatic pattern. The various two-measure patterns can be of different lengths. The first byte of data for a particular variation is the first byte of a group of bytes that are referred to hereinafter as a "note code set." A note code set contains all the information necessary to output the required notes for a single 48th note time slot of a particular style variation or pattern. Thus, during any given interrupt of processor M2, only one note code set is processed. The first byte of the note code set determines the duration of the notes that are about to be played; that is, it determines how many 48th notes will occur between the triggering of the notes in the current note code set and the subsequent triggering of notes in the following note code set. If, for example, the automatic pattern contained a quarter note in beat one of measure one and no notes were to be played until the second quarter note, then the first byte of data in the first note code set for that pattern would equal 12 (12 counts per quarter note).

The second byte of a note code set contains data corresponding to the number of notes contained in the set. For reasons described hereinafter it is desirable to keep the data for the bass notes in the pattern separate from the data for the treble notes in the pattern. It is the second byte of the note code set that contains the information for keeping bass and treble data separate. The right nibble of this second byte contains the total number of notes in the note code set, and its left nibble contains only the number of bass notes in the set. One reason for separating the bass and treble notes becomes apparent in viewing the third byte of a note code set. This byte contains information for both accenting and de-emphasizing bass notes and treble notes independently of each other. The left nibble of the third byte contains an accent value for bass notes, and the right nibble contains an accent value for the treble notes. The accent values range from 4 to 8. If a note is not accented, its accent value is 0, and processor M2 will substitute the value of 5 for the accent. This establishes 5 as the nominal note amplitude in the preferred embodiment of the present invention, providing one level of de-emphasis (a value of 4) and three levels of accent (values of 6, 7, and 8). The accent value is used in conjunction with data for the volume potentiometer setting to determine the actual output amplitude of the automatic notes.

The rest of the bytes in the note code set correspond to the actual automatic notes that are to be played, the bass notes coming first, followed by the treble notes so processor M2 will know which notes are bass and which are treble. Because in the preferred embodiment the automaic patterns must sound in different keys, depending on the root note played or otherwise identified, the data in these bytes are not actually notes, but "offsets" from which the actual notes are determined. That is, the bytes contain offsets from the root note. In the One Finger Chord mode, the root note is derived from the single note that is being played in the automatic key range. The root note is derived differently in the Funchords mode, as described hereafter. To allow the instrument to play the three notes in the lowest octave of the piano, the offsets are numbered as if the keyboard included nine additional keys to the left of the keyboard, i.e., as if the keyboard extended down to a low C. For example, if the root were C, and the offset were 0, this would indicate that the instrument should play this non-existent C. Since this note is not included, the offset "0" never exists. The lowest offset that can be used is 9, which calls for the instrument to play the lowest key, A, on the keyboard (if the root is C). In practice, however, the offsets rarely go below 24 in the preferred embodiment. This is because the majority of automatic patterns do not play notes in the range of the lowest 15 keys. By way of further illustration, if the root not is C, an offset of 24 would cause the instrument to play the note "C2", which is the second C from the left, and which is 24 notes higher than the above-mentioned non-existent C. If the next offset were 28 (the root still being C), then the instrument would play E2, which is 28 semitones higher than the non-existent C. If the root changed to a G, for example, and the offset were 28, the instrument would play a B2, which is 28 notes higher than the non-existent G in the lowest octave. It should be noted that in the foregoing example the offset of 28 caused a note to play that was a third interval from the root note (E is a third interval from C, and B is a third interval from G). Thus, a given offset always results in the same interval from the root note.

Storing the automatic code as offsets from the root note allows the playing of the selected automatic patterns in any key, just by changing the root note. If the player uses sheet music that includes the appropriate chord names, then by pressing the key corresponding to the chord name, the automatic patterns will play the correct chords for the music. As a final illustration, suppose the pattern called for the playing of a single root bass note and a major triad chord to last one quarter note before any other notes were to be played. Suppose also that the bass note needed a light accent. The note code set would be as follows (in hexadecimal notation): OC 14 60 18 30 34 37. If the root were C, then, the 1 in the 14 would indicate to processor M2 that there was only one bass note, and the 6 in the 60 would indicate that the bass note would be accented. Treble notes should be nominal amplitude. The 18 hex (24 decimal) would play a C2 (with accent for the bass note). The 30, 34, and 37 (48, 52, and 55 decimal) would play C4, E4, and G4, a C major triad chord. If the root had been G, processor M2 would have played a G2 bass note with accent, and G4, B4, and D5, a G major triad chord.

If the second byte of the note code set equals 0, then a rest is indicated for the duration indicated by the first byte of the note code set. If the same offset appears in two adjacent note code sets, it is there either to indicate that the note that was triggered the first time is to be held (not damped away) or to be retriggered. Bit 7 is used to convey this information. Bit 7 is set in all offsets, unless it is desired that the note not be retriggered but just held over (sustained and not damped). Because of this, if retriggering were called for in the above example the code would have been: 0C 14 60 98 B0 B4 B7, the only difference being the setting of bit 7 in all the offsets.

Referring to FIG. 4, it should be noted that it is the task of the Table Address Calculation Routine 252 to locate the correct note code set, receive the set from the table in processor M3, and store the bytes in memory for use during execution of the Automatic Note Processing Routine 262. Thus, although the data is looked up during execution of the logic illustrated in FIG. 6, it is not used until execution of the Automatic Note Processing Routine 262.

(d) Variations

As noted above, four variations are available for each of the various styles of patterns. These variations are each two measure patterns, and they are used to make the automatic patterns more musically interesting. If no Style Expander has been selected, the first variation only will play. If any one of the six Style Expanders is selected, the instrument will play one of the four variations, depending on the root note played and the style expander selected. The lowest note of a given musical scale is often referred to as the I key; the next highest note as the II key, then the III, IV, V, etc, keys. In the key of C, for instance, the I key is C; the II key is D; the IV key is F; the V key is G. Since the chords corresponding to these four keys (I, II, IV and V) are the chords that are most often played in a wide variety of music, each of the four variations for each style is written to be musically correct for one of these four keys. Thus, the first variation is referred to as the I variation, the next as the II, the next as the IV, and the last as the V variation. Whenever the style expander is selected which corresponds to the key in which a given piece of music is written, then, whenever the I, II, IV, or V key is played, the I, II, IV, or V variation, respectively, will be played. For example, if a piece of music is written in the key of G, and the style expander labeled "G D♭" is selected, then when a G key (I key) is played, the automatic pattern will play the I variation with G as the root note. If the G key is released and a D key (V key) played, then the piano will play the V variation with D as the root note.

Although the above-mentioned four chords occur frequently in music, the other eight keys also are called for by the music, although less frequently. Since there are 12 keys total but only four of them have variations written expressly for them in the preferred embodiment, it is necessary to assign each of the other eight keys to one of the four variations. Musical judgment is used in the assignment of each key, and in the preferred embodiment, the I sharp key (C# in the key of C, for example) is assigned to variation V, the II sharp, III, VI, VI sharp, and VII keys are assigned to variation IV, the IV sharp key is assigned to the I variation, and V sharp is assigned to variation II. In an alternative embodiment, a different variation could be written for each key, which would require 12 variations for each style. The limitation of four variations is imposed in the preferred embodiment to conserve computer memory and is a suitable compromise musically. The use of six style expanders instead of 12, for example, which could be provided in an alternative embodiment, requires each style expander pushbutton switch to share two keys. The two keys controlled by each style expander switch are selected so that they are opposite each other in the "circle of fifths," a chart that describes the relationship of the twelve musical keys to each other, as is known in the art. Table 1 illustrates the variation obtained in each key for each of the six style expanders.

TABLE 1

| | PLAYING KEY | | | | | | | | | | | |
|---|---|---|---|---|---|---|---|---|---|---|---|---|
| STYLE EXPANDER | C# | D | D# | E | F | F# | G | G# | A | A# | B | C |
| C G♭ | 5 | 2 | 4 | 4 | 4 | 1 | 5 | 2 | 4 | 4 | 4 | 1 |
| D A♭ | 4 | 1 | 5 | 2 | 4 | 4 | 4 | 1 | 5 | 2 | 4 | 4 |
| E B♭ | 4 | 4 | 4 | 1 | 5 | 2 | 4 | 4 | 4 | 1 | 5 | 2 |
| B F | 2 | 4 | 4 | 4 | 1 | 5 | 2 | 4 | 4 | 4 | 1 | 5 |
| G D♭ | 1 | 5 | 2 | 4 | 4 | 4 | 1 | 5 | 2 | 4 | 4 | 4 |
| A E♭ | 4 | 4 | 1 | 5 | 2 | 4 | 4 | 4 | 1 | 5 | 2 | 4 |

This election to have two keys share each style expander switch introduces another restriction. In order that the I, II, IV, and V variations are correct for both keys on any style expander, four of the variations for playing in a given key must be chosen by the existence of the shared other key on that style expander switch. For example, if the "C G♭" style expander is selected, in order for the G♭ key to play a I variation it is necessary for the IV sharp key of the key of C to play a I variation (since the G♭ key is the IV sharp key in the key of C). the D#, E, A, and A# keys must be arbitrarily assigned because they are not the I, II, IV, or chord of either the key of C or G♭.

(e) Calculation of Variation

With reference to FIG. 6, routine 500 determines the variation number from the style selected and the key played. There are a variety of methods by which processor M2 could obtain the desired variation number from the style expander selected and the root note played. One method is to store the information in Table 1 in six lookup tables, each table comprising twelve bytes of data in ROM storage. The data counter could then be set to the beginning address of the first table. The number corresponding to the selected style expander would then be retrieved from its storage location in the scratchpad RAM, and the number 12 could be added to the data counter as many times as the style expander number minus one (minus one because the style expander numbers range from 1 to 6). For example, if the style expander number is one, 12 is added to the data counter zero times, since the data for style expander number one is located at the beginning of the storage location. The data counter would then address the appropriate one of the six tables. To locate the desired byte within the selected table, processor M2 would add to the data counter the root number in the range of 0 to 11 (the root number in this range can be calculated by successively subtracting 12 from the root note stored in the scratchpad until the result is less than 12). The data counter then addresses the number of the desired variation. Although the four variations are referred to as I, II, IV and V, it is more convenient for processor M2 to store them as 0, 1, 2, and 3, respectively.

An alternative method is to store the information in six tables of only six bytes each. This is possible because the actual variation numbers (0, 1, 2, or 3) occupy only a single nibble. This makes it possible for a single table byte to store two variation numbers. It will be noted that the right half of each of the rows under the playing keys in Table 1 is identical to the left half of that row. This allows for even further reduction in table size to three bytes per table. This allows for only six tables of three bytes each, requiring only $3\times6=18$ bytes of storage. It will also be noted that the pattern in each row is identical to the pattern in every other row, except that the rows are shifted sideways. That is, if any row is shifted sideways beneath any other row, the patterns in both rows eventually coincide. This can be used to develop an algorithm for determining the correct variation to use even less memory for table storage. After the correct variation number has been determined by one of the forgoing alternative methods, it is stored in the scratchpad RAM.

(f) Variation Table Address Calculation

The next task performed by the computer is to calculate the address of the desired variation table (which is stored in ROM in processor M3) from the style selected and the variation number which has been calculated. This is accomplished in the next routine 505 (See FIG. 6). Various methods of calculating this address can be used, depending on the method in which the variation patterns are stored in the large data table in the ROM processor M3. In the preferred embodiment, the variation pattterns also are stored a fixed number of bytes away from each other. Since no pattern is longer than 191 bytes long in the preferred embodiment, the patterns are stored 192 bytes apart from each other. Therefore, in hexadecimal notation, the addresses are all CO bytes apart. Since there are four variations per style, the styels are $192\times4$ or 768 bytes (300 hex) apart. The data counter initially is set to the first of the four variations of the desired style. This is accomplished by first setting a scratchpad register equal to the style number stored in RAM minus one (so the number will be in the 0–11 range if there are 12 styles, for example). The data counter is then loaded with the address of the first style table. The above register is decremented in a loop to 0; for each decrement, the number 300 hex is added to the data counter. At the end of this operation, the data counter addresses the I variation of the desired style. Similarly, a register is set equal to the variation number calculated by routine 500 and decremented to 0, with the number CO Hex being added to the data counter upon each decrement. After this operation, the data counter contains the address of the desired variation of the desired style. The number equal to this address is stored in the Q register (a 16-bit register in the scratchpad memory of processor M2) for communication to processor M3.

The above method of locating information in data tables works well if all patterns are approximately identical in length. However, if the patterns vary significantly in length, many of the bytes for the shorter patterns of the tables are not used. In that case, it is more efficient to locate the tables contiguously and store the address of each table in a second table. If there were 12 styles on the piano, for example, then this second table would be 96 bytes long. (There are 12×4 variations =48 addresses; each address is two bytes long.) When a second table is used, the data counter is loaded with the first address of the table plus the style number minus one all multiplied by 8 (because there are eight table values per style with four variations and two bytes per address). A number equal to twice the variation number calculated by routine 500 is then added to the counter. The result is the address of the selected style and calculated variation. The number is then stored in the Q register for communication to processor M3.

(g) Retrieval of Note Code Set

After calculating the data table address, it is necessary to set a register R2 in scratchpad equal to the number of 48th notes that have occurred since the first 48th note of the first measure of the pattern. This is determined from the 48th note counter (FEC) in routing 510 (See FIG. 6). Since the left nibble of the FEC counts the number of quarter notes (from 0 to 11) that have occurred since the first quarter note of the first measure, the above register R2 is first set equal to the number in the left nibble of the FEC multiplied times 12, because there are twelve 48th notes in a quarter note. The right nibble of the FEC, which counts the number of 48th notes played since the beginning of the current quarter note, is then added to the register R2 also. Register R2 then contains the number of 48th notes that have occurred since the beginning of the first quarter note of the first measure of the pattern.

At this point processor M2 has calculated the address of the start of the table of the desired variation of the selected style and stored it in the Q register. Processor M2 also has calculated the number of 48th notes that have occurred since the first 48th note of the first quarter note of the pattern and stored this number in R2.

Next, processor M2 communicates this information to processor M3 by executing routine 525. Processor M2 first interrupts processor M3 by signalling its external interrupt input. This initiates the synchronization process whereby information is transferred between the two processors M1 and M2. This procedure is identical to that described in the U.S. patent application entitled "System for Communicating Data Among Microcomputers in an Electronic Musical Instrument" filed June 8, 1981 by Jones, serial no. 271,133 and now U.S. Patent No. 4,412,470. After synchronization is established, four bytes are transferred from processor M2 to processor M3. The first byte is a code which indicates to processor M3 the type of communication that is being initiated (i.e., a request for a note code set). The second two bytes are the location of the requested data table (which is stored in the 16 bit Q register). The fourth byte is the number stored in register R2. At this point, processor M3 locates the required data while processor M1 waits in a loop in which it examines its port 5 (the port on which comunications originally took place). When processor M3 has located the required data, it pulls its port 5 low. This signals processor M2 in test 530 (see FIG. 6) that processor M3 is ready to communicate data to processor M2. Processor M2 then again initiates communications by sending an interrupt signal to the interrupt input of processor M3. After synchronization has occurred, processor M2 sends a one-byte code to processor M3, which informs processor M3 that processor M2 is ready to receive the requested information. Processor M3 then sends a byte to processor M2, which byte indicates the number of bytes to be communicated from processor M3 to processor M2. If this byte is 0, then no data is to be sent, and test 535 directs processor M2 to the Key Processing Routine 545, bypassing the playing of any automatic notes during the current interrupt. Because the automatic patterns do not usually contain information on every 48th note (that situation would occur only in very complex automatic patterns), a 0 is sent to processor M2 on more than half of the 48th note interrupts.

As noted, processor M3 determines, from the address of the variation table and the number of 48th notes that have occurred since the first one of the pattern, which note code set, if any, coincides with the current FEC count. The method by which processor M3 accomplished this is described hereinafter. If the current FEC count coincides with notes in the automatic pattern, then the first byte communicated to processor M2 by processor M3 will contain the number of bytes in the note code set. This is determined by the right nibble of the second byte of the note code set, which is equal to the number of note offsets contained in the set. Adding two to this number gives the total number of bytes in the set, because every note code set contains two bytes in addition to the number of offsets in each set. If the first byte communicated is not a 0, then by execution of routine 540 processor M2 stores the designated number of bytes in the note code set into an area in its external RAM for later use in processing the automatic notes.

A series of tests (560, 565, 570, and 580) is encountered after routine 540. These tests relate only to the Funchords mode which is discussed hereinafter. In the One Finger Chord mode, the FEF flag is cleared by routing 575 (this flag is used in the Funchords mode only), and processor M2 branches to the WBO (walking base) routing 585 to process the stored note code set.

(h) Automatic Note Processing Routine

With reference to FIG. 4, the program being executed by procesor M2 will have branched through tests 254, 255, 256, and 258, and the FEF flag will have been cleared by routine 260 (routine 260 is used for the Funchords mode and will be discussed hereinafter). Next, the notes corresponding to the note code set, which has been stored away in external RAM by routine 252, are processed and output. A detailed flow diagram of Automatic Note Processing Routine 262 is shown in FIGS. *7a* and *7b*.

The first four tests (605, 610, 615, and 630) in FIG. *7a* concern the Ending Chord Routine, Funchords, and the operation of a "forced root note" whenever the root note is changed. As these are incidental to the operation of the Automatic Note Processing Routine 262, as are routines 620, 635, and 640, they are described hereinafter. That is, in normal automatic operation when a pattern is running and the root note has not been changed recently, the program falls through these tests (after resetting certain flag bits in register R8 in routine 618, as described hereinafter) to test 645. At this test, the data counter is loaded with the address of the second byte of the note code set (which was stored in external RAM by the previous routine, as described above). If this byte is equal to 0 a rest is required, and all automatic notes that are currently playing (i.e., automatic notes that have been triggered previously and that have not yet been damped, so that they are slowly decaying away according to their sustain capacitor) are damped with a short damp in the preferred embodiment. Whenever any automatic note is sounded its note code set is stored in one of 16 scratch pad registers, hereinafter referred to as the CPN memory (currently playing notes memory). At the time a note is stored in a byte in one of these 16 scratchpad registers, bit 7 of that byte is set to "protect" the note. After execution of the Automatic Note Processing Routine 262 is completed, all notes in CPN whose protect bits are not set are damped and all protect bits in the CPN are reset. This is to insure the damping of any automatic notes that might have been played by a previous interrupt but that do not appear in the present note code set.

The Damping Routine 675 loads all notes in the CPN into an area of external RAM. Processor M2 then initiates a communication with processor M3 (in the manner described above). Processor M2 then sends a coded byte to processor M3 to indicate that notes are going to be transferred to processor M3. Next, a byte equal to the number of bytes to be communicated is sent to processor M3 followed by the actual bytes comprising the note code sets of the notes to be damped (bit 7 is set for the notes to be damped). After this communication, processor M3 damps the notes it has received, and processor M2 returns from its interrupt routine to wait for the next interrupt to be initiated by its own timer (routine 234 on FIG. 4).

If the second byte of the note code set is not 0, then there are notes to process. In that case test 645 routes the program to routine 650, where the process of calculating the volume of the bass notes begins. This volume is calculated from the setting of the volume potentiometer 210 and the level of accent of the bass notes, which is indicated by a number stored in the left nibble of the third byte of the note code set, as described above. The setting of the volume potentiometer 210 is converted to a number in the range of 0 to 20 by processor M3. This number is communicated to processor M2 early in the interrupt program and is stored in processor M2's scratchpad for use in this routine 650.

As noted above, the accent values range from 4 to 8, with 0 corresponding to no accent. In routine 650, the data counter of processor M2 is loaded with the address of a 29-byte volume lookup table, which contains values ranging from 51 (at the beginning of the table) to 255 (the end of the table). Each value is 0.5 decible higher than the previous value, providing a total range of approximately 14 decibels from the lowest to the highest value. If the bass notes for the note code set are not to be accented, and therefore the accent value in the table is 0, test 655 causes routine 660 to set the accent value to 5. Then routine 655 subtracts 4 from the value to give an accent value in the range of 0 to 4. This value is then multiplied by two (by shifting the byte left once) and in 670 added to the contents of the data counter, which is still addressing the 29-byte volume table. In 680 the value of the volume potentiometer 210 (a number from 0–20) is added to the data counter. The data counter then addresses the byte of the volume table that ultimately will be output to the D/A convertor 300 by processor M3.

Multiplying the accent by two allows the accent values to be approximately one decibel apart, affording exact control over the accent levels, while the volume potentiometer 210 is adjusted in 0.5 decibel steps, making the digital changes in the potentiometer virtually undetectable. For example, if the volume reading is 0 and the accent level is 8, the address of the volume table byte is the address of the first byte plus $((8-4)\times 2=8)$, or the ninth byte of the table, which is 4 decibels higher than the first byte of the table. If the accent had been 4 in the above example, the desired volume table address would have been the first byte of the table plus $((4-4)\times 2=0)$, or the first byte of the table. So, for any position of the volume potentiometer 210, the accents range over 9 bytes of the volume table, which corresponds to a range of 4 decibels. With the volume potentiometer 210 at its highest setting and an accent of 8, the volume table address is the first byte plus $((8-4)\times 2=8)$ plus 20 (the highest volume pot reading) to equal the 29th or last byte of the volume table. This byte, which contains the number 255 in decimal, is the highest number that can be sent to the eight-bit D/A convertor 300 and it causes the highest output volume of the instrument to be sounded. After the bass note volume has been calculated, it is stored in a scratchpad register by routine 685 for use later.

The second byte of the note code set is used by routine 690 to store the total number of notes in the note code set in a register R5 and routine 695 stores the number of bass notes in a register R4. That is the left nibble of the second byte of the note code set is stored in register R4 and the right nibble is stored in register R5. Registers R4 and R5 are used as counters to be decremented in the Automatic Note Processing Routine 262 (see FIG. 4) beginning at routine 740 (see FIG. 7*b*). The forced bass note referred to in routine 750 is described hereinafter.

The NPB flag normally is not set, so that test 700 normally causes the program to branch to routine 740. The large looping routine commencing at test 745 processes the bass notes first and then the treble notes. The first test 745 determines whether any bass notes are left to process. If the contents of register R4 equal 0, either there were no bass notes in the note code set or all base notes in the noted code set already have been processed. In either case, register R4 is equal to 0, and routine 750 sets a bit in register R8 that serves as a TPF (treble processing flag) to the reset of the routines that treble notes are being processed. This routine 750 also resets an FBN (forced bass note) flag concerning the forced bass note, which is discussed hereinafter. Routine 755 then calculates the volume of the treble notes using the right nibble of the third byte of the note code set and data corresponding to the setting of the volume potentiometer 210. This calculation is done in the same way as the bass volume calculation. Routine 760 then loads a scratchpad register with the next note offset from the note code set. Ignoring for purposes of the immediate description the forced note tests and routines (765, 770, 775, 785, and 790), which are discussed hereinafter, the program branches to routine 795. This routine calculates the note code to be output from the root note code stored in the scratchpad memory of processor M2 and the offset stored in register R2. The note code is calculated by subtracting the offset in register R2 from the root note code and adding 24. If this routine determines that the note should not be output, it will set the note code equal to ØFF hex, and test 800 will cause the program to bypass the rest of the loop and branch to routine 845. It is determined that the note should not be output only if the offset calls for the playing of a dominant 7th note when the playing of a 7th note would be inappropriate. Assuming that the note is to be played, routine 795 may cause the raising or lowering of either bass notes or treble notes where it has been predetermined (in the preferred embodiment) that their playing range for a given note and variation is too high or low.

Test 820 tests to determine if the retrigger bit of the offset, bit 7, is set. (The offset is stored in register R2). This bit is stored in the note code set, as discussed above. If the bit is not set, the note has been triggered by a former note code set, and the note is neither retriggered nor damped. In this case, routine 825 locates the note in the CPN memory (not shown) and sets its protect bit. As noted above, setting its protect bit will cause the note not to be dampled at the end of the Automatic Note Processing Routine 262 (in routine 855).

The location of the note in CPN memory, as described above, is determined by loading the calculated note code into the accumulator of processor M2, and sequentially comparing the accumulator to each value in the 16-byte CPN memory. The note will not be found in the CPN memory if a change in the root note occurred after the note in question was triggered the first time. For example, if the root note had been C and the offset was 31, the note code for G2 would have been stored in the CPN, and the G2 key would have been played (i.e., root note code minus the offset plus 24 is equal to 72−31+24 or 65, which is the note code for G2). If the root were to change to a G# before the current interrupt, then the same offset of 31 would result in the routine 795 calculating a note code for D#3. Since the note code for G2 and not D#3 is stored in the CPN memory, the protect bit for G2 will not be set. As a result, routine 855 will eventually damp the G2 key. This is desirable because the sustaining of a G2 key might clash musically if the root of the chord were to change to G#.

If the retrigger bit of the offset is set, then, test 830 branches either to routine 842 (if the note is already stored in CPN) or to routine 840, which stores the note in CPN. Both routine 842 and 840 set the note's protect bit in CPN and store the code in external RAM for communication to processor M3.

The volume (either bass or treble) is stored in a byte following the note code in processor M2's external RAM. Both the bass note and the treble plus bass note counters (registers R4 and R5) are decremented in routine 845. It should be noted that the bass note counter, register R4, will contain a negative number after all bass notes are calculated and treble notes are left. Routines 750 and 755 are run only once, which occurs when R4 is equal to zero as determined by test 745 (i.e., when the switch is made from bass to treble notes). Because a maximum of 16 notes (the capacity of the CPN memory) are processed during any one interrupt, register R4 cannot become equal to 0 more than once during one interrupt. If there are notes left to process, test 850 branches to test 745, and the next offset is processed.

When all offsets in the note code set have been processed, register R5 will equal 0, and test 850 will branch to routine 855. Routine 855 scans each byte of the CPN memory. Any byte whose protect bit is not set is then stored in external RAM, with its damp bit set, along with the other notes (if any) to be communicated. All such bytes are then removed from the CPN memory. It should be noted that the protect bits in the CPN memory are used only during the Automatic Note Processing Routine 262 to avoid damping notes and that these bits are always reset at the end of the routine. At this point, processor M2's external memory contains the note codes for all notes to be damped (with bit 7 set) and the note codes for all notes to be triggered (followed by their amplitudes). All this information is then sequentially communicated to processor M3 by routine 860. Test 865 and routines 870 and 875 are discussed hereinafter in connection with the forced root feature. Destination block 880 returns processor M2 from its interrupt to wait for the next interrupt. After this last communication, processor M3 outputs keys and damp keys in accordance with the instructions received in the communication.

(i) Minor Touch Strip Operation

In the One Finger Chord mode, the player can obtain minor chords by touching the minor touch strip, which in the preferred embodiment is a thin metal strip running along the front of the instrument in the vicinity of the automatic note range of the keyboard.

Processor M3 reads the status (i.e., whether it is being touched) of the minor touch strip, as hereinafter described. The status of the minor touch strip is indicated by a single bit, which is communicated to processor M1 during the general communication that occurs during execution of routine 238 (see FIG. 4). After communications, the minor touch strip bit, which is hereinafter referred to as "MINBAR", is stored in a register in the scratchpad of processor M2.

Another bit in the scratchpad memory of processor M2, hereinafter referred to as "MIN", normally is set equal to the MINBAR bit. Whenever the MIN bit is a 1, a minor pattern is played when the instrument is in the One Finger Chord mode. When MIN is 0, a major pattern is played when the instrument is in One Finger Chord mode. The only instance when MIN does not equal MINBAR is when the Memory mode has been selected (as discussed hereinafter), the automatic pattern is playing, no automatic key is depressed, and the player first touches and then removes his hand from the minor touch strip. In this case, even though the MINBAR bit is 0 after the player removes his hand from the minor touch strip, the MIN bit remains a one until a key within the automatic range is depressed again while the minor touch strip is still untouched. This is to allow the Memory mode feature to "remember" the fact that the minor touch strip was touched, causing a minor automatic pattern to sound even when the piano is not touched by the player.

Figure 7A:
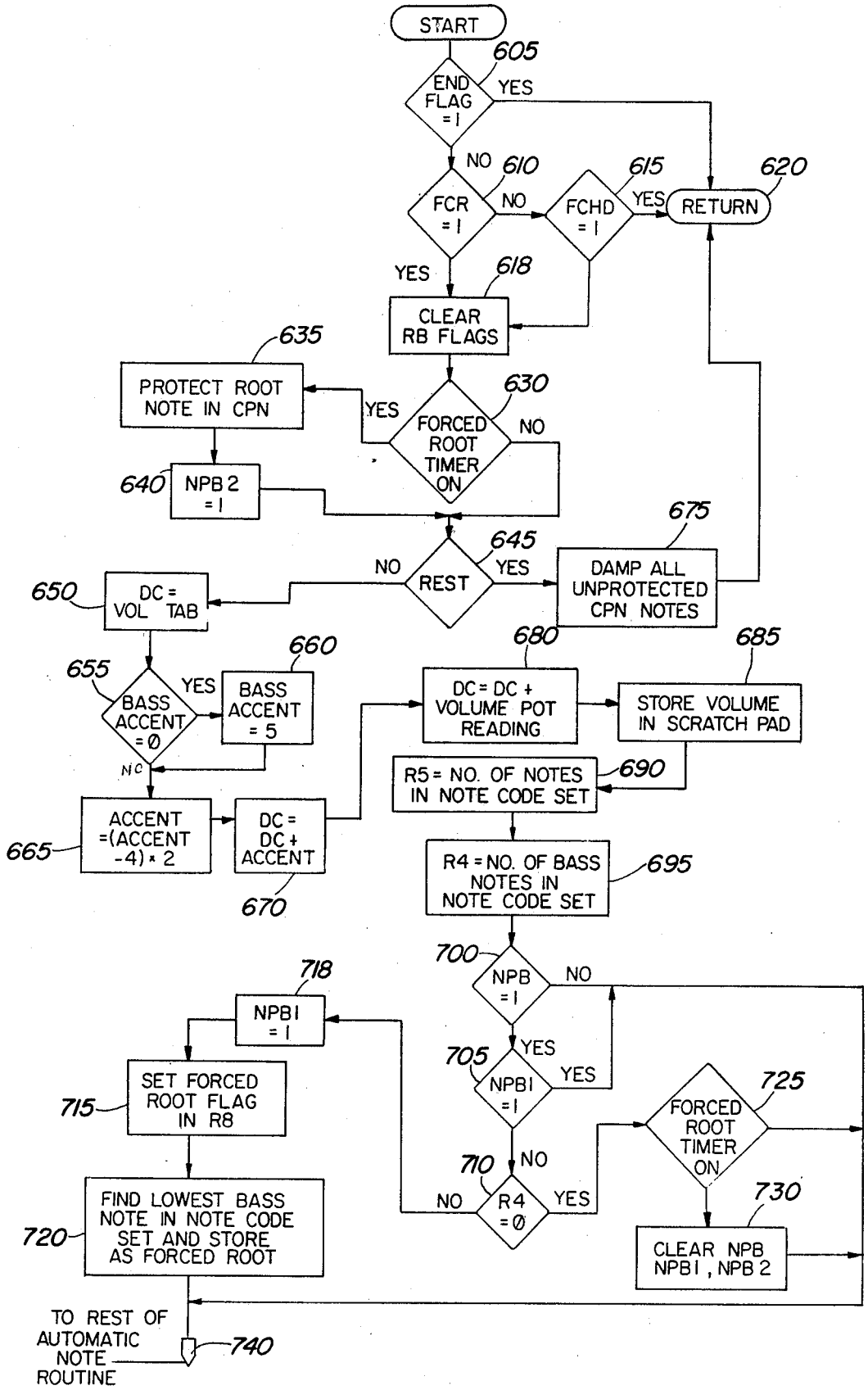
FIG. 7*a* is the first portion of a flow diagram of the routine used to process note information in the present invention.
Figure 7B:
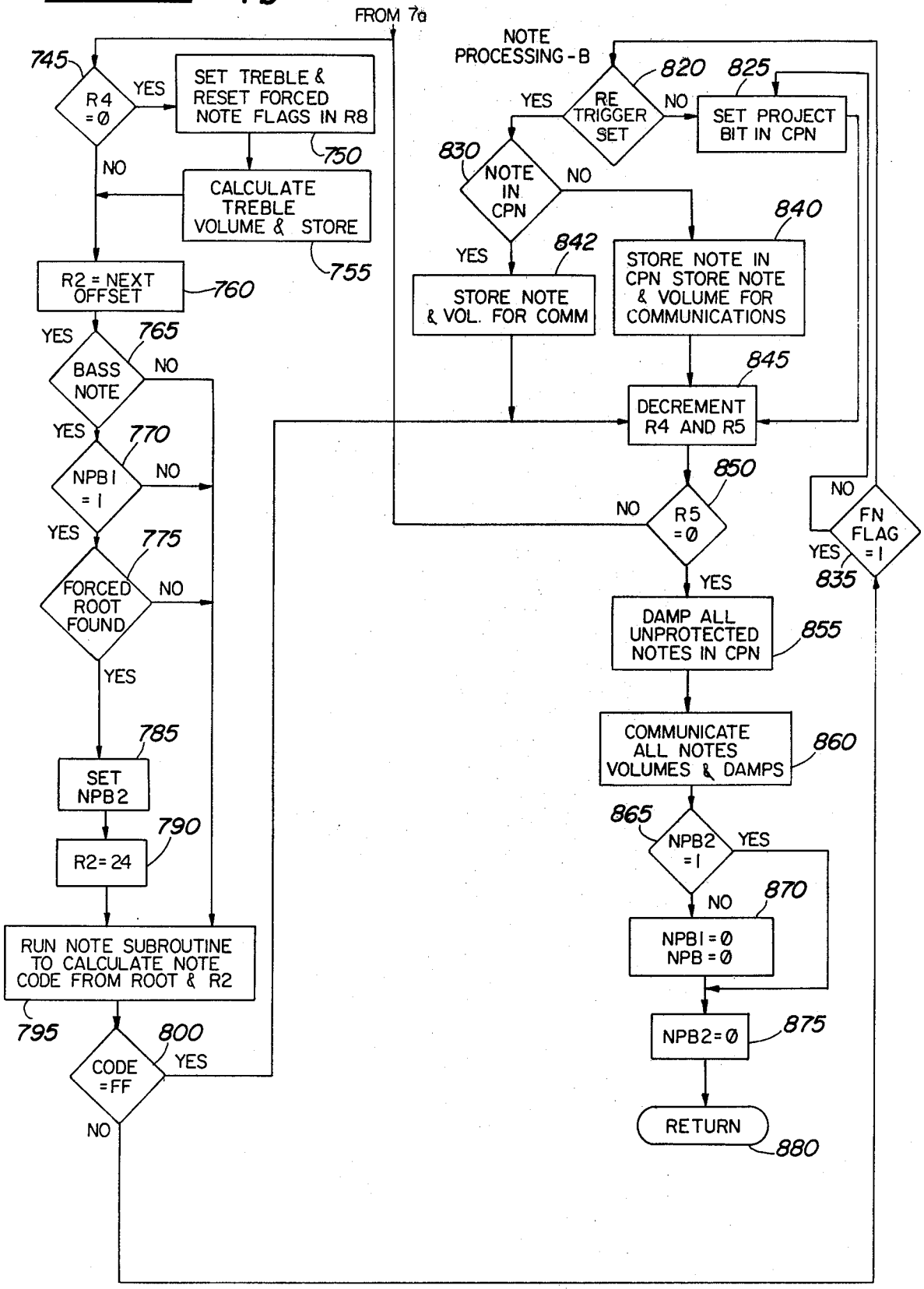
FIG. 7*b* is the second portion of a flow diagram of the routine used to process note information in the present invention.

With reference to FIG. 7*b*, execution by processor M2 of note routine 795 causes the automatic pattern to sound minor when called for by the MIN bit. After calculating an automatic note, this routine 795 examines the offset. If the offset is greater than 11, this routine substracts 12 from it repeatedly until it becomes less than 12, at which point the resulting offset is in the bottom octave. If the offset is equal to 4, then the note routine 795 will have just calculated a note code that is a major third of the root note (or a major third of the root note one or more octaves up the keyboard). This is because the major third is four semitones up from the root note. If processor M2 determines that the offset is 4 and if the MIN bit is set, execution of routine 795 adds a 1 to the note code that it has just calculated. This causes the note code to represent a note one semitone lower than othewise would have been the case. Thus, in this method the routine 795 lowers all thirds of the root note by one semitone causing them to be minor thirds and thereby cause the automatic pattern to sound minor.

(j) Sevenths in One Finger Chords

Control of major and minor automatic patterns has been described above. The One Finger Chord mode is also capable of generating seventh chords (both major and minor). The seventh chords are generated automatically so that the player does not have to press any seventh control while he or she is playing. Since sevenths are musically desirable only in some instances but not in others, the automatic chord is dependent on the root note selected and the style expander selected (if no style expander is selected, then no sevenths are generated). Given the style expander selected and the root note played, processor M2 determines whether the I, I sharp, II, II sharp, etc. key is played. Processor M2 then uses a lookup table to determine if any sevenths should be played. The rule used in generating the lookup table is that the I sharp, II, II sharp, V, V sharp and VI keys will cause sevenths to play. All other keys will inhibit the sevenths. This table information is obtained during execution of the Control Logic and FEC Update Routine 246 (see FIG. 4). If sevenths are to be played in the pattern, then a bit called SEV is set in a scratchpad register in processor M2.

Referring the FIG. 7*b*, after the note routine 795 calculates the note code from the root note and the current offset, it alters the offset to get it into the range of O to 11 (as described above in connection with the Automatic Note Processing Routine 262). If the adjusted offset equals 10, then the automatic note is a seventh note. In this case, processor M2 examines the SEV bit. If the bit is set, the note code is not altered, and the seventh note will be triggered. If the SEV bit is not set, and the One Finger Chord mode is selected, then the note code is set to FF (hexadecimal). When this happens, the test 800 routes the program to routine 845, and the seventh note is not processed.

(k) Treble Note Protection

When automatic patterns are playing, a player often will play treble notes with his or her right hand which also are played by the automatic pattern. This creates a conflict between the automatic pattern and the player's right hand. The problem is best demonstrated by the situation in which the automatic pattern plays a given note and later damps the note. If the player happens to play the note expecting to hold it down to create a sustained tone just before the automatic pattern damps the note, then the note will be damped even though the player is still holding it, expecting it to sustain. This conflict would occur often in the course of playing a piece of music, thereby making it seem as though treble notes were not under the complete control of the player.

In the preferred embodiment of the present invention protection of the treble notes is provided so that the automatic notes cannot damp any treble note that is being held down. A group of registers hereinafter referred to as TNP (treble note protect) is reserved in the scratchpad RAM of processor M2, and each key to the right of the automatic note range is assigned one bit within this set of TNP registers. Whenever a treble note is played, the Key Processing and Tab Input Routine 270 sets the bit corresponding to that key in the appropriate TNP register. When the key is released by the right hand, this bit is reset by the routine 270. Routine 855 within the Automatic Note Processing Routine 262 checks all notes that are about to be damped to determine if their TNP bit is set. If so, the routine 855 does not store the damp for that note, and the note will not be damped as long as the player is holding it down. Thus, the automatic patterns cannot interfere with the playing of treble notes by the right hand.

Another, less serious problem arises if a treble key is being held down by the player and the automatic pattern plays it multiple times within the pattern as a 16th note, for example. When this happens the automatic pattern cannot damp the note (because its TNP bit is set); therefore, the note will appear to sustain on as if it were supposed to be a continuous series of tones. After several seconds of this, the effect becomes apparent, and the note sticks out in the pattern, creating a ringing effect. To solve this, every time a new note is played in the preferred embodiment, the TNP cancel timer is set by the Key Processing and Tab Input Routine 270 to a value of 255. This timer is decremented upon every interrupt so that it takes the timer $255 \times 0.0052$ seconds (1.3 seconds) to be decremented to 0. After the timer has reached O (where it remains until another treble key is played, all the TNP bits are set equal to 0, thus clearing the treble note protection bits. Thus, the automatic patterns are again allowed to damp treble notes even if they are being held down, because their TNP bits have been reset. This insures that no note played in the treble range and held down can be damped until 1.3 seconds after it is played. It also insures that no treble notes will continue to be keyed by the automatic pattern without being damped if a chord is held by the right hand for a period longer than 1.3 seconds.

(8) Operation in the Funchords Mode (a) General Description

The other mode of automatic operation of the preferred embodiment of the present invention is the Funchords mode. In the Funchords mode operation of the automatic patterns is similar to operation in the One Finger Chord mode. The same style selector pushbutton switches are used to select the same patterns, and the style expanders are used to select the same variations, depending on the root note.

The major difference between the Funchords mode and the One Finger Chord mode is in the method of selecting the root note. Instead of playing a single key, as in the One Finger Chord mode, at least three keys must be played, and the root is identified by processor M2 from the notes played. This requires the player to have more skill, but it allows more types of chords to be played than in the One Finger Chord mode.

(b) Identification of Root Note

In the Funchords mode, the note codes for all notes that are played in the automatic range are stored in four bytes of external RAM in processor M2 (one bit per note). These bytes are referred to hereinafter as LNST (low note storage). To determine the location of a newly-played key within LNST, processor M2 first examines the note code of the key, which ranges from 48 hexadecimal (72 decimal) for C2 at the low end of the automatic note range to 35 hexadecimal (53 decimal) for G3 at the high end. The note code is then ANDED with 7 to obtain the right three bits, and this result is added to the data counter, which previously was loaded with the address of a table containing eight bytes with a single logic 1 bit per byte (for example, 01 02 04 08 10 20 40 80). The table byte addressed by the data counter is then loaded into the accumulator and stored, for example, in register R1. The note code is then shifted left one and shifted right four to yield a number in the range of 6 to 9. The number is then decreased by 6, resulting in a number from 0 to 3, which is added to the data counter. The data counter previously has been loaded with the address of the first byte of the LNST memory location. At this point, the data counter addresses the correct byte within LNST for the note code and register R1 contains the position within the byte where the bit for the newly-depressed key resides. The bit is then ORED into the LNST byte and the result stored in the LNST byte. If the note code's bit 7 has ben set, which is a damp signal, the key is removed from LNST by EXCLUSIVE ORING the bit into the same LNST byte. All LNST bytes are then ORED into two bytes (called FCNOT) in the external RAM of processor M2. That is, for example, if any C is played, a 1 is stored in bit 0 of the first FCNOT (Funchords note) byte. In a similar manner, bit 2 is set if any B is played, bit 3 is set if any A♯ is played, etc. The first FCNOT byte contains F through C, and the second FCNOT byte contains C♯ through E in its right nibble. The total number of bits set in the two FCNOT bytes is then counted and the total stored in a byte in external RAM called NFCNOT (number of Funchords notes). By examining the LNST bytes, processor M2 determines the note code of the lowest note played and stores the code in an external RAM byte called FLN. By repeatedly subtracting 12 from this code until the result is less than 12, processor M2 calculates the lowest note number in the range of 0 to 11 (C=0, B=1, A♯=2, etc.) and stores this in RAM in a byte called FLN♯ (Funchords low note number). All of the above operations are performed by the Key Processing and Tab input Routine 270 whenever the instrument is in the Funchords mode and a new key in the automatic range is played or an old key is released (as determined from the information communicated from the processor M1 to processor M2 via the FIFO's 205).

The identification of the chord that is played in the automatic note range is made by the Chord Recognition Routine 284. From the information calculated in the Key Processing and Tab Input Routine 270, the routine 284 runs a series of tests on the data to determine the root note of the chord. These tests to determine the root note are the same as those described in the U.S. patent application entitled "Chord Identification System for Electronic Musical Instruments," filed June 18, 1981 by Simmons and Uetrecht, Ser. No. 275,082 and now U.S. Pat. No. 4,389,914 hereinafter referred to as "Chord Identification"), which is incorporated herein by reference.

(c) Expansion of Chord Identification Method

If the tests in Chord Recognition Routine 284 do not recognize any chord, then the lowest note is assumed to be the root note, and a flag is set in scratchpad to indicate that a chord was not found. The chord identification in the system described in the above-referenced "Chord Identification" patent application was used to determine the root note for an automatic bass pattern, e.g., a walking bass pattern. If no chord was identified in that system, then whenever the bass pattern was to play a third interval note, it would play a flatted fifth instead. This avoided conflict with a minor third that could be held down by the player on the accompaniment manual of an organ.

The chord identification in the present invention improves upon the above method. This improvement allows for the identification of diminished, augmented, and suspended chords. The existence of a diminished or augmented chord is examined after chord recognition tests determine that no chord exists (according to the tests described in the above-referenced "Chord Identification" patent application). The existence of a suspended chord is detected within the normal chord identification routine.

When processor M2 has determined that no normal chord exists (i.e., no chord other than a diminished, augmented, or suspended chord), it rearranges the two FCNOT bytes so that the lowest-played note, which is now considered to be the root note, is in bit 3 of the second FCNOT byte. This is accomplished by transposing the FCNOT bytes a number of times equal to the FLN♯ + 1. FLN♯ is the number of the lowest note played within the automatic range that has been transferred to the range 0 to 11. To explain transposing, it is helpful to picture the two FCNOT bytes as a single 12 bit number, the left 4 bits of which are formed by the right nibble of the second FCNOT byte, and the right eight bits of which are equal to the first FCNOT byte. At the commencement of execution of routine 284 this 12-bit number would have bits set for any of the twelve key names in the following order: C♯, D, D♯, E, F, F♯, G, G♯, A, A♯, B, C. To transpose this number means to shift it to the right one position and replace the bit in the old C♯ location with the bit in the old C location. Now, every bit position contains a note that is one semitone lower than before. To implement this operation in two 8-bit registers requires multiple shifting and moving of bits on the right ends of each FCNOT byte. As an example of this operation, suppose that the lowest note were B. Then the FLN♯ would equal 1. Transposing the 12 bits a number of times equal to FLN♯ + 1 (or 2) would result in first a C on the left end and finally a B on the left end of the twelve bit number. In the preferred embodiment, the B would have ended up in bit location 3 of the second FCNOT byte. After this operation, the presence of any interval of the low note is determined by examining the bit locations in the two FCNOT bytes, the second of which contains the location of the lowest note in bit 3. For example, since a minor 3rd is three semitones higher than its root, then the bit location containing the presence or absence of a minor third is FCNOT bit 0, which is three bits to the right of the root in bit 3. Similarly, the 5th interval of the root would be found in the first FCNOT byte in bit 4, which is 7 bits to the right (remembering the 12 bit number) of the root location. Intervals such as 3rds, 5ths, 7ths, etc. referred to hereinafter are determined by processor M2 by the method just described.

In the Chord Recognition Routine 284 (see FIG. 4), once the above transpositions are completed, processor M2 checks to see if a minor 3rd is played. If so, it then checks to see if a minor 5th is played. If so, it is assumed that the chord is a diminished chord. Processor M2 then sets the flatted 5th flag (FF) and branches to the minor routine as described hereinafter. If no minor 3rd is found, processor M2 checks to see if a 5th sharp key is played. If so, it sets the AF flag (augmented 5th). These flags are used in the execution of the Automatic Note Processing Routine 262 to cause an augmented or diminished pattern to play.

Processor M2 conducts an extra test within the Chord Recognition Routine 284, which is not conducted in the chord recognition routine described in the above-referenced "Chord Identification" patent application, to determine if the chord is a suspended chord (i.e., a root note, 5th, and 4th). This Chord Recognition Routine 284 begins by looking for a 5th interval of the note currently in the root position of the FCNOT bytes (i.e., bit 3 of the second byte). If no 5th is found, the FCNOT is transposed repeatedly until a 5th interval is found. If a 5th interval of the note is found then processor M2 tests to see if a 4th interval is played. If so, the SUS (suspended) flag is set to indicate the presence of the root, 5th, and 4th notes (suspended chord) and continues on with the routine. If not, processor M2 checks to see if a 2nd interval is played. If not, processor M2 continues on with the execution of the routine, having found no suspended chord by that point. If a 2nd interval of the current root is found, however, this 2nd interval is also the 5th interval of the current 5th of the current root. If a 2nd interval of the current root is found, then there is a suspended chord that has the current 5th as a root. If this is the case, processor M2 rejects the recently discovered root-5th relationship and begins transposing to find another root-5th pair, the suspended chord. For example, if C is the current root and processor M2 has found a 5th (G), and it determines that D is also played (the 2nd interval of the C but also the 5th interval of the G), then it rejects the C as a root and transposes until G is the proposed root. Then it finds the D as the 5th, and it finds a 4th interval (C is the 4th interval of the new root G). It then sets the SUS flag, identifies G as the real root, and continues on with execution of the rest of the routine as described in the above-referenced "Chord Identification" patent application.

The Chord Recognition Routine 284 now determines the state of the MIN flag (minor flag). At this point, the root has been determined by one of the above two methods (i.e., by identifying an actual chord or by default to using the bottom note as the root). If the minor 3rd is played (i.e., bit 0 of the second FCNOT byte is set, because it is three semitones to the right of the root bit), then the MIN flag is set to indicate that a minor pattern should be played. This MIN flag is the same flag that was used in the One Finger Chord mode, but there it was controlled by the player touching the minor touch strip instead of by playing a minor 3rd key. The effect on the automatic pattern is identical; all major thirds in the pattern are flatted.

After the state of the MIN flag has been determined, processor M2 examines the FCNOT bytes for intervals of a 6th, dominant 7th, or major 7th. These three bit locations are located respectively in bits 2, 1, and 0 of the first FCNOT byte. The states of these bits are loaded directly into three flags in the scratchpad RAM (named SIX, SEV, and MSEV). The program now branches to routine 234 to wait for the next interrupt.

Having described how the flags, AF, FF, SUS, SIX, SEV, and MSEV are derived, the use of these flags to affect the automatic pattern will now be described. Each of these flags is examined in the Automatic Note Processing Routine 262. More specifically, they are processed by routine 795 in FIG. 7*b*. As described above in connection with the One Finger Chord mode, the Routine 262 uses the root note stored in scratchpad and the offset byte from the note code set to calculate the note code of the note to be output. The root note in the Funchords mode is the root note of the chord identified by Chord Recognition Routine 284.

Routine 795 (see FIG. 7*b*) examines the current offset from the note code table. If it is greater than 11, it repeatedly subtracts 12 from the offset until it is in the range of 0 to 11. Processor M2 then determines which interval from the root note will be played by the note code. For example, a 0 offset is a root, an offset of 7 is a 5th (because a 5th interval is 7 semitones higher than the root note), and an offset of 10 is a dominant 7th. In other words, the offset, in the range of 0 to 11, is the number of semitones higher the automatic note is from the root note.

Figure 8:
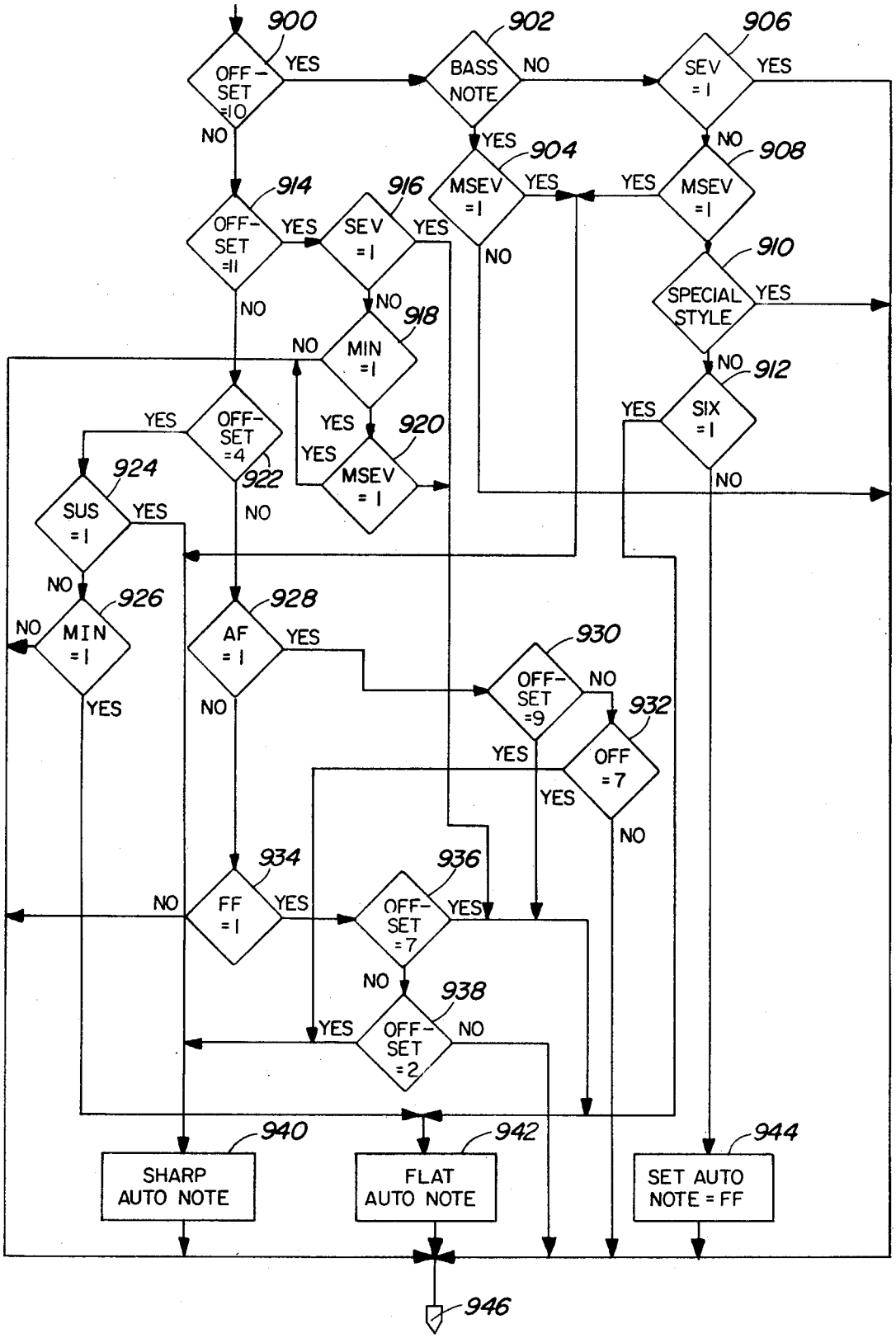
FIG. 8 is a flow diagram of the routine used to provide an expanded set of automatic chords in the present invention.

FIG. 8 shows how routine 795 (see FIG. 7*b*, uses the MIN, SIX, SEV, MSEV, SUS, AF, and FF flags to alter the existing automatic pattern according to the actual chord that is being played. Although several tests are illustrated in FIG. 8, it should be noted that this logic can have only one of four results. First, the note represented by the automatic note code (that has just been calculated by routine 795) can be made sharp by a Sharp Auto Note Routine 940. Routine 940 makes a note sharp by subtracting 1 from the automatic note code, thus causing the note to be played one semitone higher than it otherwise would have. A second possible result is that the note can be made flat one semitone by a Flat Auto Note Routine 942 by adding 1 to the automatic note code. Third, the automatic note code can be set to FF hex by routine 944, which causes the note not to play. Finally, the note can remain unchanged after execution of Routine 795.

Test 900 checks to see if the offset is equal to 10. If so, the automatic note is a 7th. In all variations of all styles, there are 7th notes written wherever they are appropriate to the music. However, these 7th notes are not always played, since there are many instances where 7th notes would not be desirable. As described above in connection with the One Finger Chord mode, 7ths are played or not played according to the style expander and the root note played (the SEV flag was set to cause 7ths to play in the One Finger Chord mode). However, in the Funchords mode, the player has more control over the playing of 7ths. In general, 7ths will play wherever they are written into the automatic pattern when the player plays a 7th chord, and 7ths will not play if the player is not playing a 7th.

Tests 902 through 912 relate to exceptions to the foregoing general rule. The treble flag is tested by test 902 to see whether processor M2 is still processing bass notes by executing the Automatic Note Processing Routine 262 or whether it has started processing treble notes. If treble notes are being processed, test 906 tests to see whether the player is playing a 7th note in the chord (i.e., whether the SEV flag is set). If the SEV flag is set, the program branches to arrow 946, leaving the automatic note code for the 7th unchanged. This is the fourth possible result described above. In this case, the 7th will play.

If the SEV flag is not set (i.e. SEV=0), test 908 checks to see whether a major 7th note is being played. If so, the program branches to routine 940, where the automatic note code for the 7th note is sharped one semitone. This is the first of the four possible results described above for the logic in FIG. 8. The result of the note being sharped one semitone is that, even though a dominant 7th is programmed into the pattern, if the player is playing a major 7th, then the major 7th note will sound instead of the dominant 7th.

Similarly in test 912, if the player is playing a 6th interval (i.e., SIX=1), then the programmed 7th note will be made flat one semitone by routine 942, and the resulting pattern will sound 6ths wherever 7ths had been programmed. This is the second of the four possible results described above.

When no 7th, major 7th, or 6th key is played, then the routine 944 will set the note code to FF hexadecimal. This will cause test 800 (FIG. 7*b*) to branch to routine 845, and no key will be played for the programmed 7th note. This is the third of the above-described possible results. An exception to this third result just described occurs in connection with styles in the preferred embodiment which are considered special styles. These are styles in which the 7th notes are critical parts of the style and should always be sounded whether or not they are played. An example of this is the Boogie style, in which 7ths make up the "flavor" of the style. To provide these exceptions, test 910 determines whether the currently-selected style is one of these special styles. If it is the program branches to arrow 946, allowing the 7th to be played.

In test 902, if bass notes are still being processed, the program branches to test 904, which checks to see if a major 7th is being played. If so, routine 940 will sharp the note, as described above, causing it to play a major 7th. If a major 7th is not being played the program branches to arrow 946, and the 7th note will play. This is because, although 7th notes written for the treble notes usually are written as part of a chord and do not make the style sound "empty" if deleted, the 7ths in the bass notes usually are played alone without other bass notes. If the 7ths in the bass line were left out, there would appear to be a "hole" inthe music. Therefore, all 7ths in the bass notes are always played (either as dominant or major 7ths, according to the result of test 904). In the preferred embodiment, one instance in which 7ths are programmed as bass notes is in the walking bass line of the Boogie style.

In test 914, if the offset for the automatic note is equal to 11, then the automatic note is programmed as a major 7th, and the program branches to test 916. If a dominant seventh is being played (i.e., SEV=1), then the note that was programmed for a major 7th gets flatted by routine 942 to cause a dominant 7th to play. This is because if a player is playing a dominant 7th, the desired result is dominant 7th notes. So if a major 7th is programmed in the style and the player is playing a dominant 7th, then the dominant 7th will sound in place of the major 7th. Because it is musically better to play a dominant 7th instead of a major 7th when playing a minor pattern, test 918 is used to cause the major 7th to play minor 7th if MIN=1. An exception to this occurs when a player is playing both a minor chord (setting MIN=1) and also a major 7th. In that case test 920 overrides the effect of the minor pattern and allows the major 7th to play as programmed.

If the offset is equal to 4, then the automatic note will be a 3rd interval of the root (the 3rd is 4 semitones higher than the root note). In this case, test 922 branches the program to test 924 to determine whether a suspended chord is being played (i.e., SUS=1). If so, test 924 sends the program to routine 940 to sharp the note. This raises the 3rd interval to a 4th, and the automatic style will then be playing suspended chords wherever 3rd intervals are programmed. If SUS=0, then test 926 determines from the MIN flag whether a minor chord is being played. If so, the note code for the major 3rd will be flatted, resulting in a minor 3rd. Flatting all major thirds in the pattern will cause it to be a minor pattern.

If the offset is not equal to 10, 11, or 4, then test 928 checks to see if an augmented chord is being played (i.e., if AF=1). To generate an automatic augmented pattern, any 5ths in the pattern are sharped one semitone, and any 6ths in the pattern are flatted one semitone. The result is that all 5ths and 6ths will play a sharped 5th, forming an augmented chord pattern. Test 930 branches the program to routine 942 to flat the automatic note if it is a 6th, and test 932 branches the program to routine 940 to sharp the note if it is a 5th. If the note is neither a 5th nor 6th, the program branches to arrow 946, and the note code is not changed.

If test 934 determines that the FF flag is set, thereby requesting a diminished chord pattern, and test 936 determines that the offset is a 5th interval, the program is routed to routine 942 to flat the note. This, in conjunction with flatted 3rds (the MIN flag is always set if the FF flag is set) will create a diminished pattern. If the automatic note is a 2nd interval, then test 938 branches the program to routine 940 to cause the automatic pattern to play a minor 3rd.

(d) Funchords Key Timer

Because a player does not play all the notes of a chord exactly simultaneously, it is necessary to delay the recognition of a newly-played chord until all the keys for the chord have been depressed fully. This is accomplished by a register referred to as the "FCHD timer" in the external RAM in processor M2 (see FIG. 4).

Within the Key Processing and Tab Input Routine 270, whenever a key initially is played when the instrument is operating in the Funchords mode, the FCHD timer is set to a value. This value is chosen so that all notes of the chord will be played before the Chord Recognition Routine 284 is executed and so that no noticeable delay is caused between the time the new chord is played and when it is recognized. Four is a typical value for the setting of the FCHD timer in the preferred embodiment. Test 276 determines whether the FCHD timer is equal to 1. The first time this test is run after the Key Processing and Tab Input Routine 270 recognizes a new key, the FCHD timer will equal 4, and the Chord Recognition Routine 284 will be bypassed. At the beginning of each interrupt, routine 238 decrements the FCHD timer by one. After the Key Processing and Tab Input Routine 270 is run again, the FCHD timer will be equal to three. In the above example in which the FCHD timer is set to four, there will be a delay of three interrupts from the time that the last key of the chord has been played until the FCHD timer equals 1, after which delay the test 276 permits the Chord Recognition Routine 284 to be executed.

On occasion, a 48th note time slot will occur and the Table Address Calculation Routine 252 will determine that automatic notes should be output while the FCHD timer is set to a value greater than 1. Because a new chord is being played, as indicated by the FCHD timer being set, it is undesirable for the automatic notes to be output which correspond to the root of the formerly played chord. It is also undesirable for the automatic notes to be skipped, as this would cause a discontinuity in the automatic pattern. To solve this problem, in the preferred embodiment the outputting of automatic notes is delayed until the new chord has been identified. Test 256 determines whether the FCHD timer equals 0, and if not, it sets a bit in a scratchpad register called the FEF flag (48th note flag) in routine 264. It then branches to the Key Processing and Tab Input Routine 270, without outputting automatic notes. In normal operation, the Table Address Calculation Routine 252 determines the current 48th note from the current count of the FEC (48th note counter). Routine 250 stores the current FEC count in register R3 for use in the Table Address Calculation Routine 252.

It should be noted that routine 255 always loads a register called FECX with the current FEC count. After the FEF has been set by routine 264, on subsequent interrupts the FEF flag is checked in test 244. If it is set, test 266 checks to see if the FCHD timer is 0, indicating that the new Funchords has been processed by the Chord Recognition Routine 284 (the routine 284 is run when the FCHD timer is equal to 1; on the following interrupt it is decremented to 0). If the timer is not 0 yet, test 266 branches to routine 270, continuing to bypass the outputting of the automatic notes. When the FEF flag equals 1 and the FCHD timer is timed out to 0 (it never gets decremented below 0), tests 244 and 266 branch to routine 268. Routine 268 loads register R3 with the value of the FEC that existed at the time the last automatic notes would have been output had the root note not been changed. The Table Address Calculation Routine 252 then finds the note code set for the time slot that was just recently missed, and routine 262 outputs the notes according to the newly-identified Funchords. This causes an actual delay in the outputting of automatic notes, but the short delay time is not noticeable. Just before the routine 262, routine 260 always resets the FEF flag. In order to determine the most current information concerning the condition of the keys, test 258 checks the output of the FIFO to see whether a new key in the automatic range has been played and whether the Funchords mode has been selected. If so, a new Funchords has been played, and the FEC timer is set to delay outputting of the automatic notes, as explained above.

(e) Funchords Single Note Bass

In the Funchords mode, a player can play his own bass line by playing only one or two notes in the automatic range. Therefore, it is necessary to play more than two notes to cause the Funchords mode to play in the automatic mode. As noted above, every time a new note is played in the automatic range, the FCHD timer is set, and the processing of the Chord Identification Routine 284 does not take place until the FCHD timer equals 1. If only one or two keys have been played by the time the FCHD timer has been decremented to 1, one or two, respectively, bass notes will be played and the automatic pattern will not start.

Thus, whenever the Key Processing and Tab Input Routine 270 detects that a new key has been played in the automatic range, the instrument is in the Funchords mode, and less than three keys are being played (including the new one), then the key is stored in one of two registers in external RAM. If the first register already has a key stored in it, the key is stored in the second register. At the same time, a flag called FCR (Funchords running) is reset to 0 to indicate that the instrument is not in the automatic mode. When the FCHD timer reaches a value of 1, then the Chord Recognition Routine 284 is executed by processor M2. If the FCR flag is not set, then this routine locates the one or two bytes that were stored above for the single bass notes, stores them both in the CPN memory and in external RAM for output communication. The routine then branches back to the Key Processing and Tab Input Routine 270 to look for any additional note codes that may have been transferred to the FIFO's 205 by processor M1. At the end of this routine, the bass note(s) is communicated along with any other note information to processor M3, which outputs the note(s).

If three notes had been played before the FCHD timer was timed out, then the Key Processing and Tab Input Routine 270 would have set the FCR flag to 1, cleared the bytes that were stored in external RAM for bass notes, and stored damps for any notes in the CPN (i.e., any bass notes that have been played and not damped) for communication to processor M3. When the Chord Recognition Routine 284 is executed again, the automatic pattern will be played. Because the output of the single bass note is delayed by the FCHD timer, the bass note is never played in this instance. This is desirable because, if the player intends to play a chord instead of a single bass note, he would not want to have the bass note played while the FCHD timer was timing out.

When one bass note is played in the above manner processor M1 sends a damp signal to processor M2 for that key when it is released. Key Processing and Tab Input Routine 270 then recognizes that FCR=0, locates the key in CPN memory, removes the key therefrom, and stores its damp for communication to processor M3. It should also be noted that, as soon as the Chord Recognition Routine 284 stores any single bass notes for communication to processor M3, it clears the note from its external memory. This avoids two bass notes being triggered when a new bass note is played.

It should also be noted that after three notes have been played, thus placing the piano in the automatic mode, releasing one or two of the keys will not cause the automatic operation to cease. The Key Processing and Tab Input Routine 270 will not reset the FCR flag to 0 unless a new key is played that results in only one or two keys being held.

(9) Forced Bass Root Note

Common to both the One Finger Chord mode and the Funchords mode is the playing of a root bass note whenever a new key is played that changes the root note. This makes it impossible to play a new note or chord and have no notes play. This also has the advantage of firmly identifying a new chord by making sure that its root bass note sounds as soon as it is played. That is, even if a 5th interval was programmed in the automatic pattern at the same time that a new chord was played, the root of the new chord (not its 5th) will be sounded, clearly identifying the chord. This forced root note feature operates similarly in both the One Finger Chord mode and the Funchords mode.

Although the forced root note is initiated by the Key Processing and Tab Input Routine 270, it is actually processed by execution of the Automatic Note Processing Routine 262. In 730 there are three bits used as flags in processing the forced root called NPB (new note played) NPB1, and NPB2. In 725 a register, referred to hereinafter as the forced root timer, is used to insure that the forced root stays on for at least a predetermined time. Whenever a new root is played, any currently playing automatic notes are damped, and the new root note is triggered. The lowest bass offset is found during the next processing of automatic notes. The lowest bass note offset is referred to hereinafter as the substituted root note. Although the bass note is not played, processor M2 times how long this bass note was intended to play. This time is the length of time that processor M2 will allow the most recent forced root note to play. In other words, processor M2 will not damp the forced root note until the bass note that otherwise would have been sounded normally would have been damped. Processor M2 actually replaces the bass not with the forced root note. The exception to this is that the forced root note always plays for at least a quarter note before being damped. This avoids its being cut off too soon by the programming of a short bass note or a rest.

Whenever a new key is played in the One Finger Chord mode the Key Processing and Tab Input Routine 270 sets the NPB flag and the forced root timer register. This routine 270 also stores the root note corresponding to the newly-played key in CPN memory and stores the note to be output by communications, at the end of the routine. The volume of the note to be output is calculated from the position of the volume potentiometer 210 and the volume table, as described above, (using an accent of 0) and is stored for communications. This indicates during execution of the Automatic Note Processing Routine 262 that the forced root process is starting. Referring to FIG. *7a,* test 700 branches to test 705 if the NPB is set; otherwise, the Automatic Note Processing Routine 262 runs as usual with no forced bass notes. If NPB1=0, then this means that the routine has not yet found a substitute bass note from which to determine the length of the forced root note. If this is the case, and there is at least one bass note in the current note code set, as determined by test 710, then routine 718 sets NPB1=1 to indicate that a substituted root note has been found. A flag called FN (forced note) is set in register R8 by routine 715, and the routine 720 finds the lowest bass note in the note code see (that note calculated from the offset with the lowest value) and stores that offset as the substituted root note offset. NPB1 will be equal to 1 in test 705 when the substituted root note has been found by a previous execution of this routine during a previous interrupt. In either case, the program now branches to the large loop routine in FIG. *7b* that outputs the notes. If test 765 determines from the treble flag in register R8 that bass notes are still being calculated, then test 770 checks the NPB1 flag. If the NPB1 flag is set, a substituted root note has been found either during this interrupt or during a former one, and the program branches to test 775 to determine if the previously-found substituted root note offset is equal to the current offset (i.e., a forced root is found). If they are euqal, the substituted root note has been found in the current note code set, and it is not yet time for the substituted root note to be damped. Routine 785 sets NPB2 to indicate that the forced root note is to continue to sustain. Routine 790 sets register R2 to 24 so that when routine 795 calculates the note code for the newly-played root, its note code is not changed. The note code for the newly-played note was stored by the Key Processing and Tab Input Routine 270 in scratchpad RAM. The FN flag was set by routine 715, which is only executed the first time a substituted root note is found be test 720, which causes test 835 to prevent the triggering of any bass note. Instead, test 835 directs the program to routine 825, which sets any bass note's CPN protect bit but does not trigger the note. This allows the new forced root note to sustain (not be damped) while preventing the new forced root note from being triggered twice (once by the Key Processing and Tab Input Routine 270 and once by the routine 840). Treble notes are sounded, however, since the FN flag is reset by routine 750, which is run after the bass notes in the current note code set have been processed. Since the FN flag is set only once, subsequent interrupts allow bass notes to be triggered even though the forced root note may still be sustaining.

Occasionally in a musical composition, after playing a new forced root note, the next note code set will have no bass notes from which to find a substituted root note. Occasionally also, the next note code set will be a rest, having no notes at all. In execution of the foregoing logic either of these two conditions would cause the forced root to be damped too soon. To prevent this, the Key Processing and Tab Input Routine 270 sets the forced root timer. This timer is decremented by routine 246 on every 48th note until it reaches 0. If test 630 determines that the forced root timer is not 0, then routine 635 calculates the root note code from the root stored in scratchpad RAM by the Key Processing and Tab Input Routine 270. The routine 270 then finds the root note code in CPN memory, where it has been stored by routine 270, and sets its protect bit, insuring that the note will not get damped during the current interrupt. Routine 640 then sets NPB2=1 to indicate that the forced root note is still sustaining. A typical value to which the forced root timer is set in the preferred embodiment is 12. This allows twelve 48th notes (or 1 quarter note) to occur before the forced root can be damped. In other words, the forced root note is held on for at least one quarter note.

After notes and damps have been communicated to processor M3 by routine 860, test 865 determines if NPB2 is set. If the NPB2 flag is not set, the forced root timer has reached 0, and the substituted root note has not been found during the current interrupt. It is now time to end the forced root note (which has already been damped, because its protect bit was not set during the current interrupt). Routine 870 resets NPB and NPB1 to indicate the end of the forced root note. The NPB2 flag is always reset by routine 875 after routine 870. This is to ensure that if NPB2 is set when the test 865 is encountered, it was set by the current interrupt and indicates that the forced root note is still sustaining, either because of the substituted root note having been found in the current note code set, or because the forced root timer has not yet been decremented to 0.

The forced root note feature operates similarly in the Funchords mode of the present invention. The only difference from its operation in the One Finger Chord mode is the method in which the forced note is initiated. Because the new root note (to be the forced root note) is not identified until after the FCHD timer has been decremented to 1 and the Chord Recognition Routine 284 is processed, the forced root note process is not initiated until the end of the Chord Recognition Routine 284. A flag called AA (added accompaniment) is set by the Key Processing and Tab Input Routine 270 every time a key is first played in the automatic range in the Funchords mode. Towards the end of the Chord Recognition Routine 284, the newly calculated root is compared with the old root. If the two roots are the same or if AA=0, the routine does not initiate a forced bass note. This is because it is musically desirable for the forced root note to sound only if a note has been added that causes a new root to play. For example, if a C chord is being played and a 7th note is added to form a C7th chord, it would be undesirable to hear a forced bass note at that time.

If AA=1 and the root has changed, the Chord Recognition Routine 284 resets AA, sets NPB, resets NPB1 and NPB2, sets the forced root timer, calculates accompaniment volume from the position of potentiometer 210 and the volume table (using an accent of 5), and stores the newly-calculated root note along with the volume for communication to processor M3. The program then returns to the end of Key Processing and Tab Input Routine 270, where the forced root note is sent to processor M3. From this point on, the Automatic Note Processing Routine 262 handles the forced root note exactly as it did for the One Finger Chord mode.

(10) Staccato Feature

The staccato feature operates in either of the two automatic modes to provide a more crisp sound to the automatic styles in the preferred embodiment. When the staccato feature has been selected, the instrument operates as described above except that when in the One Finger Chord or Funchords modes, all notes in the CPN memory are damped at the end of each execution of the Control Logic and FEC Update Routine 246. Since the CPN memory contains all notes that have been played by the automatic styles but have not yet been damped, the effect of this is that all automatic notes that are keyed are damped on the following 48th note. The notes are also removed from the CPN memory at the time they are damped. This provides variety in the music in that it contrasts with the normal mode of the styles in which notes are sustained for relatively longer periods of time.

As this effect is used to provide variety in the music, it is desirable for the player to initiate or discontinue operation of this feature without having to press extra switches, thus causing undue confusion in operating the instrument. In one embodiment, for example, the switch controlling the staccato feature is placed on a foot pedal. This allows selection of the feature when desired, however, operation of the foot pedal may seem cumbersone to some inexperienced players.

In the preferred embodiment, the staccato feature is combined with a memory feature. When the memory feature is selected, the style continues to play when the palyer lifts his hand from the keyboard while an automatic style is being played. The memory feature can be selected by a pushbutton switch, for example. The logic to provide the memory feature is contained in the Control Logic and FEC Update Routine 246. Whenever the memory feature is selected, routine 246 sets a bit (MEM) in a register in scratchpad RAM of processor M2. In either of the two automatic modes, a KD (key down) flag is set by the Key Processing and Tab Input Routine 270 whenever and key in the automatic range is depressed. Conversely, when all keys have been released, the KD flag is reset. When the Control Logic Routine 246 interrogates this flag while a style is running and discovers that the flag has been reset, it then looks at the MEM bit. If MEM is 0, then the Control Logic Routine 246 proceeds to stop the automatic pattern and reset the FEC counter to wait for key(s) to be played. If MEM is set to 1, however, the Control Logic Routine 246 continues the automatic style by not resetting the patterns. This is possible because the root information has been stored in scratchpad RAM so that releasing keys does not destroy information necessary for continuing the pattern.

If the staccato and memory features have been selected, however, the Control Logic Routine 246 examines the bit that is set by selecting the staccato feature when the routine determines that KD=O MEM=1. If this bit is set, the program examines each byte of the CPN memory, and stores each non-zero byte in RAM with its damp bit set for communication to processor M3. It then sets all CPN bytes to 0 and initiates a communication with processor M3 to send the notes to processor M3, which then damps the notes. In this manner, the player has easy control over the staccato feature, because he need only lift his left hand from the keyboard to obtain the effect. Depressing a key (or keys in Funchords) will discontinue the staccato feature to provide longer sustains on automatic notes. In the preferred embodiment of this instrument, selection of the staccato feature automatically turns on the memory feature, lighting both the staccato and memory indicator lights. This logic is performed by the Tab Calculations Routine 282. (11) Bottom Octave Chord The lowest 15 notes on the keyboard, which are to the left of the automatic notes on the keyboard, are used for ending the music in the present invention. Whenever the automatic pattern is operating and one of these notes is depressed, the pattern stops playing, all automatic notes are damped, the FEC is reset, and a chord is played. The name of the chord is the same as the name of the key that was depressed. If a minor chord is desired for the ending chord, then the minor touch strip is depressed to cause the minor chord to sound. Each bottom octave contains a bass note of the root played and a triad chord several octaves up the keyboard.

In FIG. 5, tests 430 and 435 decide whether either automatic mode is selected and whether the new key is to the left of the standard piano range. If so, test 445 determines whether the newly-played (or released) key is below the automatic range. If so, the key is in the bottom octave chord range, and the program branches to the ENDO routine 450 to process the note.

When the ENDO routine 450 begins, the key information from one of the FIFO's 205 is already stored in register R0. If the key is not a damp (i.e., if bit 7 of RO is not set), then the amplitude is loaded from the FIFO's 205 and stored in the scratchpad RAM of processor M3. The FIFO's 205 are then clocked to remove the amplitude information from their outputs. A flag called END in scratchpad RAM is then set to indicate to various other routines in the program that the bottom octave chord is playing.

Next, all bytes in the CPN memory are examined, and damps are stored for each non-zero byte in external memory for communication to processor M3. All CPN bytes are then set to 0. Next a register, R4 for example, is set equal to four to count the number of notes to be played ending chord routine, and the data counter of processor M3 is set to the address of a table that contains the offsets from the root in RO that represent the four notes of the chord to be played. A loop is then run four times (counted by the above register R4) to calculate the four notes to be output, each time subtracting the byte addressed by the data counter (which gets incremented on each loop) from the note in RO to determine the desired note of the chord. Each note is loaded into the CPN memory to keep track of which notes are being output, and each note is stored (with the above-mentioned amplitude stored after each note) in external memory for communication to processor M3. When register R4 reaches the count that addresses the major third interval of the chord, the MIN bit is checked. If it is set, then the note chord to be output is incremented to cause it to be a minor 3rd and, hence, form a minor chord. For example, suppose the table programmed into processor M3 is 00, 36, 40, 43 (decimal) and the root ntoe in R9 is equal to 72 (decimal), the note code for C2. Then, on the first loop, the calculated note code would be 72−0=72. O n the second loop, the code would be 72−36=36. The third and fourth loops would give 72−40=32 and 72−43=29. The resulting codes are 72, 36, 32, and 29 for the notes C2, C5, E5, and G9, forming a C major chord with a C bass note. When R4=2, processor M3 will have checked the MIN bit. If it has been set, the code 32 above would have been raised to 33, causing the E5 to become an Eb5 to form a minor chord.

After these notes have been calculated and stored along with any notes that the ENDO routine has determined should be damped, they are communicated to processor M3 for triggering and damping.

Because the END flag has been set, the control logic routine 246 resets the FEC counter and stops the automatic pattern.

As long as the bottom octave chord note is held, the notes will sustain. As soon as the note is released, however, test 445 will again branch to the ENDO routine 450. If this routine finds bit 7 of RO set, then it resets the END flag to indicate that the bottom octave chord mode is over. It then stores damps for all CPN bytes (which are at this point the notes that comprised the bottom octave chord) in RAM for communication to processor M3 and sets all CPN bytes to 0. Communications are then initiated to damp the most recently determined bottom octave chord notes, and the routine returns to the Key Processing and Tab Input Routine 270. A new key must be played to start the automatic styles playing again. If test 445 determines that the newly-struck key is in the automatic range, test 445 checks to see if the instrument is in the Funchords mode. If so, program control branches to 465 to process funchord notes, which is discussed below. If not, the program branches to 460 to process one Finger Chord information.

(12) Right Hand Fill-In Features

(a) Arpeggio

When either of the automatic modes is operating and the player touches the arpeggio touch strip 238, which can be a metallic bar located under the keyboard on the front of the instrument, additional patterns are played by the instrument. These patterns, which are added to the currently-playing automatic style, are called arpeggios. Each arpeggio pattern lasts as long as the player touches the arpeggio strip, and will stop (leaving the original style running) as soon as the player stops touching the arpeggio strip. Like the styles, each arpeggio is a two-measure pattern. However, there are fewer arpeggio patterns on the instrument than there are styles. Although it would be possible to include a separate arpeggio for each style, in the interest of conserving memory, it is more practical to limit the number of arpeggios. This means that several styles must share single arpeggio.

The processing of arpeggios is handled entirely by processor M3, which is responsible for reading the arpeggio touch strip. After processor M2 communicates a table address to processor M3 in routine 525 (see FIG. 6), processor M3 first looks up the appropriate note code set. It then checks the arpeggio strip. If the arpeggio strip is being touched, processor M3 uses the table address to determine which arpeggio pattern is to be played. Processor M3 then locates the appropriate note code set within the arpeggio pattern and adds it to the note code set for the selected style. To add the two note codes together, processor M3 determines the number of arpeggio notes in the arpeggio note code set (from the second byte of the arpeggio note code set), adds this number to the right nibble of the second byte of the style hote code set (which contains the total number of offsets in the style note code set), and then includes to the right of the style note code set all offsets contained in the arpeggio note code set. For example, if the style note set is (in hexadecimal) equal to OC 13 00 18 28 2C, and the arpeggio note code set is 04 02 00 48 4C, then the added or composite note code set that will get communicated back to processor M2 is 15 00 18 28 2C 48 4C. The 15 indicates one bass note and five treble notes (the sum of three style notes and two arpeggio notes). The five offsets are 18 28 2C (the style offsets) and 48 4C (the arpeggio offsets). After these bytes are communicated back to processor M2 in routine 540, processor M2 processes all notes as if they were style offsets without differentiating the arpeggio notes. See the above description of the communication of the offsets.

It is possible that the style note code set will coincide with the current FEC count (as represented by communication of R2 to processor M3 in routine 525) and that the arpeggio note code set does not coincide with it, or vice versa. In this case processor M3 sends only the note code set that coincides with the FEC count. In the above description, there is no control of the accent level of arpeggio notes. If the style treble notes are accented, then the arpeggio notes are accented. This allows the arpeggio notes to be accented along with the current style. In another embodiment, arpeggio notes can be accented independently, by using another data byte which is communicated from processor M3 to processor M2 to indicate their accent levels.

(b) Pro Harmony

In either of the two automatic modes, One Finger Chord or Funchords, whenever the pro harmony feature is selected and a right hand note (i.e., a note to the right of the automatic range of notes on the keyboard) is played, a fill-in harmony of notes is played along with the right hand note. These notes are the notes of the chord played (a triad of the root note in One Finger Chord mode or the actual keys depressed in the Funchords mode) but sounded in the octave below the right hand note. The exception to this is that the note that is one semitone below the played treble note will not play, because it would cause a musical dissonance with the played note. The operation of the pro harmony feature of the instrument is almost identical to that described in the U.S. patent application entitled "Harmony Genertor for Electronic Organ, " filed June 11, 1980 by Simmons, serial no. 158,585 and now U.S. Pat. No. 4,387,618. In the present instrument, however, the volume of the harmony notes is controlled differently.

Referring to FIG. 4, when the Key Processing and Tab Input Routine 270 receives a new treble note to be stored for output, this routine, in addition to storing the key's amplitude for communications, also stores the amplitude in a register called PAMP (pro amplitude). When the test 272 determines that a treble note has been played and that one of the automatic modes is operating and that the pro harmony pushbutton is selected, then the pro harmony routine 274 is processed by processor M2. This routine calculates all harmony notes and stores them for communications. It also calculates a volume for these notes that is somewhat lower than the volume of the treble note that was just processed by the key processing routine 270. To accomplish this, the PAMP register contents are stored in the accumulator of processor M2, shifted right 1 and stored in a register, register R2 for example. The value of R2 is now half the value of PAMP. The accumulator is shifted right once more (leaving the accumulator with one quarter of the value of PAMP), and then R2 is added to the accumulator. The accumulator now contains a value that is (0.5+0.25) or 75% of the value of the recently struck treble note (PAMP).This value is stored along with all pro notes for communication to processor M3. This allows the harmonized notes to play at a lower volume than the played treble note (in this case, 75% of the treble note volume) so that the treble note is distinguished as the melody note, and the harmony notes sound like accompaniment notes. By similar manipulations of the PAMP amplitude, it is possible in other embodiments to raise or lower the relative volume of the pro harmony notes thereby providing dynamic harmony adjustment.

(c) Coupler

A third right hand fill-in effect is obtained when the coupler feature is selected. Unlike pro harmony, this feature operates in all three modes of the instrument (Standard Piano, One Finger Chord, and Funchords). When selected, this feature allows the playing of a note or notes one or more octaves above the treble note that is actually played. In the preferred embodiment, the coupler feature causes a note to play two octaves higher than the note that is actually struck, causing both notes to sound. This feature is used for variation in the sound of the instrument, and it allows the player to make sounds that normally could not be created by automatically producing a two-octave reach. In order for the coupled note (e.g., the note that is two octaves higher than the struck note) not to overpower the struck note, the volume of the coupled note is reduced, in the same manner as the volume of the pro harmony notes is reduced, as described above.

Whenever a new key is struck when in the Standard Piano mode or when a key is struck to the right of the automatic range when in either automatic mode, the Key Processing and Tab Input Routine 270 checks to see if the coupler feature has been selected. If it has, after storing the key and its amplitude for subsequent communication to processor M3, the number 24 is subtracted from the key's note code to obtain the new note of the key that is two octaves higher, and the new note code is also stored for communication. Then the reduced amplitude of the key is calculated (as described above in connection with the pro harmony feature), and it also is stored for communication. If the note is in the next highest octave on the instrument, then the number 12 is subtracted from the key instead of 24 to raise the key one octave (because there are no electronic keying circuits to sound keys that are higher than the highest octave). The coupler features does not function at all for notes played in the highest octave of the piano.

(13) Manual Advance

The manual advance feature of the present invention allows a player to play automatic accompaniments without having to keep to the tempo that is generated by the instrument. Either a 4/4 manual advance pattern of a 3/4 manual advance pattern can be selected. One of two separate styles is selected when either of the two manual advance patterns is selected. These two styles are the 4/4 manual advance and the 3/4 manual advance, and they are distinct from all the other automatic styles. They are programmed so that all notes fall on a quarter note time slot. Instead of these styles advancing automatically at the selected tempo rate, as do all the other styles in the present invention, these styles only advance to and play the next quarter note when the player plays a new note (or a new chord when in the Funchords mode). This allows the player to play a piece of music at his own tempo, which he may vary depending on how often he plays new keys. If the first measure of the 4/4 manual advance pattern begins with a root bass, then a root chord, then a 5th bass, then a root chord, for example, then, when the player (in the One Finger Chord mode) first plays a C note, he will hear a C bass note, and the display 218 will display beat 1 in the left digit. Lifting his hand and then pressing the C again would cause a C chord to play and beat 2 to be displayed on the second digit from the left of the display 218. Lifting the hand again and then pressing the C again would cause a G (5th interval of C) to play and beat 3 to appear on the third from the left digit on the display 218. Lifting the hand again and pressing C once more would cause a C chord to play and beat 4 to appear on the right digit of the display 218. Operation is similar in the Funchords mode, except that a whole chord must be played repeatedly to cause the style to advance. In either the One Finger Chord or Funchords modes, when a manual advance pattern is selected, no forced bass root is inserted.

The method in which the manual advance feature is implemented is illustrated in FIG. 6. Test 491 checks to see if either of the two manual advance modes has been selected (by ORing together the 4/4 and 3/4 manual advance bits). If so, then test 492 checks to see if the manual advance flag (MAF) has been set. This flag is set by the Key Processing and Tab Input Routine 270 in the One Finger Chord mode whenever a key is played in the automtic key range. In the Funchords mode, this flag is set by the Chord Recognition Routine 284 whenever this routine is re-executed because a new key was added. If test 492 determines that the MAF flag is not set, then the program jumps back to the automatic Key Processing and Tab Input Routine 270 (from destination block 520) and does not process any automatic notes. Because the FEC is not updated in this case, the display 218 continues to display whatever beat it was displaying. If the MAF flag is set, test 491 branches the program to routine 493, which updates the FEC counter to the next quarter note (not the next 48th note as does routine 495 when manual advance is not selected). To update the FEC to the next quarter note, the right nibble of the FEC is set to 0, and the left nibble is incremented. Routine 494 then sets the MAF flag to 0 to clear it for the next time a key is played. Routine 496 then sets the variation number to zero. Test 497 determines whether the 3/4 manual advance pattern is selected. If so, the table address (within processor M3) for the 3/4 manual advance pattern is stored for communication by routine 498. If not, the table address for the 4/4 manual advance table is stored for communication by routine 499. The program then branches to routine 510, which determines the number of 48th notes played since the start of the pattern, and the program operates as it did in the automatic mode from here on, outputting the note code set for the current FEC count of the appropriate manual advance pattern. After these notes have been output, the FEC will not be advanced and no more manual advance notes will be played until another key is played (or chord in the Funchords mode), again causing the MAF flag to be set.

The 3/4 mode can be selected by a 3/4 manual advance pushbutton switch, or by one of the automatic styles, such as the waltz. All styles are written as if they were 4/4 patterns, including the 3/4 styles (in the latter case, the fourth best of each measure is merely a rest). When either routine 495 or 493 updates the FEC counter, each routine first checks to see if a 3/4 style is selected (routine 495 checks to see if any of the styles that have been designated 3/4 have been selected, and routine 493 checks to see if the 3/4 manual advance switch is on). If so, and the FEC is about to get updated to beat four of either measure one or two, then the FEC is actually updated to bat one of measure two (if the FEC was about to be updated to bat four of measure one) or to bet one of measure one (if the FEC was about to be updated to bat four of measure two). This causes the FEC counter to count from 1 to 3 and repeat instead of from 1 to 4 and repeat, and, in the process, does not play beat four of either measure, thus creating the 3/4 timing.

E. Processor M3

(1) M3 Functions

Processor M3 performs all output functions to the instrument's hardware necessary for the keying and damping of all piano gates 222, the latching of the latches 208 that control the lights in all lighted pushbutton switches (tabs) 207, and the latching of the information to control the 4-digit, 7-segment LED display 218.

Processor M3 also communicates with processor M2 to exchange information necessary for outputting all of its information.

The majority of the ROM in processor M3 is used as a set of tables in which are stored all the informationfor the various automatic styles and for the arpeggios.

Processor M3 also reads various peripheral circuits to calculate information that is to be sent to processor M2. These peripheral circuits include the tempo potentiometer 211, the volume potentiometer 210, arpeggio touch strip 217 and minor touch strip 215, and the sustain pedal (not shown).

(2) Processing of Piano Gate Circuits

One of the main tasks that processor M3 performs is to control the gate circuits 222 that key on and damp off the frequencies of the instrument to play, sustain, and damp the piano tones. Before describing the general flowchart of processor M3's main program, the operation of the piano gating will be described in detail.

With reference to FIGS. 2 and 3*a–e*, the signal for any gate 222 is output on port O of processor M3 to D/A convertor 320. The analog signal at output 301 is directed to the correct sample capacitor 320 by analog multiplex circuit 302. The address for analog multiplex circuit 302 is output on bits 4, 5, and 6, of port 1 of processor M3. The enable for analog multiplex circuit 302 is decoded by dual 4-bit decoders 305 and 307 from address bits 0, 1, 2, and 3, and enable bit 7 of port 1 of processor M3. D/A convertor 300 and analog multiplex circuit 302 have an active range of from 0 to 15 volts. When an output is required, the digital amplitude data is output on port O M3. The required address is then output on port 1 of processor M3 with enable bit 7 high. The enable bit 7 initially is left high to prevent a glitch address from being enabled. Subsequently, the same address is then output with enable bit 7 low. Sample capacitor 320 is allowed to charge from output 301 through analog multiplex circuit 302 for about 100 microseconds (about five time constants for a typical analog multiplex circuit and about three time constants for a limit device, i.e., a device with the maximum deviation within tolerance). For reasons explained hereinafter, the voltage output to the sample capacitor 320 is higher than the voltage required by the gate sustain capacitor C12. The operation of the gate sustain capacitor in the present invention is similar to the operation of the gate sustain capacitor described in U.S. Pat. No. 4,248,123—Bunger and Uetrecht, issued Feb. 3, 1981, which is assigned to the same assignee as the present invention. Operational amplifier (op amp) 322 is connected to function as a unity gain amplifier by connecting the output to the negative input. The gate sustain capacitor C12 (typically 4.7 microfarads) is charged via diode 326 and attack control resistor 327 (typically 470 ohms). Op amp 322 can be a commercially available type LM 324 which has a maximum input bias current of −250 nanoamps. While the gate sustain capacitor is being charged, feedback resistor 323 and damp resistor 325 (typically 127 K ohms) discharge sample capacitor 320. The initial discharge rate is: delta V/delta T=I/C=0.6 volts / (127 K ohms x 0.047 microfarads)=0.2 volt/millisecond. This causes a small loss of charge from the sample capacitor 320 during the charging of the sustain capacitor C12. Most of the discharge of the sample capacitor 320 during the charging cycle of the sustain capacitor C12 could be eliminated by resampling after two time constants (about 5 ms.). However this discharge is necessary to allow the sustain capacitor to discharge during normal sustain cycle. This allows an initial discharge rate of 500 microamps, or 30 K ohms at 15 volts, on the sustain capacitor C12. If the sustain capacitor C12 discharges at a slower rate the voltage across resistors 323 and 324 decreases below 0.6 volts (one diode drop), and the sample capacitor voltage follows the sustain capacitor C12 voltage.

When a key is released and it is required that the sustain capacitor C12 be damped, 0 volts is input to sample capacitor 320 in the same manner as above. The sustain capacitor C12 discharges toward ground via resistors 324 and 327 and diode 325. However, the resistor 323 causes sample capacitor 320 to recharge at about 0.13 volts per millisecond. Since the damp time constant is about 125 milliseconds, it is necessary to repeatedly discharge sample capacitor 320 to 0 volts to complete the discharge of the sustain capacitor C12. Since it is necessary to repeatedly discharge the sample capacitor it is only necessary to hold the sample voltage for 50 microseconds and all 88 sample capacitors 320 can be updated every 4.4 milliseconds. When the sustain capacitor voltage discharges to about 1.25 diode drops, the voltage across diode 325 decreases and the final discharge is through resistors 327, 324, and 323 directly to the sample capacitors 320. When the sustain capacitor C12 is fully discharged, to refresh sample capacitor 320 requires only that the charge accumulated from the input bias current to the op amp 322 be discharged.

Although it would be possible to update the 88 sample capacitors 320 every 4.4 milliseconds, it is not necessary to update them constantly. For example, if an external interrupt program were to be executed while the instrument was in the process of damping its sample capacitors 320, it would be permissible for the interrupt to last 10 to 20 milliseconds without interferring with the damp functions of the instrument, as long as processor M3 re-commenced its damping operations on the sample capacitors 320 at the conclusion of the interrupt routine.

(3) Program Operation for Processor M3

In describing the operations of processor M3, reference will be made to FIG. 9, the system flowchart for this device. The main program for processor M3 begins at test 960, which reads the sustain pedal to determine if it is on. This pedal is the right one of the two pedals located in front of the instrument near the bottom, and it functions similarly to the sustain pedal on a regular (i.e., acoustical) piano.

A section in the scratchpad RAM is devoted to storing information concerning the damping conditions of all 88 keys of the instrument. Each key has two bits associated with it; they reside in adjacent bytes within this section (which will be referred to as KEYMEM), and they both have the same bit number. The two bits for any individual key will be referred to as bit A (for the RAM byte of lower address) and bit B (for the RAM byte of higher address). Since KEYMEM must store two bits for each key, it occupies $88\times2/8=22$ bytes of memory. When a gate is turned on, both A and B bits are set to 1. When the key is turned off, or damped, if the sustain pedal is not on, both bits are reset to 0; if the sustain pedal is on, then only the A bit is reset. This provides the information that the key has been released, but that it is not yet time to damp the key, because the sustain pedal is still on.

If the sustain pedal is not on, test 960 branches to routine 970, which begins the damping of all notes with A bits $=0$. This routine sequentially scans all bytes of the KEYMEM and damps each key with its A bit set to zero for a period of approximately 50 microseconds, as discussed above. In 975 all the B bits are reset to 0 at this time. If test 970 determines that the sustain pedal was pressed, then routine 965 is processed. This applies the 50 microsecond damps for only those keys whose B bits are set to 0. If a key had been played (setting its A and B to 1), and then the sustain pedal pressed, and then the key was released (setting its A bit$=$0, but its B bit was still equal to 1), the damp routine 965 will not damp this key, because its B bit was set. However, if another key had not been played or if it had been released while the sustain pedal was not on, then its $A=0$ and $B=0$. This second key would be damped by routine 965. In this manner, the keys that should be damped because their keyers must keep charged off will get damped; the keys that should be sustained will stay sustained. It is important that the A bit in the first of the two keys in the above example is reset to 0, because that is the only indication that the key has been released. This is because processor M2 sends only one damp to processor M3 when a key is released.

After damping operations have been completed, and this may require approximately 5 milliseconds, routine 980 outputs data to latch all the information for the lighted pushbuttons. The state of each pushbutton has been stored in processor M3's RAM by previous communications with processor M2. Outputting to the latches 208 is accomplished by placing the desired address on bits 0, 1, and 2 of port 0 of processor M3 and the data is placed on bits 4, 5, and 6 of the same port. The latches are then enabled by output Q3 of decoder 307*d* which is set by bits 0, 1, 2, 3, and 7 of port 1 of processor M3.

After latching in the status of the pushbuttons 206, the main program of the processor M3 branches to test 960 again, where the damping process is repeated.

At any time, the above main program may be interrupted by processor M2's sending an interrupt signal to the interrupt pin of processor M3. When this happens, a communication between processors M2 and M3 will take place similar to the type of communications described in the above-referenced patent application entitled "System for Communicating Data Among Microcomputers in an Electronic Musical Instrument," filed June 8, 1981 by Jones, Serial No. 271,133 and now U.S. Pat. No. 4,412,470. The first byte that is communicated from processors M2 to M3 contains a code that tells processor M3 which of the three possible types of communications is about to take place.

General communications is the only event that takes place on a regular basis, and this occurs every 5.2 milliseconds. This is because it is initiated within the routine 238 (FIG. 4) on every interrupt by processor M2. All information concerning the status of the lighted pushbuttons is received and stored in processor M3 RAM by routine 995, and routine 1000 receives and stores in RAM the information for lighting the LED display 218. Routines 1005 and 1010 send the tempo potentiometer 211 reading, the volume potentiometer 210 reading, and minor touch strip 215 status to processor M2. Communications now being over, processor M3 reads either the tempo potentiometer 211 or the volume potentiometer 210 (alternatively each is read on alternate general interrupts), and calculates their value as "Tempo Measurement, Display, and Control System for an Electronic Musical Instrument," filed June 15, 1981 by Jones, Serial No. 273,788 now U.S. Pat. No. 4,361,066. Routine 1015 then reads the minor touch strip 215 and arpeggio touch strip 217 and stores their status in RAM. The method of reading these two touch strips is described in U.S. Pat. No. 4,156,379 entitled "Digital Arpeggio System," issued May 29, 1979 and U.S. Pat. No. 4,176,575 entitled "Improved Touch Operated Capacitance Switch Circuit," issued Dec. 4, 1979. The data for the LED display 218 is then output by routine 1017. It is important to output the LED display data during the general interrupt routine, because the multiplexing system requires an even duty cycle, which is found in general communications. The method of LED display can be the same as described in the above-referenced "Tempo Measurement, Display, and Control System" patent application. The interrupt routine then branches to destination block 1020 to return to the main program.

If tests 990 and 1025 determine that the first byte of communications contain the code for processing key information, then test 1025 branches the program to routine 1075, which sequentially receives all the key information. This information may cause keys to be damped or keys to be output or both. A damped key will be one byte containing the key's note code with bit 7 set. A note to be triggered will be represented by two bytes, the first being the key's note code (with bit 7=0), and the second being the amplitude of the key. After these keys are received and stored in RAM, processor M3 then proceeds to output the keys to be output and adjust the KEYMEM for keys to be damped (no damping is actually performed during the interrupt, because it is all done in the main program). In 1080 all keys to be output are output to the gates as described above, and their A and B bits are both set to 1. Then, if the sustain pedal is not on, as determined by test 1085, routine 1090 will reset to 0 all A and B bits of each key to be damped in the KEYMEM memory. If the sustain pedal is on, then only the A bits of the keys to be damped in routine 1100. After processing the key information, the program branches to destination block 1020 to return to the main program.

If test 1025 had determined that the interrupt was a request for information, then processor M3 inputs the three bytes containing the address of the table to be searched and the number of 48th note counts that have occurred since the beginning of the first beat of the pattern. If test 1030 determines that the 48th note count is coincident with one of the note codes in the pattern, then the note code set is looked up and stored by routine 1035 in an area of RAM called TAS (table address storage). If no note code set is coincident with the 48th note count, then the first byte of TAS is set to 0 by routine 1040, and the program branches to test 1045. This test checks to see if the arpeggio touch strip is pressed (processor M3 reads the bar and stores its status in a bit in RAM). If not, the program branches to routine 1070. If so, processor M3 must determine the appropriate arpeggio table from the table address that was just communicated to processor M3 in test 1030. Based on this address and a lookup table that stores the correct arpeggio address for each table address, the address of the start of the arpeggio table is located. At this point, processor M3 determines if there is a note code set within the table that is coincident with the 48th note count that was just communicated to processor M3. If test 1050 determines that no note code set is coincident, then the program branches to routine 1070. If there is a coincident note code set, test 1055 checks the first byte of TAS to see if there is also a coincident style table address (as determined by test 1030). If so, in 1065 the style note code set is combined with the arpeggio note code set, as described above in connection with processor M2. If not, then in 1060 TAS is loaded with the bytes of the arpeggio note code set, and the program branches to routine 1070, where the assembled note code set is communicated to processor M2. At that point, the interrupt routine is complete, and the program returns to the main program.

(4) Coincident Note Code Set

If a note code set is coincident with the current 48th note count, then it is the correct point in time for that note code set to be played. The 48th note count that is communicated from processor M2 to M3 is the number of 48th notes that have occurred since the beginning of the first 48th note of the pattern or style. Given the starting address of a given style table, processor M3 searches through the table, one note code set at a time, to determine if any note code set is coincident with the 48th note count.

For example, the first two note codes of a given style table will be designated to be (in hexadecimal): OC 12 00 20 30 06 11 00 20. Since the 2 in the second byte of the table represents the two notes in the first note code set, and since the third byte (00) contains accent information, then the 20 and 30 have to be two notes of the first note code set, and the 06 is the first byte of the second note code set. Suppose the 48th note count that is current is 0. Then the first beat of the first measure is called for, and the first note code set (beginning with OC) is the desired note code set. Suppose the 48th note count were, instead, equal to 12 (C in hex). This means that the second quarter note is ready to play, and the second note code group (beginning with 6) is the desired coincident note code set. Suppose instead that the 48th count is 6. This means that processor M3 should look for a note code set that should be played on the second 8th note of the first beat (or halfway through the first quarter note). Since there is no activity in this table between the first quarter note and 12 (as indicated by the OC in the first byte of the table), there is no activity on the 48th note count of 6, and therefore no note code set is coincident with the 48th note count.

In searching for a note code set that is coincident with the 48th note count, processor M3 first loads a register (R1, for example) with the 48th note count. (Note that if the 48th note count is 0, then the first note code set is the set that is coincident.) The data counter is then loaded with the address of the first byte of the table (OC in the example). The value of the byte addressed by the data counter (OC) is loaded in another register (R2 for example). The data counter (DC), which has incremented itself one by the act of loading the first byte of the table, is now addressing the second byte of the table (12). This byte is loaded (DC now points to third byte of the table), and its right nibble, which is the number of offset notes in the current note code set, is added to the DC. The DC now points to the last byte of the note code set, so it is incremented once more so that it addresses the next note code set. Now, the value in R2 above is subtracted from R1 and the result is stored in R1. With each note code set that is searched in this manner, the value of R1 is reduced. If the result in R1 is positive, then the search goes on to the next note code set. If the result is negative, then there is no coincident note code set. If the result in R1 is 0, however, the DC is pointing to the correct note code set, and the set is said to be coincident with the 48th note count.

In the first of the three examples above, since R1 would initially equal 0, processor M3 would determine that the first note code set was coincident and would load the DC with the first address of the table. In the second example, R1 would have been set to 12, and the DC would be advanced to address the second note code set, R2 having been set to OC (the first byte of the table). Subtracting R2 from R1 gives a zero result, so the processor M3 would determine that the note code set currently addressed by the DC is coincident with the 48th note count. In the third example, R1 would have been set to 6. When the DC moved to address the second note code set, R2 would have been set equal to 12. Since R1−R2 gives a negative value, processor M3 would determine that there is no coincident note code set.

While the preferred embodiment of the invention has been illustrated and described, it is to be understood that the invention is not limited to the precise construction herein disclosed, and the right is reserved to all changes and modifications combing within the scope of the invention as defined in the appended claims.

I claim:

1. In an electronic musical instrument having an array of playing keys, an automatic musical style pattern generator apparatus for generating sequential patterns of musical notes, said apparatus comprising:

style selector means for selecting one of a plurality of musical styles, each of the musical styles having a plurality of musical key, interval related variations;

memory means for storing a table of data for each of the musical styles;

tab scanning means for detecting whether a musical style has been selected;

key scanning means for detecting the playing of a key in the array of playing keys;

processor means for generating from the data in said memory means data corresponding to the notes of a variation, the notes being a function of both a key played, as detected by said key scanning means, and one of the plurality of variations of the musical style selected, as detected by said tab scanning means;

audio output means for generating and sounding the tones of the variation corresponding to the data generated by said processor means, whereby an automatic pattern of musical tones determined by said played key and said selected musical style commences upon the playing of a key.

2. The apparatus as claimed in claim 1 further comprising:

style expander selector means for selecting one of a plurality of style expanders, wherein said memory means also stores a table of data for each variation of each style, and wherein when one of the style expanders is selected said processor means generates data corresponding to the notes of one of the plurality of musical key, interval related variations of the style selected, said variation being the one that is identified by the musical interval between a key played and the key of the music determined by said style expander selector means.

3. The apparatus as claimed in claim 2 wherein the relationship between the style expander selected and a key played is predetermined so as to be musically appropriate for the musical key of the music being played on the array of playing keys.

4. The apparatus as claimed in claim 2 wherein seventh notes are generated when one of the style expanders is selected by said style expander selector means and the root note played on the array of playing keys is related to the style expander selected in a predetermined manner as determined by said processor means, whereby sevenths are generated in the automatic pattern only when they have a musically desirable relationship to the root note being played in the array of playing keys and to the key of the music being played as indicated by the style expander selected.

5. The apparatus as claimed in claim 1 or 2 wherein said array of playing keys is subdivided into at least two ranges, the playing keys of only one range being used for operation of said automatic musical style pattern generator, and individual playing keys of another range being used both to terminate said operation of said musical style pattern generator and to play a chord based upon the root note identified by playing one of said individual playing keys.

6. The apparatus as claimed in claim 1 further comprising:

a plurality of flag means, with one of said flag means corresponding to each one of predetermined note intervals within a combination of playing keys;

detecting means for detecting the combination of keys played among the plurality of playing keys, said detecting means setting a corresponding flag for each predetermined note interval which is being played;

wherein said processor means alters the data from the table of data in said memory means according to which of the flag means are set to generate notes of a variation, whereby the variations sounded by said audio means contain notes corresponding to data not stored in the table of data in said memory means.

7. The apparatus as claimed in claim 1 wherein each musical style includes a plurality of time slots during which notes are generated and wherein the table of data stored in said memory means for each of the musical styles includes automatic note code sets containing offset values for each time slot of each musical style and wherein said processor means generates a set of data for each time slot corresponding to notes for each of the offset values, each of which is offset from a reference note a number of semitones equal to the corresponding offset value.

8. The apparatus as claimed in claim 7 wherein each of said automatic note code sets further comprises data to determine the duration of the notes to be generated by said processor means form said automatic note code set, data corresponding to the number of notes and the number of bass notes specified by said automatic note code set, and data for accenting predetermined notes to be generated by said processor means from said automatic note code set, and wherein said audio output means generates and sounds tones corresponding to notes determined by said processor means from said automatic note code set, each tone being sounded for the duration and with the amount of accent determined by said processor means from said automatic note code set.

9. The apparatus as claimed in claim 7 wherein said automatic note code set further comprises accent values wherein the set of data generated by said processor means for each time slot contains an accent value for the notes corresponding to the offset values, wherein said processor means provides a volume control signal corresponding to the associated accent value for each note, and wherein said audio output means for generating the musical tone corresponding to each note sounds each tone at a volume controlled by the corresponding volume control signal, whereby each tone is sounded at a higher or lower volume relative to the other tones sounded according to the corresponding accent value in said note code set.

10. The apparatus as claimed in claim 1 further comprising:

staccato selector means for selecting a staccato musical mode, wherein said tab scanning means detects whether the staccato musical mode has been selected, wherein when the staccato musical mode has been selected said processor means also generates damp data corresponding to the notes of the variation, and wherein responsive to the damp data said audio output means damps the tones of the variation of the automatic pattern being sounded.

11. The apparatus as claimed in claim 10 further comprising:

memory mode selector means for selecting a memory mode, wherein said tab scanning means detects whether the memory mode has been selected , wherein when the memory mode has been selected said processor means continues to generate data corresponding to the notes of a variation after the key played is released, and wherein said audio output means thereby continues to generate and sound the tones of the variation corresponding to the data generated by said processor means.

12. The apparatus as claimed in claim 11 wherein when the staccato mode is selected by said staccato selector means the memory mode is automatically selected by said staccato selector means, said processor means continues after the key played is released to generate data corresponding to the notes of a variation and damp data corresponding to the notes of a variation, whereby the staccato mode is obtained by releasing a key played and the staccato mode is discontinued by depressing a key.

13. The apparatus as claimed in claim 9 further comprising volume control means having a volume potentiometer for providing an amplitude value related to the setting of said potentiometer wherein the volume control signal provided by said processor means for each note is obtained by summing the corresponding accent value and the amplitude value for said volume potentiometer.

14. The apparatus as claimed in claim 1 further comprising manual advance selector means wherein when manual advance is selected and a predetermined style is selected by said style selector means, said processor means generates data corresponding to the note of the key played when the key is played and said audio output means sounds the tones of a beat of the musical style after the playing of the key, whereby the musical style only advances to and plays the next note when the player plays a new key.

15. The apparatus as claimed in claim 1 wherein the data generated by said processor means also includes damp data corresponding to each tone being sounded which is to be dampedby said audio output means and trigger data corresponding to each tone to be generated and sounded by said audio output means.

16. The apparatus as claimed in claim 15 further comprising treble note protection means for preventing said audio output means from damping a tone corresponding to a key being played within a predetermined range in the array of playing keys.

17. The apparatus as claimed in claim 16 wherein said treble note protection means further comprises treble note protect register means for storing a data bit corresponding to each key in the predetermined range of keys in the array of playing keys, each of said data bits being set to a first state if the corresponding key is being played, each of said data bits being set to a second state if the corresponding key is not being played and wherein said processor means deletes damp data corresponding to the tone of each key for which the corresponding data bit stored in said treble note protect register means is in the first state.

18. The apparatus as claimed in claim 17 wherein said processor means sets the data bit stored in said treble note protect register means corresponding to each key within the predetermined range of keys to a second state a predetermined period of time after the playing of the key, whereby the damping of keys being played within the predetermined range of keys is not inhibited by said treble note protection means after the predetermined period of time.

19. The apparatus as claimed in claim 17 further comprising:

a plurality of gating means for controlling said audio output means said audio output means having a tone generator controlled by each one of said gating means;

digital to analog converter means for converting the damp data and the trigger data to corresponding analog trigger and discharge signals; and a plurality of analog multiplexer means for receiving sequentially the analog trigger and discharge signals from said digital to analog converter means and sequentially applying the analog trigger and discharge signals to corresponding ones of said gating means, whereby said gating means causes tones to be sounded from the tone generators associated with the gating means to which trigger signals are applied and said gating means causes tones to be damped from the tone generators associated with the gating means to which discharge signals are applied.

20. The apparatus as claimed in claim 19 wherein said memory means stores a table of data for each time slot of each of the musical styles and wherein the data generated by said processor means corresponding to the notes to be sounded is also related to the data stored in said memory means for each time slot of the musical style which said tab scanning means detects has been selected.

21. The apparatus as claimed in claim 20 further comprising staccato selector means for selecting a staccato musical mode wherein when the staccato musical mode is selected said processor means generates damp data corresponding to each note sounded during the preceding time slot thereby causing said digital to analog converter means to convert the damp data to discharge signals which cause said gating means to damp the tones which were triggered by said tone generator means during the preceding time slot.

22. The apparatus as claimed in claim 19 wherein the sounding of each of said tone generators to which a trigger signal has been applied continues with a long sustain envelope unless a subsequent trigger signal or discharge signal is applied to the associated one of said gating means.

23. The apparatus as claimed in claim 19 wherein each of said tone generators is periodically damped by the application of a discharge signal.

24. In an electronic musical instrument having a plurality of playing keys, each of which corresponds to a musical note, an apparatus for identifying the chord type and root note, the chord type and root note corresponding to notes which have been selected by playing a plurality of the playing keys, said apparatus comprising:

detecting means for detecting whether or not each of the playing keys among the plurality of playing keys is being played;

first memory means for storing bits corresponding to each note detected by said detecting means as being played;

second memory means for storing a bit for each of an octave of notes, each bit being set that corresponds to chromatically identical notes detected by said detecting means as being played;

processor means for determining from the bits stored in said first memory means the lowest note played and transposing the bits stored in said second memory means a number of times sufficient to place the bit corresponding to the lowest note played in a predetermined bit position in said second memory means, said processor means then setting a minor 3rd-minor 5th flag bit when both a minor 3rd note and a minor 5th note are played as determined by said processor means from the bits which are set and their positions in said second memory means, said processor means setting a 5th sharp flag bit when a minor 3rd note is not played and a 5th sharp note is played as determined by said processor means from the bits which are set and their positions in said second memory means.

25. The apparatus as claimed in claim 24 further comprising:

automatic pattern memory means for storing data corresponding to an automatic pattern of notes;

automatic pattern control means for producing an automatic pattern of notes according to the data stored in said first memory means and the notes stored in said automatic pattern memory means; and wherein said processor means determines the relationship between the data stored in said first memory means and the data stored in said automatic pattern memory means, and when a first predetermined relationship is detected from said 5th sharp flag, said automatic pattern control means produces an automatic pattern of notes having a note that is a semitone higher than a corresponding note in the automatic pattern of notes stored in said automatic pattern memory means.

26. The apparatus as claimed in claim 24 further comprising:

automatic pattern memory means for storing data corresponding to an automatic pattern of notes;

automatic pattern control means for producing an automatic pattern of notes according to the data stored in said first memory means and the notes stored in said automatic pattern memory means; and wherein said processor means determines the relationship between the data stored in said first memory means and the data stored in said automatic pattern memory means, and when a second predetermined relationship is detected from said minor 3rd-minor 5th flag, said automatic pattern control means produces an automatic pattern of notes having a note that is a semitone lower than a corresponding note in the automatic pattern of notes stored in said automatic pattern memory means.

27. In an electronic musical instrument having a plurality of playing keys, each of which corresponds to a musical note, an apparatus for identifying the chord type and root note, the chord type and root note corresponding to notes which have been selected by playing a plurality of the playing keys, said apparatus comprising:

detecting means for detecting whether or not each of the playing keys among the plurality of playing keys is being played;

first memory means for storing bits corresponding to each note detected by said detecting means as being played;

second memory means for storing a bit for each of an octave of notes, each bit being set that corresponds to chromatically identical notes detected by said detecting means as being played;

processor means for setting a 4th interval flag bit when both a 5th interval note and a 4th interval note are played as determined by said processor means from the bits which are set and their positions in said second memory means, and wherein when a 5th interval note but no 4th interval note is found by said processor means as being played, said processor means tests to determine whether a 2nd interval note exists among the notes corresponding to the bits which are set in said first memory means, and, if a 2nd interval note is found by said processor means, said processor means transposes until the bits in said second memory means are positioned so as to provide a second root-5th pair, said processor means then setting said 4th interval flag bit.

28. The apparatus as claimed in claim 27 further comprising:

automatic pattern memory means for storing data corresponding to an automatic pattern of notes; automatic pattern control means for producing an automatic pattern of notes according to the data stored in said first memory means and the notes stored in said automatic pattern memory means; and wherein said precessor means determines the relationship between the data stored in said first memory means and the data stored in said automatic pattern memory means, and when a first predetermined relationship is detected from said 4th interval flag, said automatic pattern control means produces an automatic pattern of notes having a note that is a semitone higher than a corresponding note in the automatic pattern of notes stored in said automatic pattern memory means.

29. In an electronic musical instrument having a plurality of playing keys, apparatus for generating a musical tone when a key is played, the volume of which is related to the manner in which the key is played, said apparatus comprising:

normally closed contact means for each of the playing keys, said normally closed contact means for each playing key being closed when that playing key is not being played, and said normally closed contact means being open for each playing key when that playing key is being played;

normally open contact means for each of the playing keys, said normally open contact means for each playing key being open when that playing key is not being depressed, and said normally open contact means for each playing key being closed when that playing key is depressed;

scanning means for detecting whether said normally closed contact means for each playing key is closed or open and for detecting whether said normally open contact means for each playing key is open or closed;

timer means responsive to said scanning means for timing the transition time from when the normally closed contact means for each playing key becomes open until the normally open contact means for that playing key becomes closed;

processor means for providing a volume control signal to control the volume at which the tone corresponding to the playing key played is to be sounded, said processor means determining the volume according to a predetermined relationship with the time measured by said timer means; and audio output means for generating and sounding the musical tone corresponding to a key whose associated normally open contact means is closed, the volume level at which said audio output means sounds the musical tone being controlled by the volume control signal provided by said processor means, whereby musical tones are generated at volume levels related to the transition time required for each associated playing key to be depressed from its at rest position to its depressed position.

30. The apparatus as claimed in claim 29 wherein said timer means further comprises:

a plurality of register means for timing the travel of keys that are being depressed; and wherein when said scanning means detects that one of said normally closed contact means has become open, said processor means sets one of said register means to a predetermined value and periodically decrements this value stored in said register means until said scanning means detects that the corresponding one of said normally open contact means has become closed, said processor means determining the time between when the normally closed contact means became open until the normally open contact means became closed from the value stored in the corresponding one of said register means at the time the corresponding one of said normally open contact means became closed.

31. The apparatus as claimed in claim 30 further comprising a lookup table in which are stored a value of amplitude corresponding to every possible value of transition time stored in said first register means when one of said normally open contact means becomes closed, and wherein said processor means determines the amplitude at which a note corresponding to a key played is to be sounded from the amplitude value in said lookup table corresponding to the value of transition time of the played key.

32. The apparatus as claimed in claim 29 further comprising volume potentiometer means wherein the volume control signal provided by said processor means is also related to the setting of said volume potentiometer means.

33. The apparatus as claimed in claim 30 or 31 wherein said register means further comprises:

switch scan status register means for storing data for each playing key corresponding to the state of said normally closed contact means and said normally open contact means as detected by said scanning means;

key timer means for storing a number corresponding to the travel time of a key being played, said number being set to a predetermined value when the data stored in said switch scan status register means for an associated key changes from a first state to a second state and being periodically decremented by said processor means until the data stored in said switch scan status register means changes from the second state to a third state; and key number register means for storing the location in said key timer register means in which the travel time for an associasted key being played is stored, wherein said processor means assigns a location in said key timer register means to a key when the key is played and storing said location in said key number register means, whereby the locations in said key timer register means are assigned to the keys being played and are reassigned as other keys are played after the travel times of the keys presently being played have been determined by said processor means.

34. The apparatus as claimed in claim 33 wherein the number of locations in said key timer register means in which travel times are stored for associated keys are stored is fewer than the number of playing keys in the array of playing keys.

35. The apparatus as claimed in claim 34 wherein when the number of keys in transition from not being played to being played is greater than the number of locations in said key timer register means, said processor means assigns the travel time for the most recently timed key to a key in transition in excess of the number of locations in said key timer register means.

36. The apparatus as claimed in claim 1 or 29 further comprising:

amplitude register means for storing an amplitude value corresponding to the amplitude at which a tone corresponding to a key played within a predetermined range of keys in the plurality of playing keys is to be sounded;

harmony generator means for generating fill-in harmony notes; and wherein said processor means generates a volume control signal for the fill-in harmony notes related to the amplitude value stored in said amplitude register means, said volume control signal causing said audio output means to sound the fill-in tones at a volume having a predetermined relationship to the volume at which the tone corresponding to the note of the key played is sounded by said audio output means.

37. In an electronic musical instrument, an automatic style pattern generator apparatus for generating musical chords, said apparatus comprising:

an array of playing keys having a first and a second range of playing keys;

processor means for generating a musical pattern of notes corresponding to the keys played in said first range of playing keys, and for generating notes corresponding to a chord based upon the root note identified by a key played in said second range of playing keys, wherein said processor means ceases generating the musical pattern of notes upon the playing of a key in said second range of playing keys; and audio output means for generating and sounding the tones corresponding to the notes generated by said processor means, whereby musical tones related to the keys played in said first range of playing keys and a musical chord having the root note identified by a key played in said second range of playing keys are sounded.

38. The apparatus as claimed in claim 37 wherein said array of playing keys further comprises a third range of playing keys and wherein said processor means also generates notes corresponding to the keys played in said third range of playing keys.

39. The apparatus as claimed in claim 38 wherein said processor means also generates a note of the same nomenclature as, but higher in frequency than, the note of a key played within said third range of playing keys in the array of playing keys.

40. In an electronic musical instrument having a plurality of playing keys, apparatus for generating a musical tone when a key is played, said apparatus comprising:

detecting means for detecting the keys played;

volume control generating means for providing a volume control signal to control the volume at which the tone corresponding to each key played as detected by said detecting means is to be sounded;

amplitude register means for storing an amplitude value corresponding to each volume control signal provided by said volume control generating means for the keys played;

harmony generator means for generating fill-in harmony notes;

processor means for generating a fill-in harmony volume control signal for the fill-in harmony notes, said fill-in harmony volume control signal having a predetermined relationship to at least one of the amplitude values stored in said amplitude register means; and audio output means for generating and sounding the musical tones corresponding to the keys played, the volume level at which said audio output means sounds each of the tones being controlled by the volume control signals provided by said volume control generating means, said audio output means also generating and sounding fill-in harmony musical tones corresponding to the fill-in harmony notes generated by said harmony generator means, the volume level at which said audio output means sounds each of the fill-in harmony tones being controlled by the fill-in harmony volume control signals provided by said processor means.

41. In an electronic musical instrument having an array of playing keys, each of which by its playing action initiates the onset of a corresponding musical tone and which by the power of its playing action controls the volume of the corresponding musical tone, apparatus connected to the keys of a limited range of said array for generating an automatic sequential pattern of musical notes, said apparatus comprising:

memory means for providing fixed, stored data corresponding to the notes of an automatic sequential pattern;

key detecting means for sensing the playing of a key within said limited range;

processing means for generating notes from the data in said memory means, the notes being a function of a key being manually played within said limited range as sensed by said key detecting means; and audio output for generating and sounding, while at least one key is being manually played within said limited range, the tones of said automatic sequential pattern according to the notes generated by said processing means, whereby an automatic sequential pattern of musical tones commences upon the playing of a key in said limited range and continues for so long as at least one key in said range is being manually played.

42. The apparatus as claimed in claim 41 further comprising:

dynamic key means for providing volume control data corresponding to the power of the playing action of keys within said limited range, wherein said processing means also provides a volume control signal for each note it generates, the volume control signal being a function of the volume control data provided by said dynamic key means, and wherein said audio output means controls the volume of the tones of the automatic sequential pattern according to the volume control signal provided by said processing means, whereby the volume of the tones in the automatic sequential pattern is dependent upon the playing action of the key within said limited range which initiates the pattern.

43. In an electronic musical instrument having a plurality of playing keys, an improved automatic pattern generating system for generating automatic patterns in accordance with actual chords played, said apparatus comprising:

detecting means for detecting the playing of each of the playing keys;

first memory means for storing data corresponding to the notes of the keys detected by said detecting means as being played;

second memory means for storing data corresponding to an automatic pattern of notes;

chord identification means for detecting predetermined relationships within the data stored in said first memory means;

automatic pattern control means for producing an automatic pattern of notes according to the relationship detected by said chord identification means and the data stored in said second memory means, wherein when a predetermined relationship within the data stored in said first memory means and the automatic pattern of notes stored in said second memory means is detected by said chord identification means, said automatic pattern control means produces an automatic pattern of notes having a note that is a semitone higher than a corresponding note in the automatic pattern of notes stored in said second memory means; and audio output means for generating and sounding the tones corresponding to the notes produced by said automatic pattern control means, whereby an automatic pattern of musical tones is provided that includes at least some notes that are chromatically the same as the notes of the chord played.

44. The apparatus as claimed in claim 43 wherein the data corresponding to an automatic pattern of notes stored in said second memory means includes an automatic note code for each note of the automatic pattern and wherein said automatic pattern control means produces a note a semitone higher than a corresponding note in the automatic pattern of notes by adding one to the automatic note code for the corresponding note.

45. In an electronic musical instrument having a plurality of playing keys, an improved automatic pattern generating system for generating automatic patterns in accordance with actual chords played, said apparatus comprising:

detecting means for detecting the playing of each of the playing keys;

first memory means for storing data corresponding to the notes of the keys detected by said detecting means as being played;

second memory means for storing data corresponding to an automatic pattern of notes;

chord identification means for detecting predetermined relationships within the data stored in said first memory means;

automatic pattern control means for producing an automatic pattern of notes according to the relationship detected by said chord identification means and the data stored in said second memory means, wherein when a predetermined relationship within the data stored in said first memory means and the automatic pattern of notes stored in said second memory means is detected by said chord identification means, said automatic pattern control means produces an automatic pattern of notes having a note that is a semitone lower than a corresponding note in the automatic pattern of notes stored in said second memory means; and audio output means for generating and sounding the tones corresponding to the notes produced by said automatic pattern control means, whereby an automatic pattern of musical tones is provided that includes at least some notes that are chromatically the same as the notes of the chord played.

46. The apparatus as claimed in claim 45 wherein the data corresponding to an automatic pattern of notes stored in said second memory means includes an automatic note code for each note of the automatic pattern and wherein said automatic pattern control means produces a note a semitone lower than a corresponding note in the automatic pattern of notes by subtracting one from the automatic note code for the corresponding note.

47. In an electronic musical instrument having a plurality of playing keys, an improved automatic pattern generating system for generating automatic patterns in accordance with actual chords played, said apparatus comprising:

detecting means for detecting the playing of each of the playing keys;

first memory means for storing data corresponding to the notes of the keys detected by said detecting means as being played;

second memory means for storing data corresponding to an automatic pattern of notes;

chord identification means for detecting predetermined relationships within the data stored in said first memory means;

automatic pattern control means for producing an automatic pattern of notes according to the relationship detected by said chord identification means and the data stored in said second memory means, wherein when a predetermined relationship between the data stored in said first memory means corresponding to the notes of the keys played and the automatic pattern of notes stored in said second memory means is detected by said chord identification means, said automatic pattern control means produces an automatic pattern of notes not including a note corresponding to one of the notes in the automatic pattern of notes stored in said second memory means, whereby a note of the automatic pattern of notes is eliminated when a note is not identified within said first memory means that is chromatically related to the automatic pattern of notes stored in said second memory means; and audio output means for generating and sounding the tones corresponding to the notes produced by said automatic pattern control means, whereby an automatic pattern of musical tones is provided that includes at least some notes that are chromatically the same as the notes of the chord played.

* * * * *

UNITED STATES PATENT AND TRADEMARK OFFICE

CERTIFICATE OF CORRECTION

PATENT NO. : 4,449,437

DATED : May 22, 1984

INVENTOR(S) : Robert B. Cotton, Jr. and Dale M. Uetrecht

It is certified that error appears in the above-identified patent and that said Letters Patent is hereby corrected as shown below:

Col. 2, line 39, "measure" should be --measures--.

Col. 5, line 13, "13a" should be --13a,--.

Col. 5, line 66, "kay" should be --key--.

Col. 6, line 44, "se" should be --see--.

Col. 6, line 63, "illustrate" should be --illustrates--.

Col. 7, line 65, "and" second occurrence should be --are--.

Col. 8, line 48, "communicates" should be --communicated--.

Col. 8, line 61, "not" should be --now--.

Col. 8, line 64, "if" should be --is--.

Col. 9, line 67, "mumerous" should be --numerous--.

Col. 10, line 57, "harware" should be --hardware--.

Col. 11, line 9, "serial" should be --Serial--.

UNITED STATES PATENT AND TRADEMARK OFFICE

CERTIFICATE OF CORRECTION

PATENT NO. : 4,449,437

DATED : May 22, 1984

INVENTOR(S) : Robert B. Cotton, Jr. and Dale M. Uetrecht

It is certified that error appears in the above-identified patent and that said Letters Patent is hereby corrected as shown below:

Col. 12, line 9, "syle" should be --style--.

Col. 12, line 18, "playe" should be --played--.

Col. 12, line 24, "base" should be --bass--.

Col. 12, line 31, "C" should be --G--.

Col. 13, line 14, "memory), 64" should be --memory), and 64--.

Col. 14, line 6, "required, tempo" should be --required, the tempo--.

Col. 14, line 46, "240" should be --440--.

Col. 15, line 13, "send" should be --sends--.

Col. 15, line 16, "routine" should be --Routine--.

Col. 15, line 27, "mode:" should be --mode--.

Col. 16, line 4, "FIFO's every" should be --FIFO's 205 every--.

Col. 16, line 9, "FIFo's" should be --FIFO's--.

Col. 16, line 50, "difference" should be --differences--.

UNITED STATES PATENT AND TRADEMARK OFFICE

CERTIFICATE OF CORRECTION

PATENT NO. : 4,449,437

DATED : May 22, 1984

INVENTOR(S) : Robert B. Cotton, Jr. and Dale M. Uetrecht

It is certified that error appears in the above-identified patent and that said Letters Patent is hereby corrected as shown below:

Col. 17, line 31, "this accomplished" should be --this is accomplished--.

Col. 19, line 5, "mentioned" should be --mentioned,--.

Col. 26, line 26, "forgoing" should be --foregoing--.

Col. 26, line 45, "styels" should be --styles--.

Col. 27, line 22, "routing" should be --routine--.

Col. 28, line 19, "accomplished" should be --accomplishes--.

Col. 28, line 33, "(560," should be --(550, 560,--.

Col. 28, line 37, "routing" should be --routine--.

Col. 28, line 39, "routing" should be --routine--.

Col. 28, line 43, "procesor" should be --processor--.

Col. 29, line 4, "sounded" should be--sounded,--.

Col. 29, line 54, "655" should be --665--.

Col. 30, line 40, "noted" should be --note--.

UNITED STATES PATENT AND TRADEMARK OFFICE

CERTIFICATE OF CORRECTION

PATENT NO. : 4,449,437

DATED : May 22, 1984

INVENTOR(S) : Robert B. Cotton, Jr. and Dale M. Uetrecht

It is certified that error appears in the above-identified patent and that said Letters Patent is hereby corrected as shown below:

Col. 30, line 43, "reset" should be --rest--.

Col. 33, line 26, "the" first occurrence should be --to--.

Col. 33, line 29, "0" (in bold type) should be --0--.

Col. 34, line 23, "0" (in bold type) should be --0--.

Col. 35, line 53, "hereinafter" should be --(hereinafter--.

Col. 37, line 55, "these bits" should be --these three bits--.

Col. 39, line 34, "inthe" should be --in the--.

Col. 45, line 46, "palyer" should be --player--.

Col. 46, line 20, "(11) Bottom Octave Chord" should be a new section heading.

Col. 47, line 8, "O n" should be --On--.

Col. 48, line 15, insert "code" after "note".

UNITED STATES PATENT AND TRADEMARK OFFICE

CERTIFICATE OF CORRECTION

PATENT NO. : 4,449,437

DATED : May 22, 1984

INVENTOR(S) : Robert B. Cotton, Jr. and Dale M. Uetrecht

It is certified that error appears in the above-identified patent and that said Letters Patent is hereby corrected as shown below:

Col. 51, line 25, "bat" should be --beat--.

Col. 51, line 26, "bat" should be --beat--.

Col. 51, line 27, "bat" should be --beat--.

Col. 51, line 28, "bat" should be --beat--.

Col. 51, line 64, "320" should be --300--.

Col. 52, line 5, after "0" insert "of processor".

Col. 52, line 34, "325" should be --324--.

Col. 52, line 44, insert "the" after "during".

Col. 56, line 67, "combing" should be --coming--.

Col. 58, line 30, "form" should be --from--.

Col. 59, line 42, "dampedby" should be --damped by--.

Signed and Sealed this

*Nineteenth* Day of *February 1985*

[SEAL]

*Attest:*

DONALD J. QUIGG

*Attesting Officer* *Acting Commissioner of Patents and Trademarks*